US007066898B2

(12) United States Patent
Mori et al.

(10) Patent No.: US 7,066,898 B2
(45) Date of Patent: Jun. 27, 2006

(54) VIBRATOR, VIBRATION UNIT, AND VIBRATOR CONTROL METHOD

(75) Inventors: Kentaro Mori, Kyoto (JP); Akitoshi Miki, Kyoto (JP); Koichi Tanaka, Kyoto (JP); Kuniyoshi Takahashi, Kyoto (JP)

(73) Assignee: OMRON Corporation, Kyoto (JP)

( * ) Notice: Subject to any disclaimer, the term of this patent is extended or adjusted under 35 U.S.C. 154(b) by 269 days.

(21) Appl. No.: 10/329,661

(22) Filed: Dec. 24, 2002

(65) Prior Publication Data

US 2004/0122343 A1 Jun. 24, 2004

Related U.S. Application Data

(63) Continuation of application No. PCT/JP01/05672, filed on Jun. 29, 2001.

(30) Foreign Application Priority Data

Jun. 30, 2000 (JP) ..... 2000-199599
Nov. 10, 2000 (JP) ..... 2000-344502

(51) Int. Cl.
*A61H 15/00* (2006.01)

(52) U.S. Cl. ..... 601/99; 601/100; 601/103; 601/116

(58) Field of Classification Search ..... 601/86, 601/87, 90, 92, 94, 95, 97, 98, 99, 100, 101, 601/102, 103, 115, 116, 118, 122, 126
See application file for complete search history.

(56) References Cited

U.S. PATENT DOCUMENTS

| | | | | |
|---|---|---|---|---|
| 5,741,218 | A * | 4/1998 | Fujii | 601/90 |
| 6,117,094 | A * | 9/2000 | Fujii | 601/99 |
| 2003/0018284 | A1* | 1/2003 | Lim | 601/98 |

FOREIGN PATENT DOCUMENTS

| | | |
|---|---|---|
| JP | 6-304217 | 11/1994 |
| JP | 9-262264 | 10/1997 |
| JP | 9-294792 | 11/1997 |
| JP | 11-113993 | 4/1999 |
| JP | 2000-102578 | 4/2000 |

* cited by examiner

*Primary Examiner*—Quang D. Thanh
(74) *Attorney, Agent, or Firm*—Beyer Weaver & Thomas LLP

(57) ABSTRACT

A vibrator has massaging balls supported by a treating unit that may be shifted along a subject portion for treatment, guided by guiding members. The treating unit is supported by a supporting structure with respect to the guiding members. A position or orientation altering mechanism is provided for altering the position of the treatment unit in a direction orthogonal to the direction of its shifting or the orientation of the treating unit with respect to the guiding members. The supporting structure may include an engaging unit that engages the guiding members and an arm for supporting the engaging unit.

1 Claim, 42 Drawing Sheets

VIBRATOR, VIBRATION UNIT, AND VIBRATOR CONTROL METHOD

This application is a continuation of International Application No. PCT/JP01/05672, filed Jun. 29, 2001, which claims priority based on Japanese Patent Applications 2000-199599 filed Jun. 30, 2000 and 2000-344502 filed Nov. 10, 2000.

FIELD OF THE INVENTION

This invention relates to a vibrator, a vibration unit and a vibrator control method, which carry out treatments on the human body by driving treating elements.

BACKGROUND OF THE INVENTION

Japanese Patent Publication Tokukou-Hei 1-49496 discloses, as an example of conventional vibrator of this type, a vibrator in which an arm having a pair of treating elements is swingably driven around a main shaft to carry out massaging treatment with the intensity being changed by changing the angle of the arm around the main shaft.

Japanese Utility Model Publication Jikkai-Shou 56-125232 discloses a vibrator in which a pair of massaging rings is swingably attached eccentrically to a first rotation shaft in a tilted manner, a pair of massaging elements is attached to the tip of an arm that is swingably attached to the first rotation shaft through an eccentric cam disc, and the tip of a lever is swingably attached to a second rotation shaft through an eccentric cam disc being supported by a frame in the middle of the above-mentioned arm. In this vibrator, the amount of protrusion of the massaging elements attached to the arm through the lever is changed by adjusting the rotation angle of the eccentric cam disc attached to the second rotation shaft so that the pair of massaging rings or both the pair of massaging rings and the pair of massaging elements are made to contact a human body.

Japanese Patent Publication Tokukou-Shou 61-44027 discloses a vibrator in which a pair of ring members that are attached to a main shaft eccentrically and a side lifting roller are installed and the amount of protrusion of the ring members is changed by rotating the main shaft to adjust the strength so that only the ring members or both of the ring members and the side rising roller are made to contact a human body.

These prior art vibrators have the following problems.

(1) Since the treating unit with treatment elements is caused to shift only along a guide, it is not possible to carry out treatments in accordance with the body shape of the user and, depending on positions of the treating unit, the treating elements tend to separate from the treatment subject portion, thereby weakening the strength to be exerted on the treatment subject portion, or the treating elements are too close to make the force exerting on the treatment subject portion too strong.

(2) When no treatments are being carried out, the treating elements form cumbersome objects.

(3) In general, since the distance between the treating elements and the human body is fixed, it is not possible to carry out treatments with a sufficient strength suitable for the condition and the corresponding portion. Although there are vibrators with which the distance between the treatment elements and the human body is adjustable, the amount of adjustment that can be made is small.

(4) It is not possible to achieve a stimulation-type work such as a finger-pressure therapy.

(5) Pounding stimulation onto the human body can be done only in a fixed operation direction and hence is monotonous.

(6) The number of treating elements that can be made to contact the human body is fixed, and this makes the stimulation monotonous.

The present invention has been accomplished in view of these problems, and its objective is to provide a vibrator, a vibration unit and a vibrator control method, which can properly control a force to be exerted on a treatment subject portion by increasing the amount of adjustment of the distance between the treating elements and the human body so that treatments are carried out with strength suitable for the condition and the corresponding portion and so that it is possible to achieve treatments with various functions and to prevent the treating elements to be cumbersome when no treatments are applied.

SUMMARY OF THE INVENTION

In order to achieve the above-mentioned objectives, the present invention provides a vibrator having a pair of right and left treating elements, a treating unit that supports the treating elements, and is shiftable along a treatment subject portion, a guiding means which guides the treating unit to shift along the treatment subject portion and a supporting means which supports the treating unit with respect to the guiding means, and this vibrator is further provided with a position altering means which alters the position of the treating unit in a direction approximately orthogonal to the shifting direction with respect to the guiding means.

With this arrangement, it is possible to alter the position of the treating unit supported by the supporting means in a direction substantially orthogonal (or approximately perpendicular) to the shifting direction with respect to the guiding means. Since this arrangement does not change the position and orientation of the member for supporting the treating elements but changes the position of the treating unit itself which shifts along the guiding means, it is possible to form a position altering means without being limited by the driving structure of the treating elements, and consequently to ensure a greater amount of positional change. In other words, since it becomes possible to increase the range of a change in the amount of protrusion with respect to the treatment subject portion, the force to be exerted on the treatment subject portion is more properly controlled so that it is possible to achieve treatments with strength suitable for the condition and the corresponding portion. In other words, it is possible to achieve treatments with various functions.

It is more preferable to install at least two pairs of the above-mentioned treating elements in the shifting direction of the above-mentioned treating unit.

More preferably, the treating elements, at least two pairs of which are installed in the shifting direction of the above-mentioned treating unit, include two pairs of treating elements that have mutually different characteristics.

By installing the treating elements having mutually different characteristics, it becomes possible to provide different treatments by using the respective pairs of the treating elements in a different manner, and consequently to provide treatments having various functions. In this case, the characteristics refer to characteristics such as mechanical properties including a shape, a material, an elastic property, etc., that can provide differences in sensitivity or treatment effects to the user.

The supporting means is preferably arranged to support the treating unit at least two portions in the shifting direction with respect to the guiding means, and the position altering means is preferably arranged to alter the position in a direction substantially orthogonal to the shifting direction with respect to the guiding means of each of the portions of the treating unit supported by the supporting means.

With respect to the supporting means that support portions of the above-mentioned treating unit having different shifting directions, the position altering means is preferably caused to have a function of altering the positions in an independent manner.

The position altering means may alter the positions in a synchronous manner or may alter them independently.

The position altering means preferably has a function for altering the position of the portion of the treating unit supported by the supporting means with respect to the guiding means so as to be directed at least toward the treatment subject portion side.

The supporting means may preferably be provided with an engaging portion that engages the guiding means and an arm which supports the engaging portion and is swingably supported by the treating unit.

The position altering means is preferably provided with a function for altering the swing angle of the above-mentioned arm between a first state in which the center of the swing of the arm is positioned on the treatment subject portion side with respect to the engaging portion and a second state in which the engaging portion is positioned on the treatment subject portion side with respect to the center of the swing of the arm.

With this arrangement, the treating elements are caused to exert a pressing force on the treatment subject portion to carry out treatments, and when the treatments are not necessary, the treating elements are caused to retreat so as not to contact the human body.

The invention provides a vibrator having a pair of right and left treating elements, a treating unit that supports said treating elements, and is shiftable along a treatment subject portion and a guiding means which guides the treating unit to shift along the treatment subject portion, and this vibrator is further provided with a supporting means for supporting the above-mentioned treating unit with respect to the guiding means, and an orientation altering means which alters the orientation of the treating unit supported by the supporting means, with respect to the guiding means.

In this manner, it is possible to form the orientation altering means without being limited by the driving structure of the treating elements not only when the position of the entire position of the treating unit is altered, but also when only the orientation of the treating unit is altered by changing only one portion of the position in the shifting direction of the guiding means. Therefore, by increasing the range of change of the amount of protrusion with respect to the treatment subject portion in the same manner, it becomes possible to control the force exerted on the treatment subject portion more properly and consequently to achieve treatments having strength suitable for the condition and the corresponding portion. If at least two pairs of right and left treating elements are placed in the shifting direction of the treating unit, switching can be made so as to cause the front or rear pair of treating elements in the shifting direction or both of the pairs to contact the treatment subject portion by altering the orientation of the treating elements with respect to the guiding means so that it becomes possible to carry out treatments having various functions.

The present invention also provides a vibration unit having a pair of right and left treating elements, a treating unit which supports the treating elements and is shiftable with respect to a treatment subject portion and a supporting means which supports the treating unit, and joins it to an associated member with the associated member being attached thereto. In this arrangement, the vibration unit may be provided with a position altering means for altering the position of the treating unit in approaching and departing directions with respect to the treatment subject portion.

This invention relates not only to a vibrator in which the treating unit is guided by the guiding means so as to shift along the treatment subject portion but also to a vibration unit which is attached to an associated member selected on demand, such as a chair and a bed, so as to carry out treatments. By using such a vibration unit, it becomes possible to achieve various functions in the same manner. In the above, any member, not limited to items such as a chair and a bed, may be used as the associated member as long as the vibration unit is attached thereto. The associated member may be prepared as a member that can be held by the user, and a vibration unit may be attached to it so as to form a portable vibration device.

A rail member for guiding the supporting means may be attached to either the associated member or the treating unit so that the supporting means is provided with an engaging unit that engages and is caused to shift along the rail member.

The rail member may have an extended part that causes the treating unit to shift in a wider range like the guiding means in the vibrator or a shorter extended part. For example, the extended part may cause only a shift of the treating unit in a limited range that is equivalent to an approaching and departing distance to and from the treating unit. Alternatively, the rail member may be attached to the associated member or may be installed on the treating unit side. The shift of the treating unit is achieved by a relative positional change between the treating unit and the associated member through the supporting means so that the similar shift is achieved by either of the cases in which the rail member is attached to the treating unit and in which it is attached to the associated member.

At least two pairs of these treating elements may be installed in the extending direction of the rail member. At least two pairs of the treating elements, installed in the extending direction of the above-mentioned rail member, may include two pairs of treating elements that have mutually different characteristics.

The supporting means is preferably arranged to support the associated member at two or more portions in the extending direction of the above-mentioned rail member, and the above-mentioned position altering means is preferably arranged to alter the positions of the respective portions of the treating unit supported by the supporting means in the approaching and departing directions with respect to the treating unit.

The position altering means is preferably arranged to have a function for altering the above-mentioned position independently with respect to the respective supporting means that support different portions in the extending direction of the rail member in the above-mentioned treating unit.

The supporting means supports the above-mentioned engaging unit and is provided with an arm that is swingably supported by either the treating unit or the associated member, and the position altering means is preferably provided with a function for altering the swing angle of the above-mentioned arm.

The position altering means is preferably provided with a function for altering the swing angle of the arm between a first state in which the swinging center of the arm is positioned on the treatment subject portion side with respect to the engaging portion and a second state in which the engaging unit is positioned on the treatment subject portion side with respect to the swinging center of the arm.

The position altering means is preferably provided with a function for altering the position of the portion of the treating unit supported by the supporting means with respect to the associated member at least toward the treatment subject portion.

Moreover, the present invention provides a vibration unit having a pair of right and left treating elements, a treating unit which supports the treating elements and is shiftable with respect to a treatment subject portion and a supporting means which supports the above-mentioned treating unit, and joins it to an associated member with the associated member being attached thereto, and in this arrangement, the vibration unit may be provided with an orientation altering means which alters the position of the above-mentioned treating unit supported by the supporting means with respect to the associated member.

The invention also relates to a control method of a vibrator which shifts a first pair of right and left treating elements and a second pair of right and left treating elements placed below the first treating elements along a treatment subject portion in up and down directions, and controls the positions of the above-mentioned first treating elements and second treating elements in the treatment subject direction so as to carry out massaging treatments. This control method includes a step in which the first treating elements are caused to protrude toward the treatment subject portion side with the second treating elements retreating toward the side opposite to the treatment subject portion, at the upper end portion in a predetermined shifting range of the first treating elements and the second treating elements, and another step in which the first treating elements are caused to retreat toward the opposite side from the treatment subject portion, with the second treating elements protruding toward the treatment subject portion, at the lower end portion in a predetermined shifting range of the first treating elements and the second treating elements.

The invention further relates to a control method of a vibrator which shifts a first pair of right and left treating elements and a second pair of right and left treating elements placed below the first treating elements along a treatment subject portion in up and down directions, and controls the positions of the above-mentioned first treating elements and second treating elements in the treatment subject direction so as to carry out massaging treatments. The control method includes a step in which the first treating elements are caused to retreat toward the side opposite to the treatment subject portion with the second treating elements protruding toward the treatment subject portion, at an upper end portion within a predetermined shifting range of the first treating elements and the second treating elements, and another step in which the first treating elements are caused to protrude toward the treatment subject portion, with the second treating elements retreating toward the side opposite to the treatment subject portion, at a lower end portion within a predetermined shifting range of the first treating elements and the second treating elements.

The invention still further relates to a control method of a vibrator which shifts a first pair of right and left treating elements and a second pair of right and left treating elements placed below the first treating elements along a treatment subject portion in up and down directions, and controls the positions of the above-mentioned first treating elements and second treating elements in the treatment subject direction so as to carry out massaging treatments. This control method includes a step in which the first treating elements are caused to retreat toward the side opposite to the treatment subject portion with the second treating elements protruding toward the treatment subject portion, at a predetermined position within a shifting range at the time of the downward shifting process along the treatment subject portion, and another step in which the first treating elements are caused to protrude toward the treatment subject portion, with the second treating elements retreating toward the side opposite to the treatment subject portion, at a predetermined position within a shifting range at the time of the upward shifting process along the treatment subject portion.

Thus, the positions along the treatment subject portion of the first treating elements and the second treating elements placed longitudinally are altered at various positions during the shifting process along the treatment subject portion so that it is possible to eliminate a difference in shifting ranges along the treatment subject portion of the respective treating elements within a predetermined shifting range. Moreover, the treating elements to be made in contact with the treatment subject portion are switched by altering the positions of the first treating elements and second treating elements placed longitudinally in the treatment subject direction so that it becomes possible to achieve treatments having various functions. The vibrator is not limited to two pairs of the first treating elements and the second treating elements but may have more than two pairs of the treating elements.

In the control method of the vibrator, the positions of the first treating elements and the second treating elements in the direction of the treatment subject portion may be controlled in an independent manner.

DETAILED DESCRIPTION OF THE INVENTION

Some embodiments of the invention are described next with reference to drawings.

Figure 1:
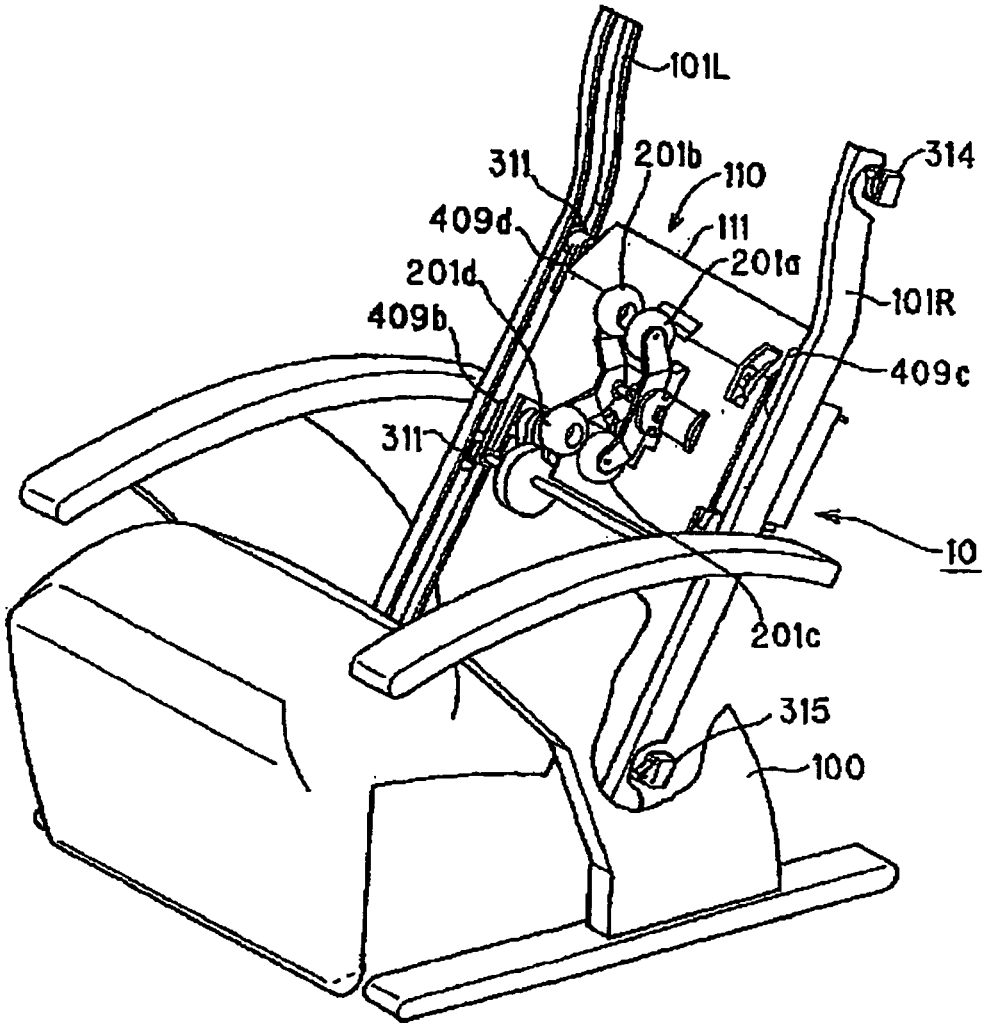
FIG. 1 is a perspective view that shows a schematic structure of a vibrator in accordance with an embodiment of the present invention.
Figure 2:
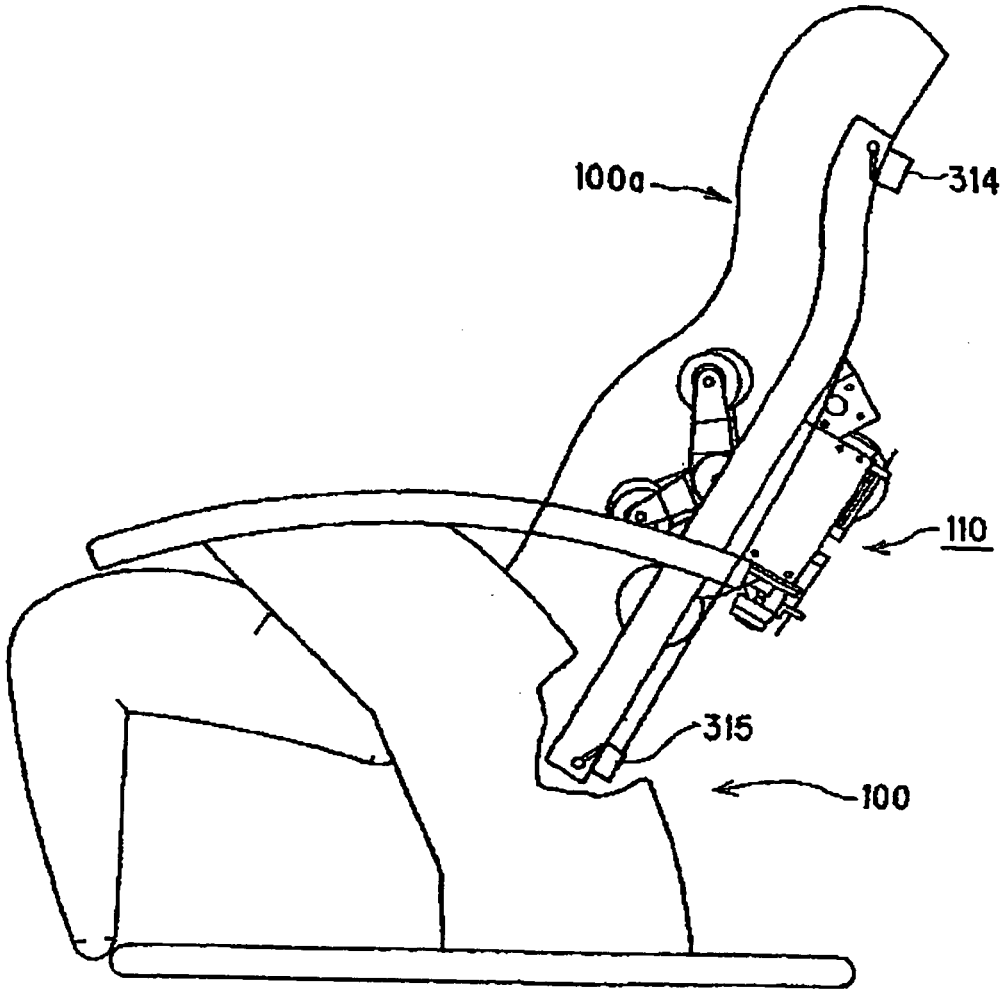
FIG. 2 is a side view showing the entire portion of the vibrator in accordance with the embodiment of the present invention.

FIG. 1 is a perspective view that schematically shows the structure of a vibrator 10 in accordance with a preferred embodiment of the invention. In FIG. 1, a cover sheet and a cushion of a back portion 100*a* are omitted from the drawing. FIG. 2 is a side view showing the entire portion of the vibrator 10, and this drawing shows the outer shape and the inner structure of the back portion 100*a*.

The vibrator 10 is constituted by the back portion 100*a* of a freely reclining chair 100 in which a treating unit 110 is combined. Massaging balls (treating elements) 201*a* to 201*d*, which are placed so as to protrude toward the surface side covered with a cover sheet of the back portion 100*a* from the treating unit 110, carry out massaging treatments on the human body. The massaging balls include a pair of right and left massaging balls 201*a*, 201*b* (first treating elements) placed on an upper side along the back-muscle direction and a pair of right and left massaging balls 201*c*, 201*d* (second treating elements) placed on the lower side thereof.

The treating unit 110 is supported by a pair of guide rails (guiding means, rail member) 101R, 101L having a U-shape (box shape) in its cross-section that is placed along the back portion 100*a* with its openings aligned face to face with each other. The treating unit 110 is provided with a lifting pinion 310 and a lifting roller 311, which will be described below, engaged by a crack installed on the inside of the guide rails 101R, 101L, and caused to shift upward and downward along the guide rails 101R, 101L by rotatably driving the lifting pinion 310.

Figure 3:
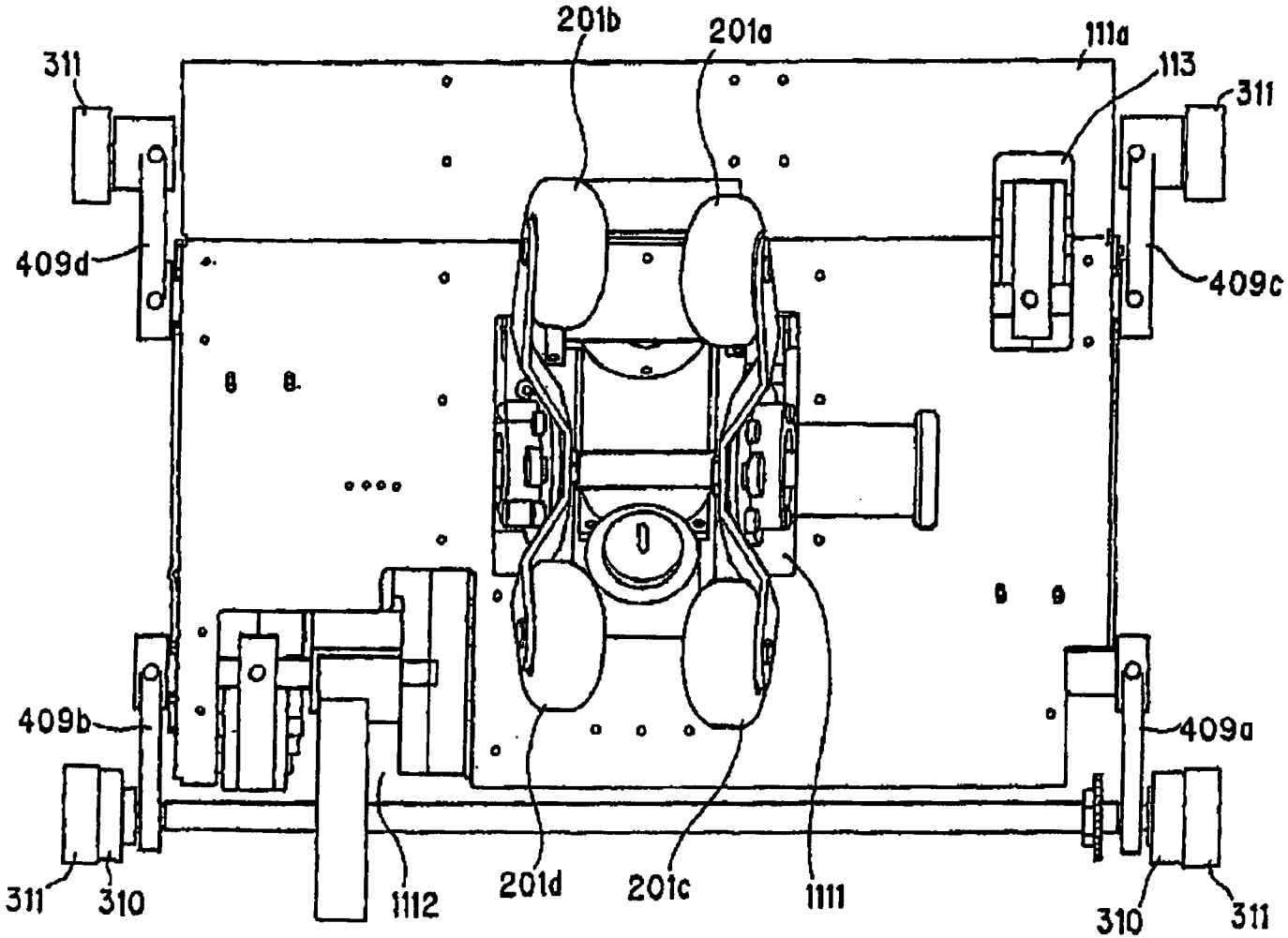
FIG. 3 is a front view showing a treating unit.
Figure 4:
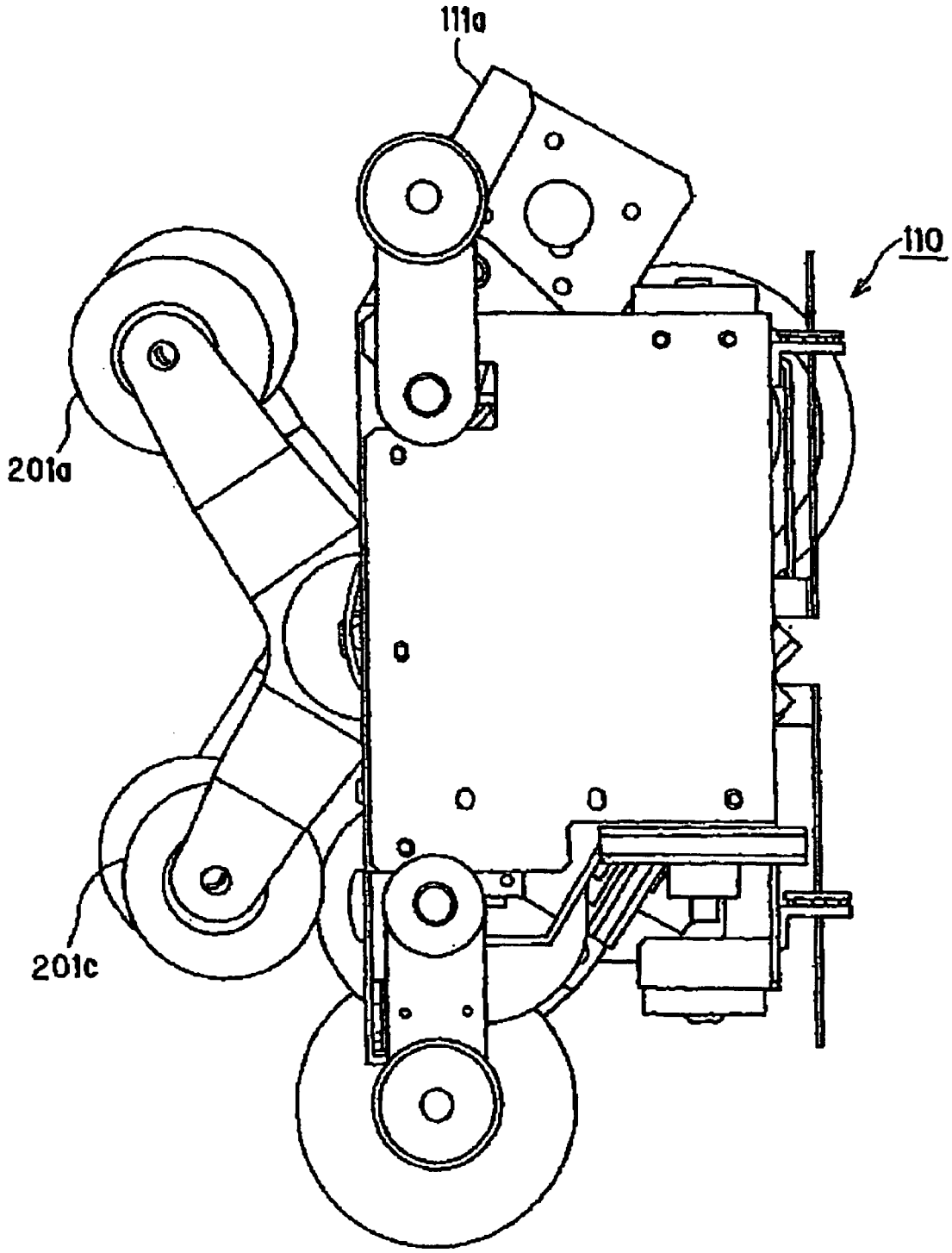
FIG. 4 is a right side view of the treating unit.
Figure 5:
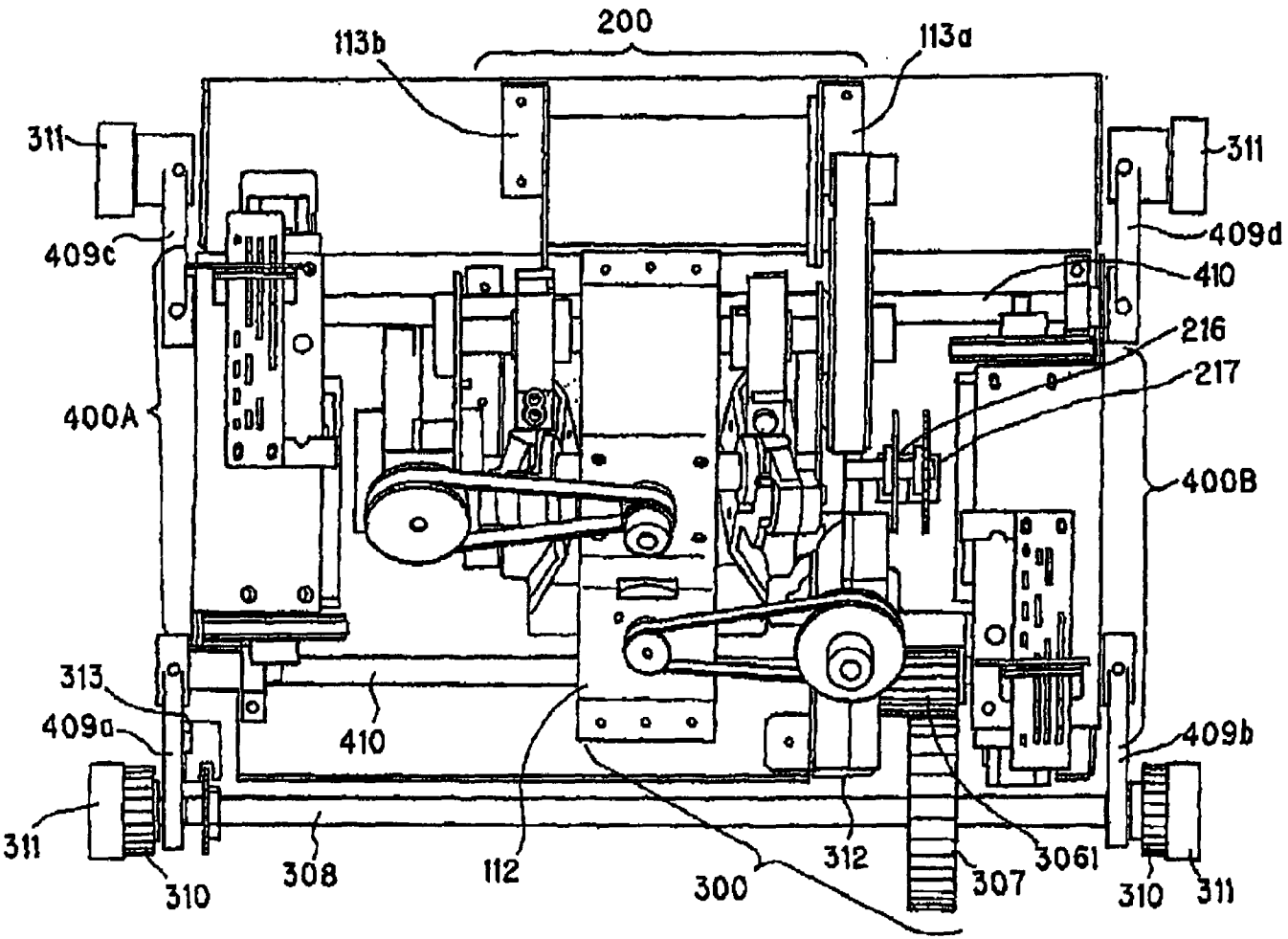
FIG. 5 is a rear face view of the treating unit.
Figure 6:
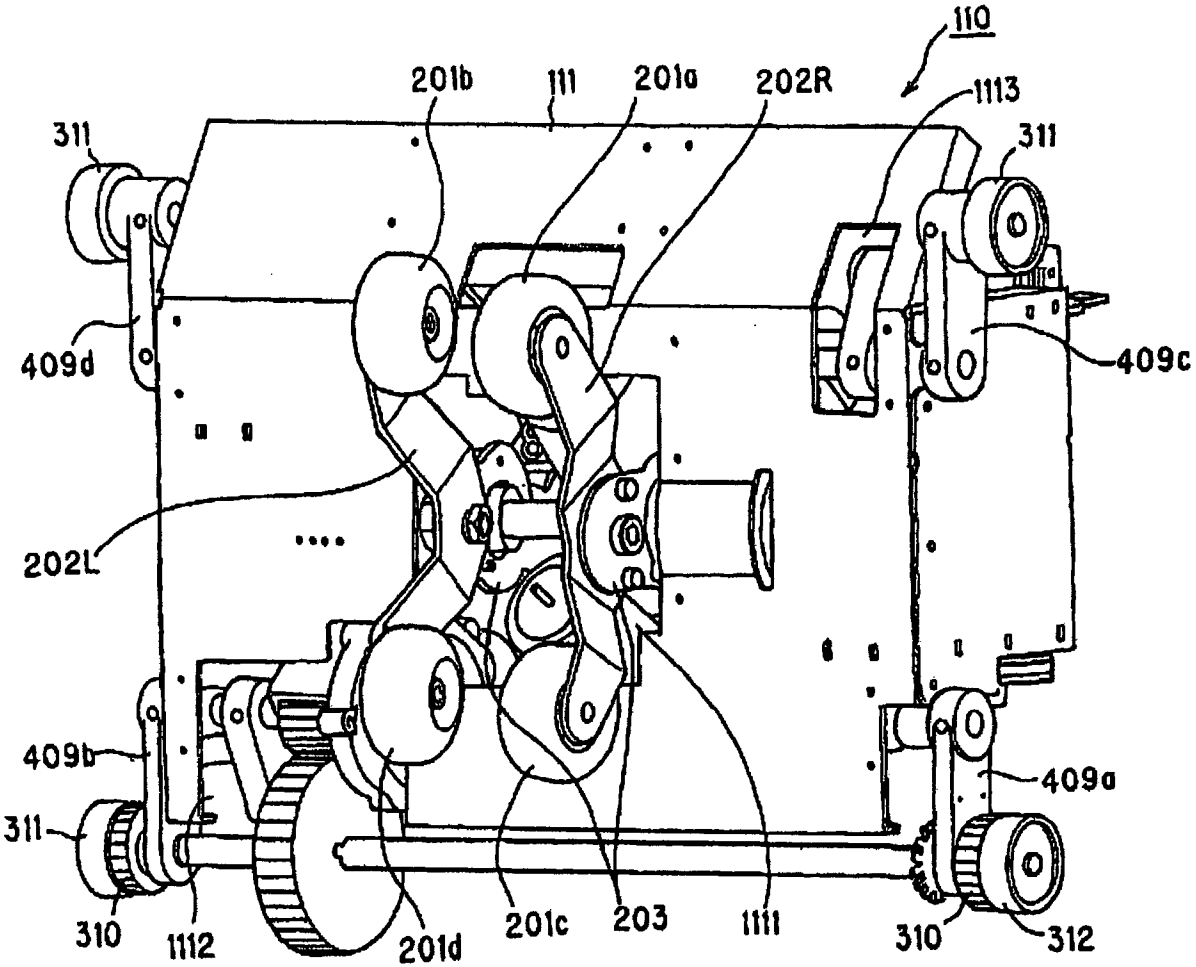
FIG. 6 is a perspective view of the front face of the treating unit.
Figure 7:
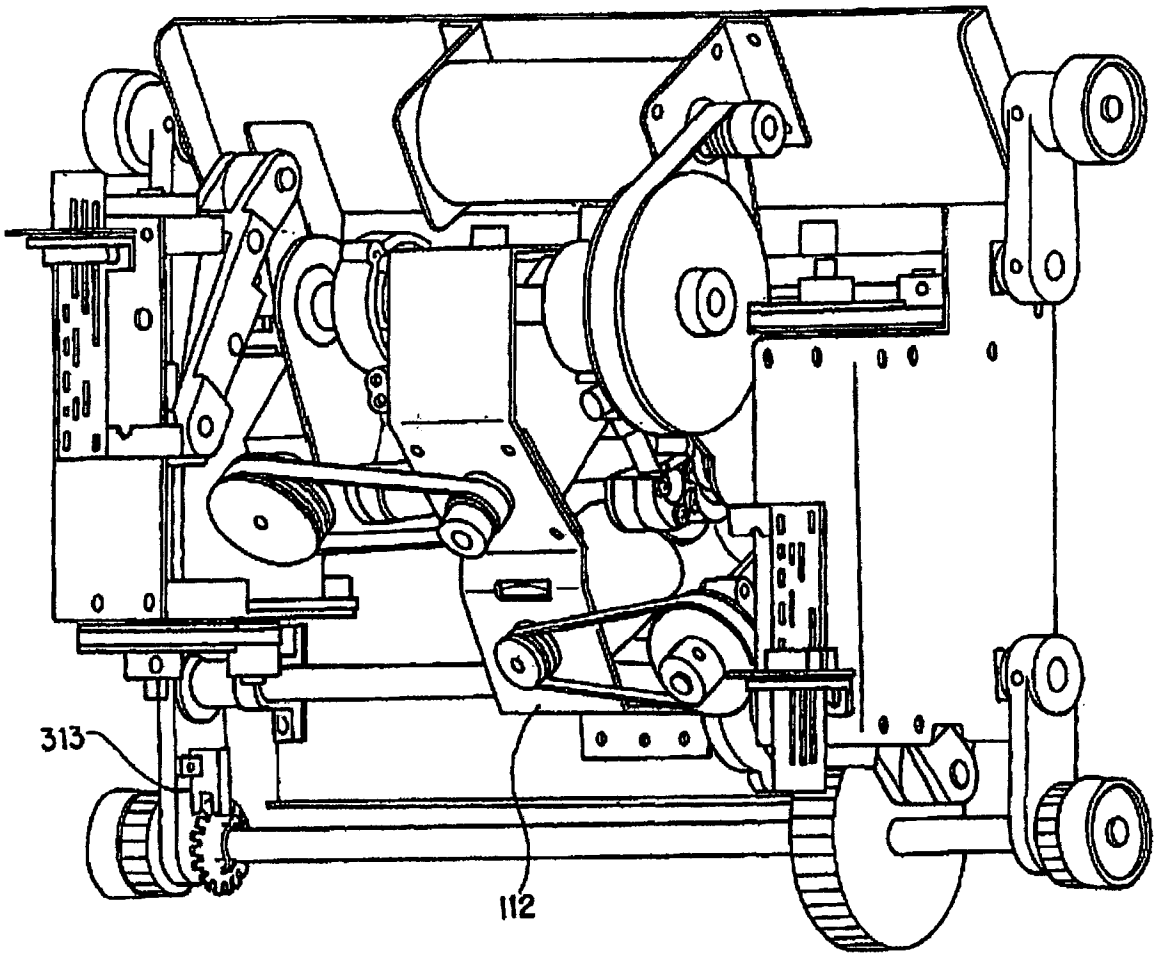
FIG. 7 is a perspective view of the rear face of the treating unit.

FIG. 3 is a front view of a treating unit 110, FIG. 4 is a drawing that shows the right-hand side view thereof, FIG. 5 is a drawing that shows the backside view thereof, FIG. 6 is a perspective view of the front face side thereof, and FIG. 7 is a perspective view of the backside view thereof.

The front of the treating unit 110 is covered with a plate-shaped base member 111. The base member 111 has an upper end portion that is bent toward the back face side and is provided with an opening section 1111 having a substantially rectangular shape from which massaging balls 201*a* to 201*d* protrude in the center thereof. The base member 111*a* is provided with a cutout section 1112 and an opening section 1113 so as not to interfere with gears and the like. The vibration unit 110 is formed with the treating unit 110 and a treating-unit front-rear position altering unit 400, which will be described below.

(Structure of the Treating Unit)

Figure 8:
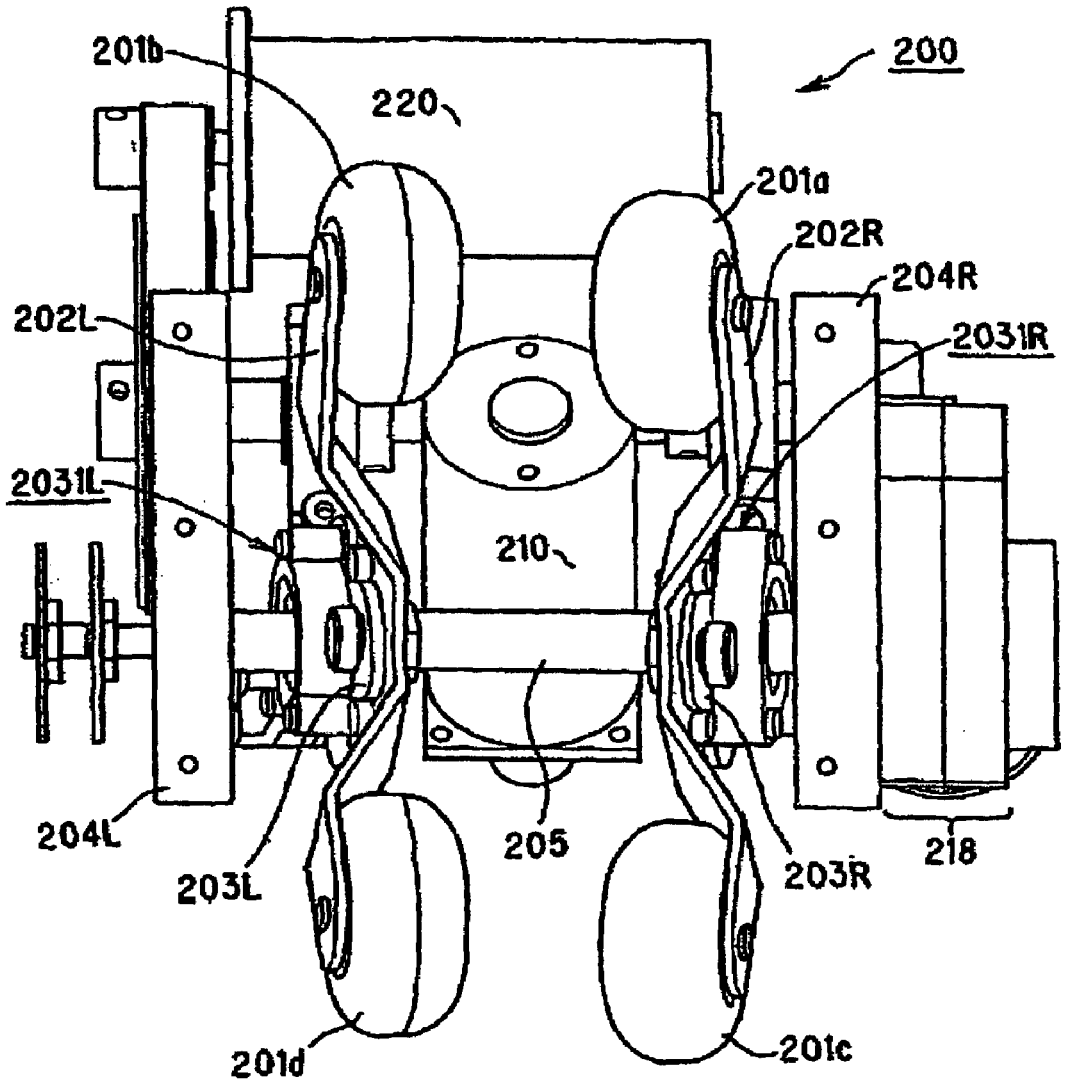
FIG. 8 is a front view of a treating portion.
Figure 9:
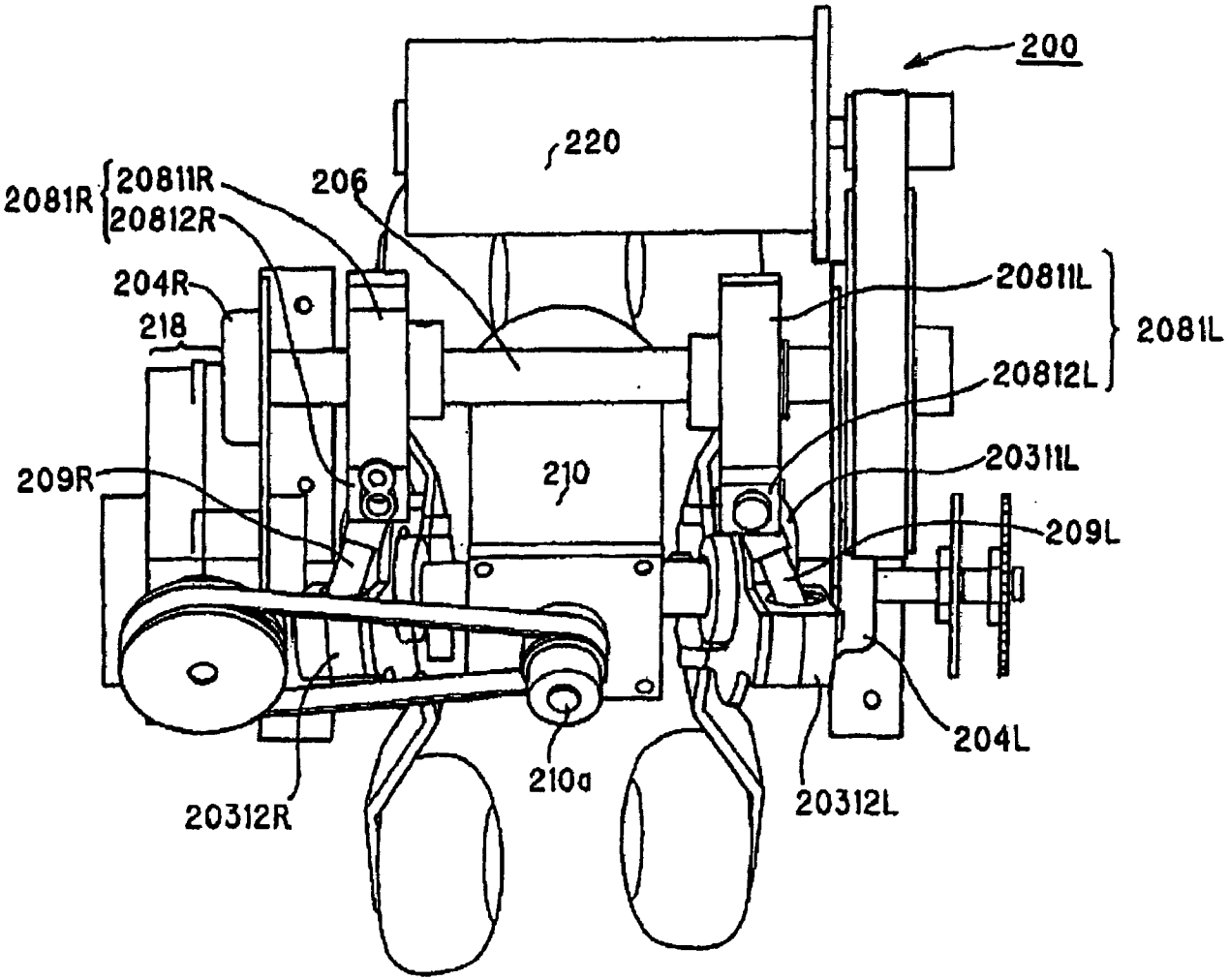
FIG. 9 is a rear face view of the treating portion.
Figure 10:
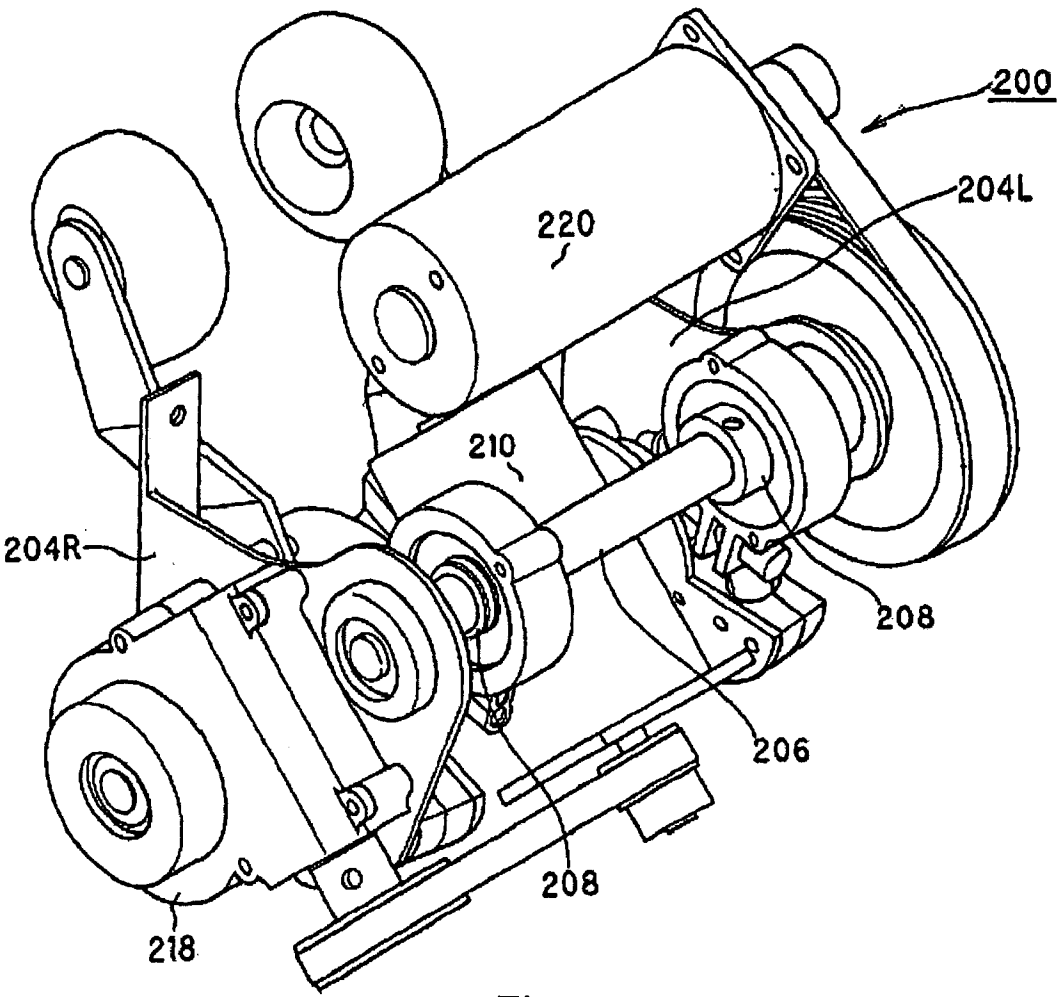
FIG. 10 is a perspective view taken from diagonally above the rear face of the treating portion.
Figure 11:
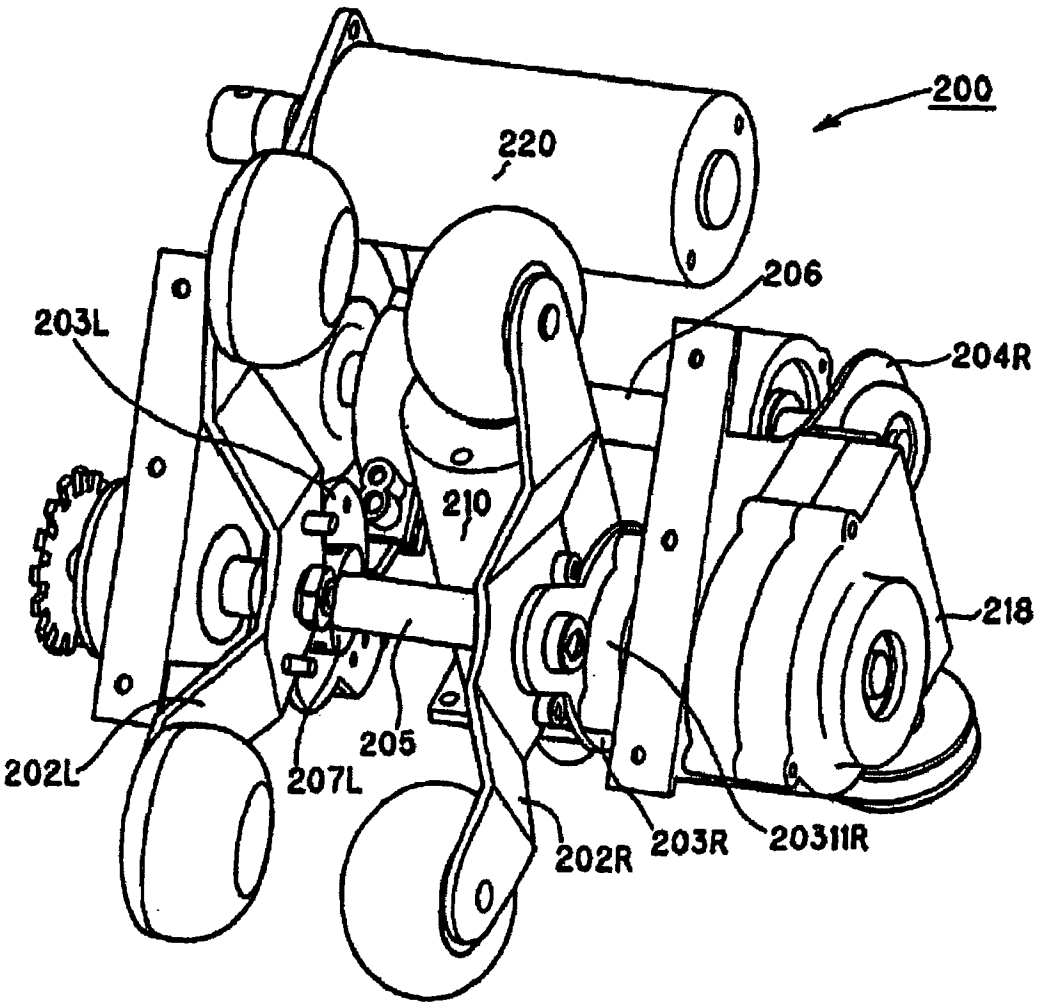
FIG. 11 is a perspective view taken from the right side of the front face of the treating portion.
Figure 12:
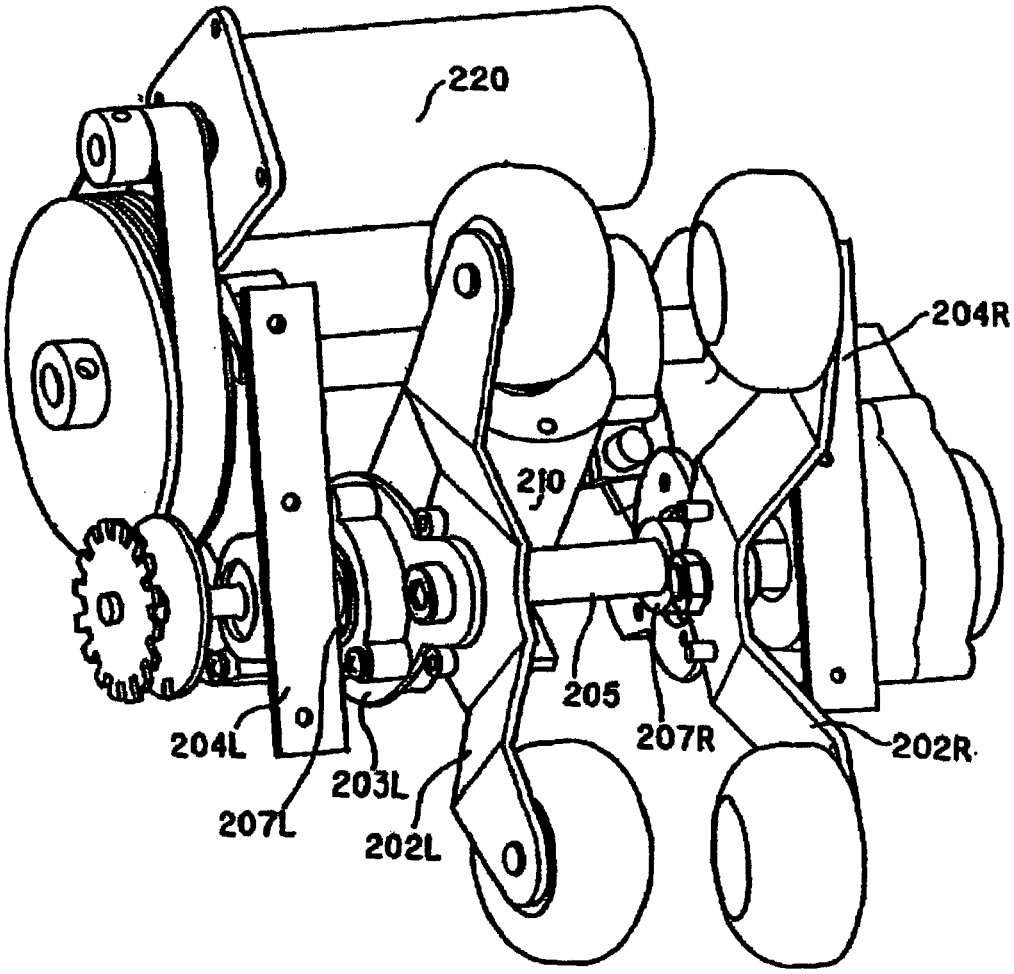
FIG. 12 is a perspective view taken from the left side of the front face of the treating portion.
Figure 13:
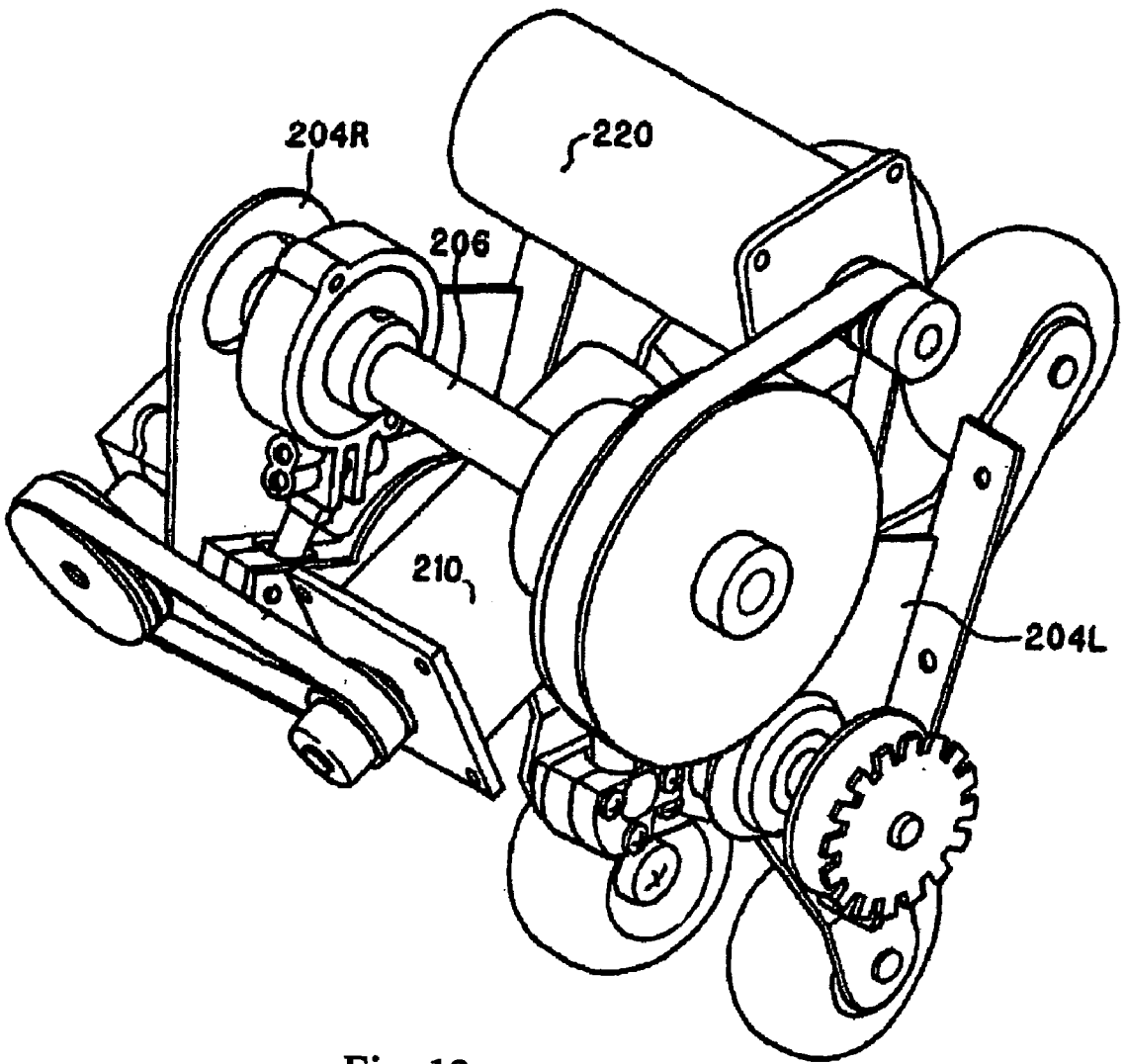
FIG. 13 is a perspective view taken from below the rear face of the treating portion.

FIG. 8 is a front view of the treating unit 200 that is attached to the base member 111, FIG. 9 is a drawing that shows a rear view thereof, FIG. 10 is a perspective view taken from above the rear face thereof, FIG. 11 is a perspective view taken from the right side of the front face of the treating portion, FIG. 12 is a perspective view taken from the left-hand side of the front face thereof, and FIG. 13 is a perspective view taken from below the rear face thereof.

Four massaging balls 201*a* to 201*d* are rotatably supported by the respective tip portions of V-shaped massaging ball arms 202R, 202L. The base ends of the massaging ball arms 202R, 202L are secured to arm supporting members 203R, 203L. Cylindrically shaped tilt sleeves 207R, 207L are secured to right and left sides of a massaging shaft 205 in a manner so as to tilt with respect to each axial direction; thus, the tilt states of the tilted sleeves 207R, 207L relative to the axial direction are set symmetrically with respect to right and left shapes. Each of bearing cases 2031R, 2031L is freely rotatably fitted to the periphery of each of the tilted sleeves 207R, 207L through bearings that rotate along the circumferential face thereof. Arm supporting members 203R, 203L are secured to the side faces of the bearing cases 2031R, 2031L. The bearing cases 2031R, 2031L are provided with base portions 20311R, 20311L that are fitted to the periphery of the tilt sleeve 207, and link receiving sections 20312R, 20312L that are formed so as to protrude in the circumferential direction. One end of each of the links 209R, 209L, which is formed into a spherical shape, is fitted to each of the link receiving sections 20312R, 20312L so that the links 209R, 209L are freely swingably supported along the spherical face.

A pounding shaft 206 is placed in parallel with the massaging shaft 205 above the massaging shaft 205. Cylinder shaped eccentric sleeves 208, 208, which are placed in an eccentric manner in the diameter direction, are secured to the right and left sides of the pounding shaft 206 corresponding to the tilted sleeves 207. The right and left eccentric sleeves 208 are secured so as to be eccentric toward mutually opposing directions with respect to the pounding shaft 206. Each of bearing cases 2081R, 2081L is freely rotatably fitted to the periphery of each of the eccentric sleeves 208 through bearings that rotate along the circumferential surface thereof. The bearing cases 2081R, 2081L are provided with base portions 20811R, 20811L that are fitted to the periphery of the eccentric sleeve 208, and link receiving sections 20812R, 20812L that are formed so as to protrude in the circumferential direction. Each of the links 209R, 209L with its one end connected to the bearing case 2031R, 2031L has the other end that is swingably supported in the axial direction of the pounding shaft 206 with respect to the link receiving sections 20812R, 20812L.

(Massaging Mechanism)

The massaging mechanism of the treating portion 200 is described next.

The massaging shaft 205 and the pounding shaft 206 are rotatably supported by massaging shaft holding brackets 204R, 204L, each having a plate shape, through bearings on both sides sandwiching the massaging ball arms 202R, 202L. The massaging shaft holding brackets 204R, 204L are secured to a base member 111.

Figure 14:
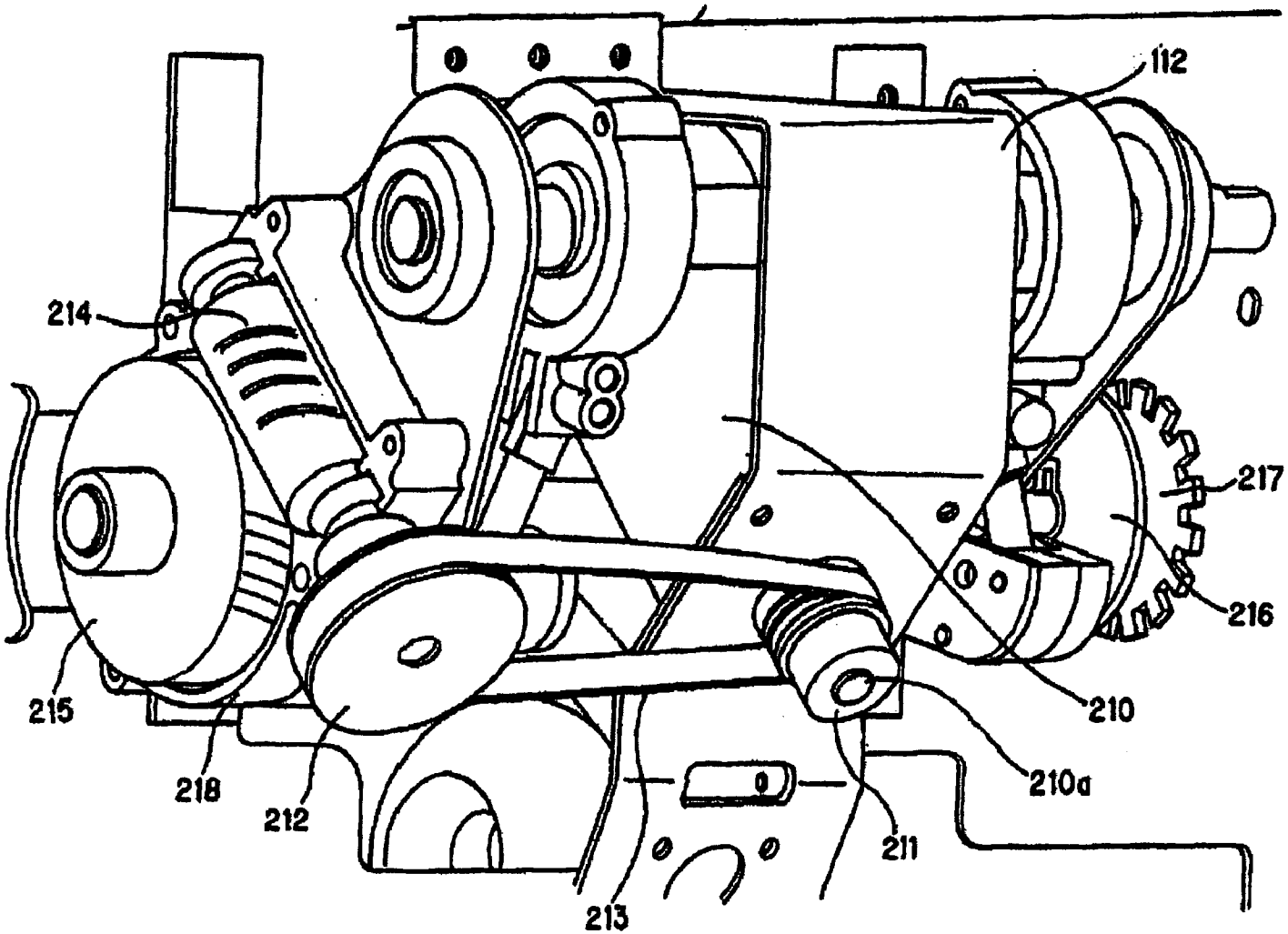
FIG. 14 is a drawing that shows a structure of a massaging mechanism.
Figure 15:
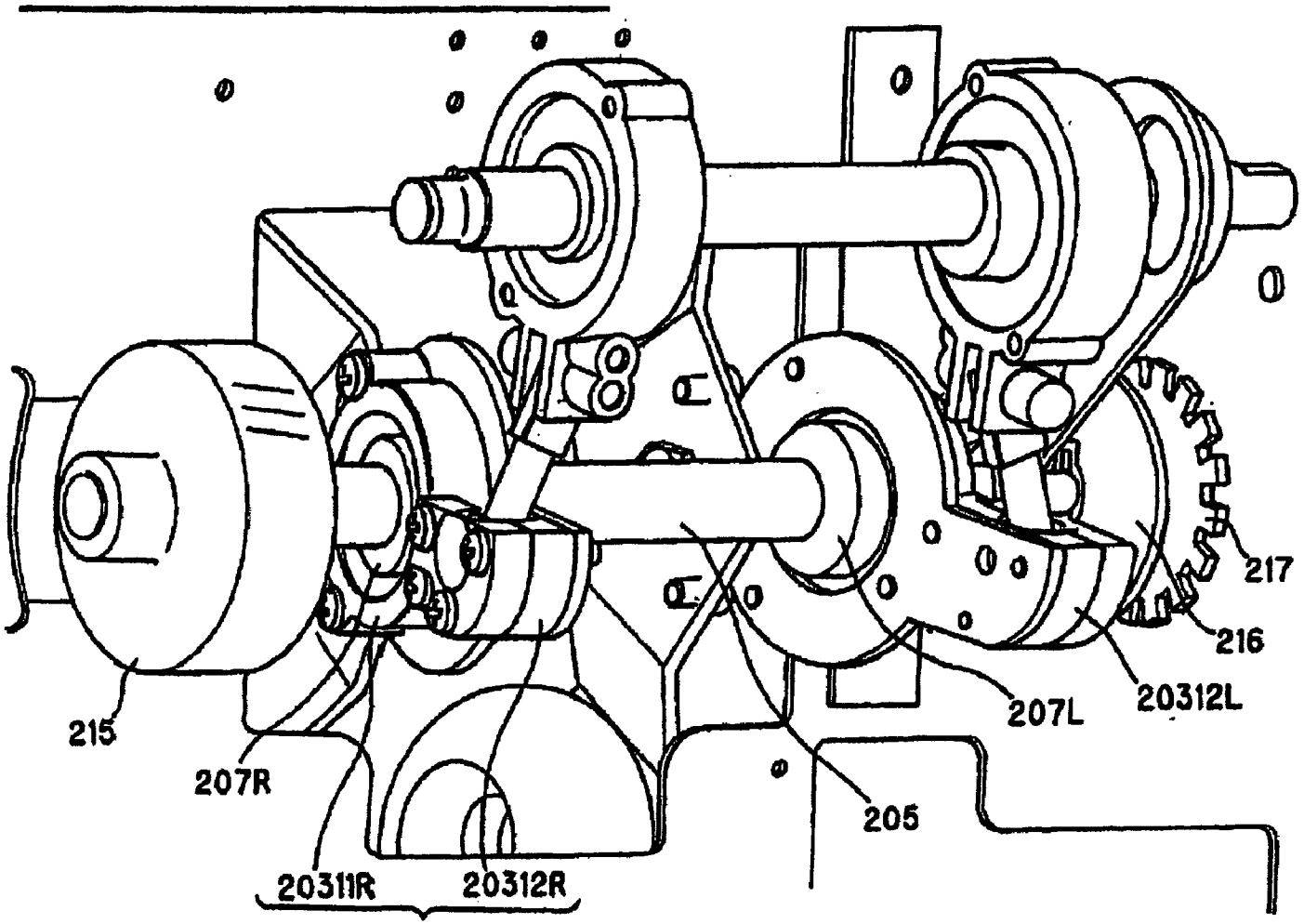
FIG. 15 is a drawing that shows a structure of a massaging mechanism.

FIGS. 14 and 15 are drawings that show a structure of the massaging mechanism. Both drawings show the base member 111 viewed from the rear. For convenience, some parts are omitted from these drawings.

The massaging shaft 205 is driven by a massaging motor 210. The massaging motor 210 is secured to a treating-lifting motor supporting member 112. The massaging-lifting motor supporting member 112 is a plate-shaped member that is bent into an M-shape, and covers the massaging shaft 205 and the pounding shaft 206 in a manner so as to bridge over the rear face side thereof, with its end portion being secured to the rear face side of the base member 111*a*.

A massaging small pulley 211 is attached to the driving shaft 210*a* of the massaging motor 210. A massaging belt 213 in the form of an endless belt, which is wound around the outer circumference of the massaging small pulley 211, is also wound around the outer circumference of a massaging large pulley 212 that is attached to the shaft of a massaging worm gear 214. The massaging worm gear 214 is engaged by a massaging worm wheel 215. The massaging worm wheel 215 is secured to the outer circumference of the massaging shaft 205 in a concentric manner. The massaging worm gear 214 and massaging worm wheel 215 are housed in a massaging gear box 218 attached to the massaging shaft holding bracket 204R, so as to freely rotate therein.

Thus, the driving force of the massaging motor 210 is transmitted through a route including the massaging small pulley 211 massaging belt 213 massaging large pulley 212 massaging worm gear 214 massaging worm wheel 215, while being reduced in its speed, so that the massaging shaft 205 is driven to rotate.

(Pounding Mechanism)

The pounding mechanism of the treating portion 200 is described next.

Figure 16:
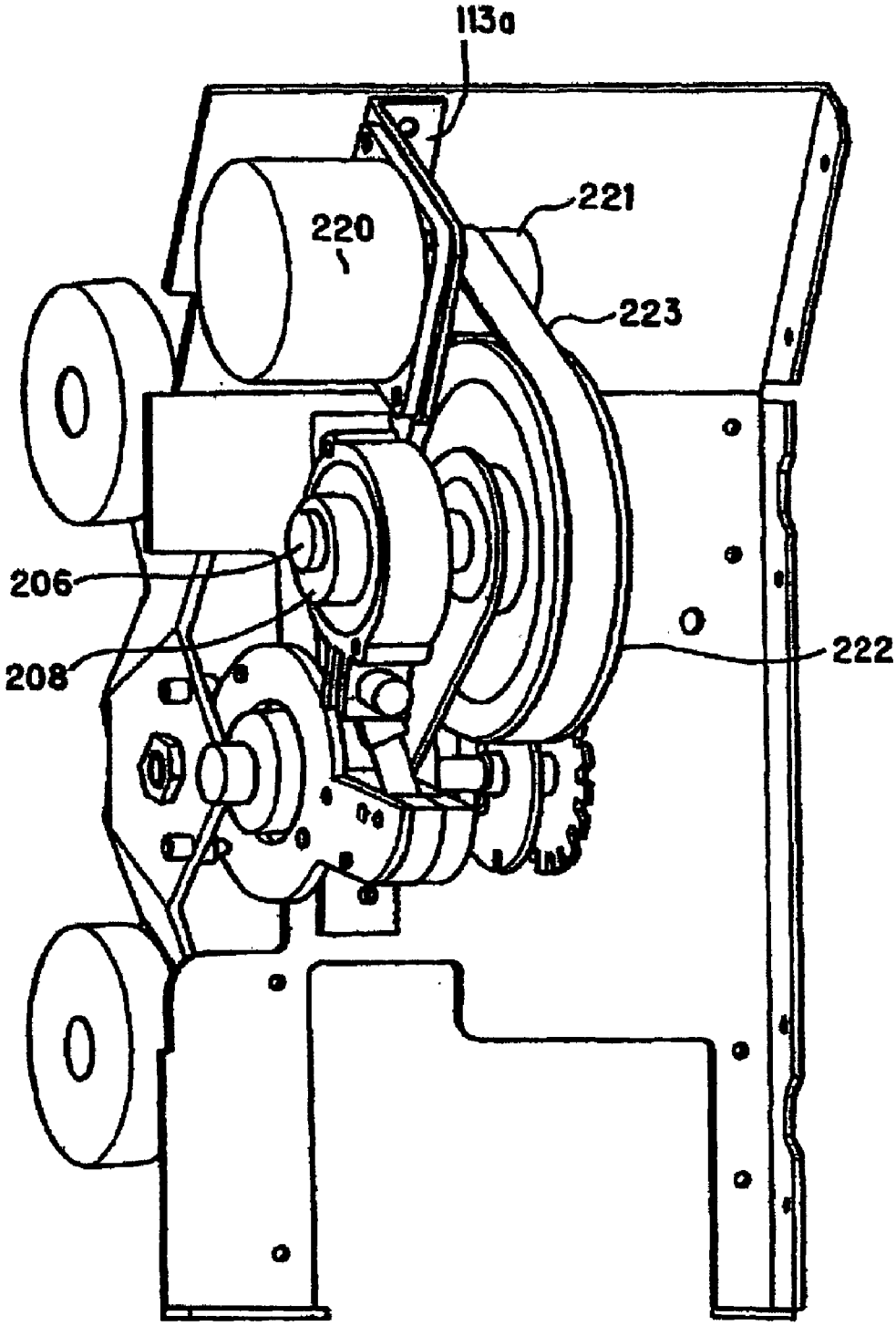
FIG. 16 is a drawing that shows a structure of a pounding mechanism.
Figure 17:
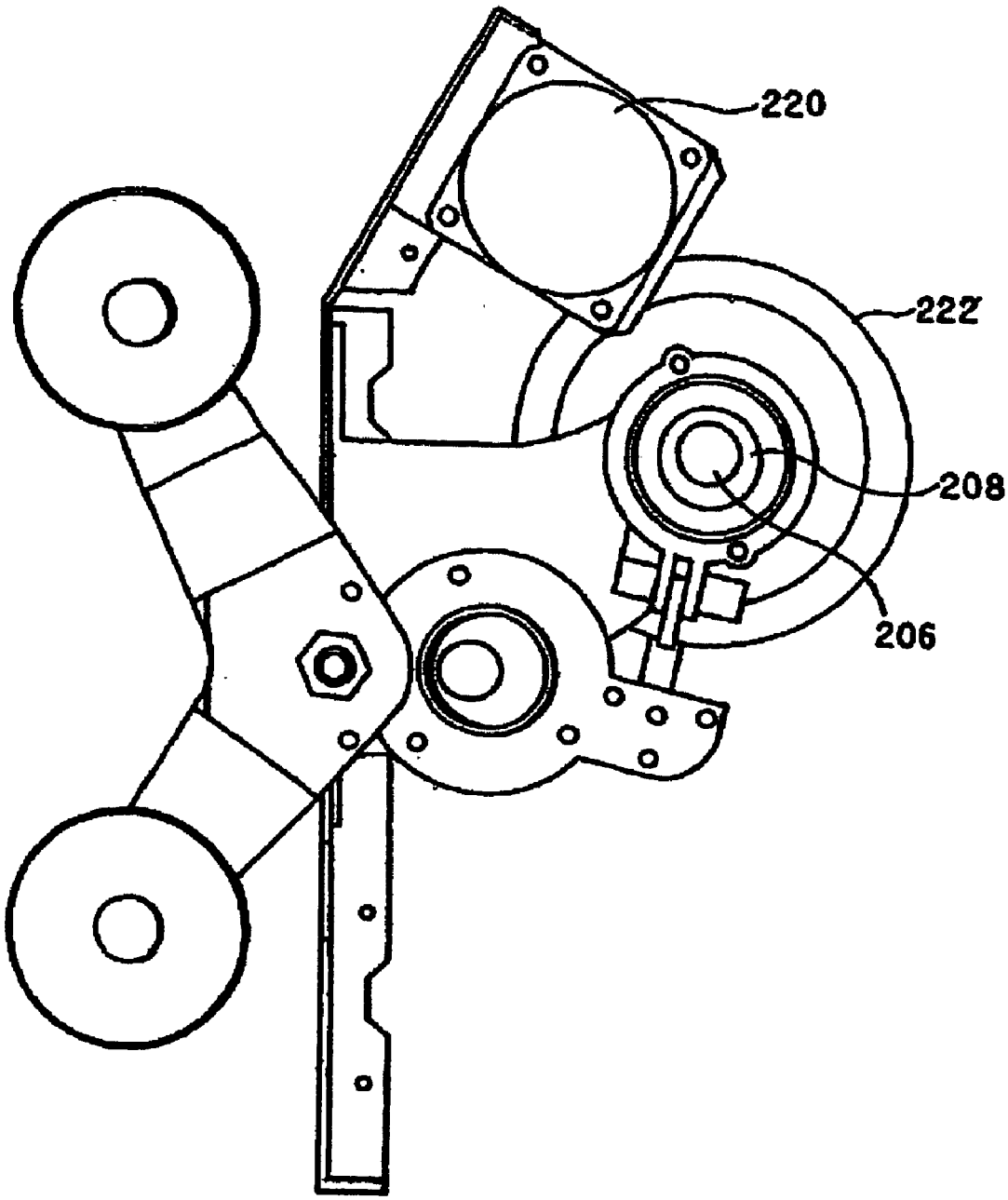
FIG. 17 is a drawing that shows a structure of a pounding mechanism.

FIGS. 16 and 17 are drawings that show the pounding mechanism.

The pounding shaft 206 is driven by a pounding motor 220. The pounding motor 220 is secured to the rear face side of the base member 111*a* through holding members 113*a*, 113*b* (see FIG. 5).

A pounding small pulley 221 is attached to the driving shaft of the pounding motor 220. A pounding belt 223 having an endless shape, which is wound around the outer circumference of the pounding small pulley 221, is also wound around the outer circumference of a pounding large pulley 222 in the same manner. The pounding large pulley 222 is concentrically secured to the outer circumference of the pounding shaft 206.

Thus, the driving force of the pounding motor 220 is transmitted through a route including the pounding small pulley 221 →pounding belt 223 →pounding large pulley 222, while being reduced in its speed, so that the pounding shaft 206 is driven to rotate.

(Lifting Portion of Treating Unit)

The mechanism of the lifting portion of the treating unit is described next.

Figure 18:
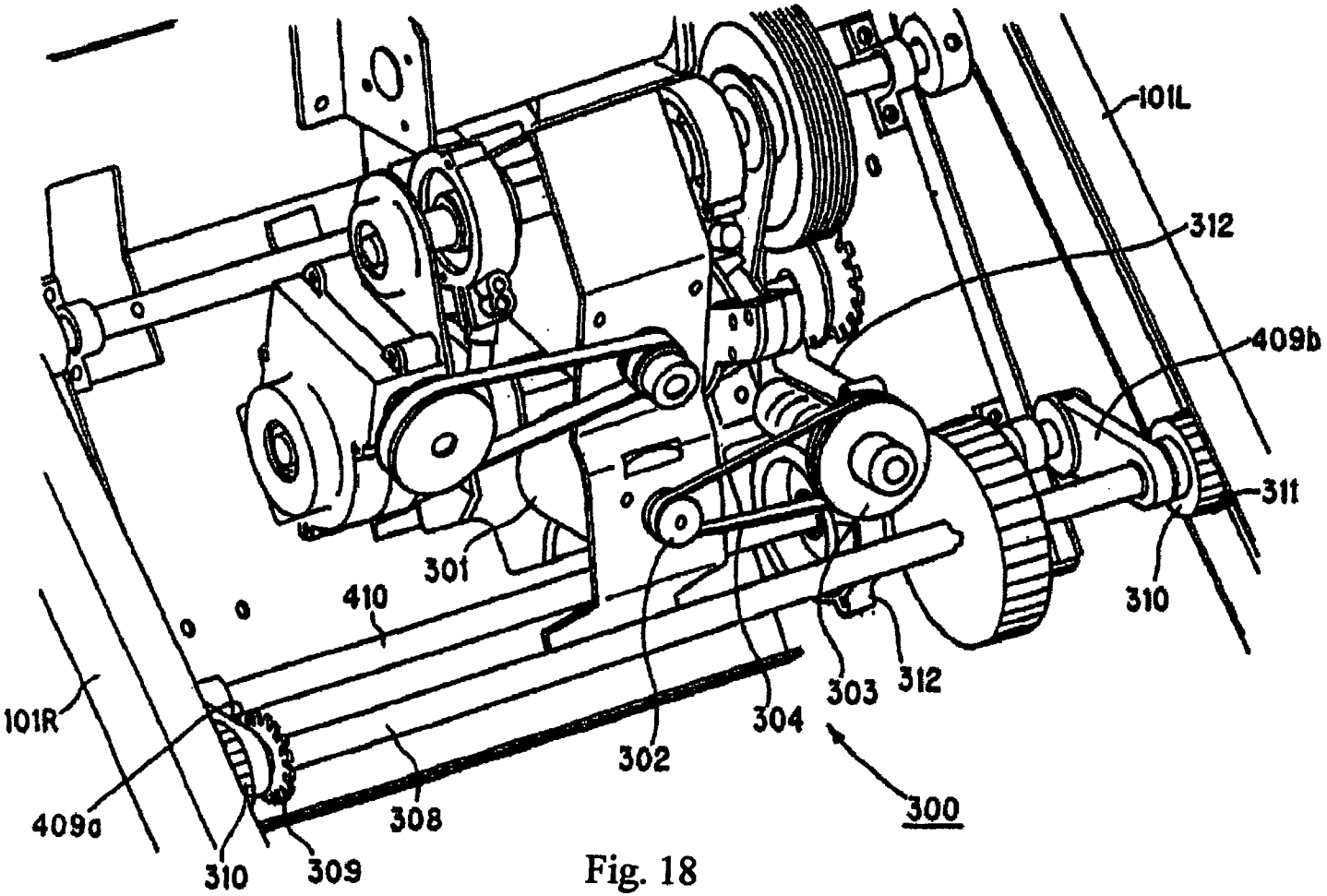
FIG. 18 is a drawing that shows a structure of a lifting unit.
Figure 19:
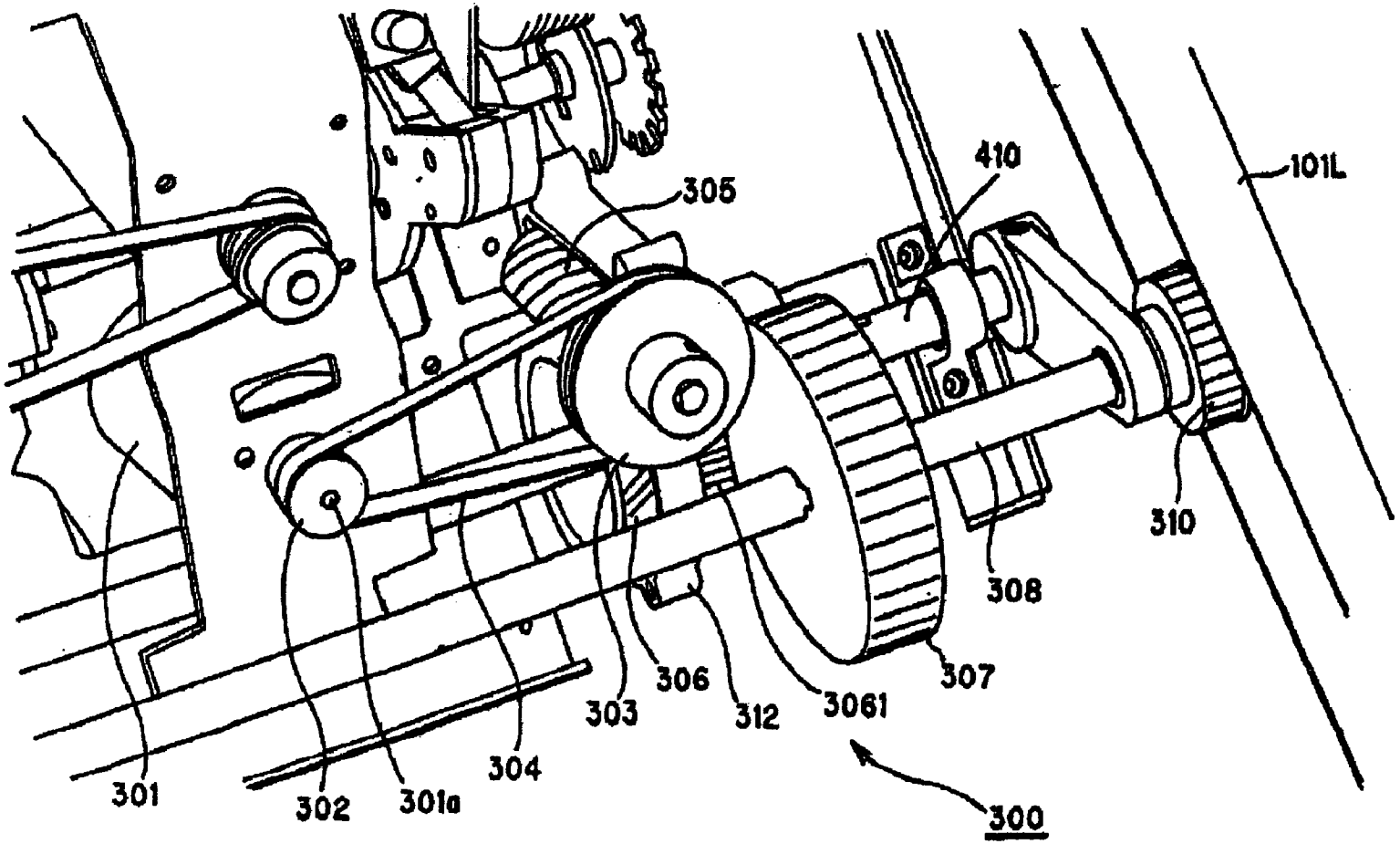
FIG. 19 is a drawing that shows one portion of the lifting unit in an enlarged manner.

FIG. 18 is a drawing that shows a structure of a lifting portion viewed from the rear face side of the base member 111, and FIG. 19 is a drawing that shows one portion thereof in an enlarged manner. In FIGS. 18 and 19 also, for convenience of explanation, some parts are omitted on demand.

Lifting pinions 310, which engage a rack, not shown, that is attached to the inner face of the guide rails 101R, 101L, are secured to both ends of a lifting shaft 308. A roller 311, which is caused to rotate on inner faces of the guide rails 101R, 101L, is secured to the outside of the lifting pinion 310 in the axial direction side by side (see FIG. 5). The lifting shaft 308 is freely rotatably supported by one end of the lifting roller supporting links 409*a*, 409*b*. The other end of lifting roller supporting links 409*a*, 409*b* is concentrically secured to a front-rear-position altering axis 410.

The lifting pinion 310 is driven by the lifting motor 301. The lifting motor 301 is secured to the massaging-lifting motor holding member 112. A lifting small pulley 302 is attached to the driving shaft 301*a* of the lifting motor 301. A lifting belt 304 in the form of an endless belt, which is wound around the outer circumference of the lifting small pulley 302, is also wound around the outer circumference of a lifting large pulley 303 that is attached to the shaft of a lifting worm gear 305. The lifting worm gear 305 is engaged by a lifting worm wheel 306. The lifting worm wheel 306 is supported by the outer circumference of the front-rear-position altering shaft 410 so as to freely rotate thereon. The lifting worm gear 305 and lifting worm wheel 306 are housed in a lifting gear box 312 secured to the rear face side of the base member 111*a*. The lifting worm wheel 306 is engaged to the lifting gear 307 secured to the outer circumference of the lifting shaft 308.

Thus, the driving force of the lifting motor 301 is transmitted through a route including the lifting small pulley 302 →lifting belt 304 →lifting large pulley 303 →lifting worm gear 305 →lifting worm wheel 306 →lifting gear 307, while being reduced in its speed, so that the lifting pinion 310 is driven to rotate together with the lifting shaft 308.

A disc-shaped lifting-position indicating plate 309 is secured to the outer circumference of the lifting shaft 308.

Slits are successively formed on the outer circumferential edge of the lifting-position indicating plate 309 so that a lifting-position photo-sensor 313, which is placed at positions sandwiching the outer circumferential edge of the lifting-position indicating plate 309, detects the lifting-position of the treating unit 110 along the guide rails 101R, 101L based upon the number of revolutions of the lifting-position indicating plate 309. A lifting-upper-limit sensor 314 and a lifting-lower-limit sensor 315 are installed in the guide rails 101R, 101L (see FIG. 1). They respectively detect whether or not the treating unit 110 is located at the upper-limit position and the lower-limit position.

(Treating Unit Front-rear Position Altering Unit)

The mechanism of the front-rear position altering unit 400 in the treating unit 110 is described next.

Figure 20:
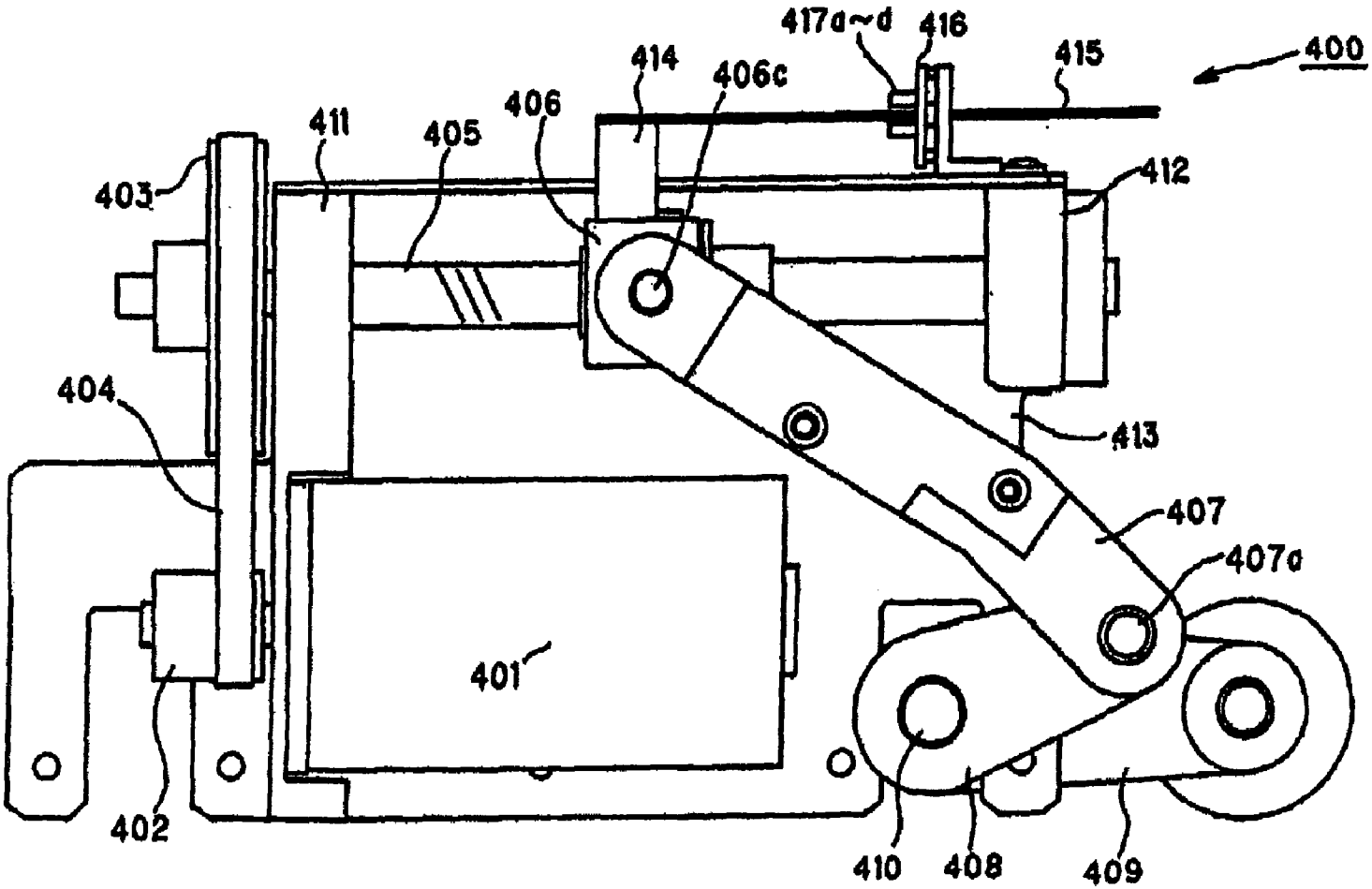
FIG. 20 is a drawing that shows a structure of a front-rear position altering unit.
Figure 21:
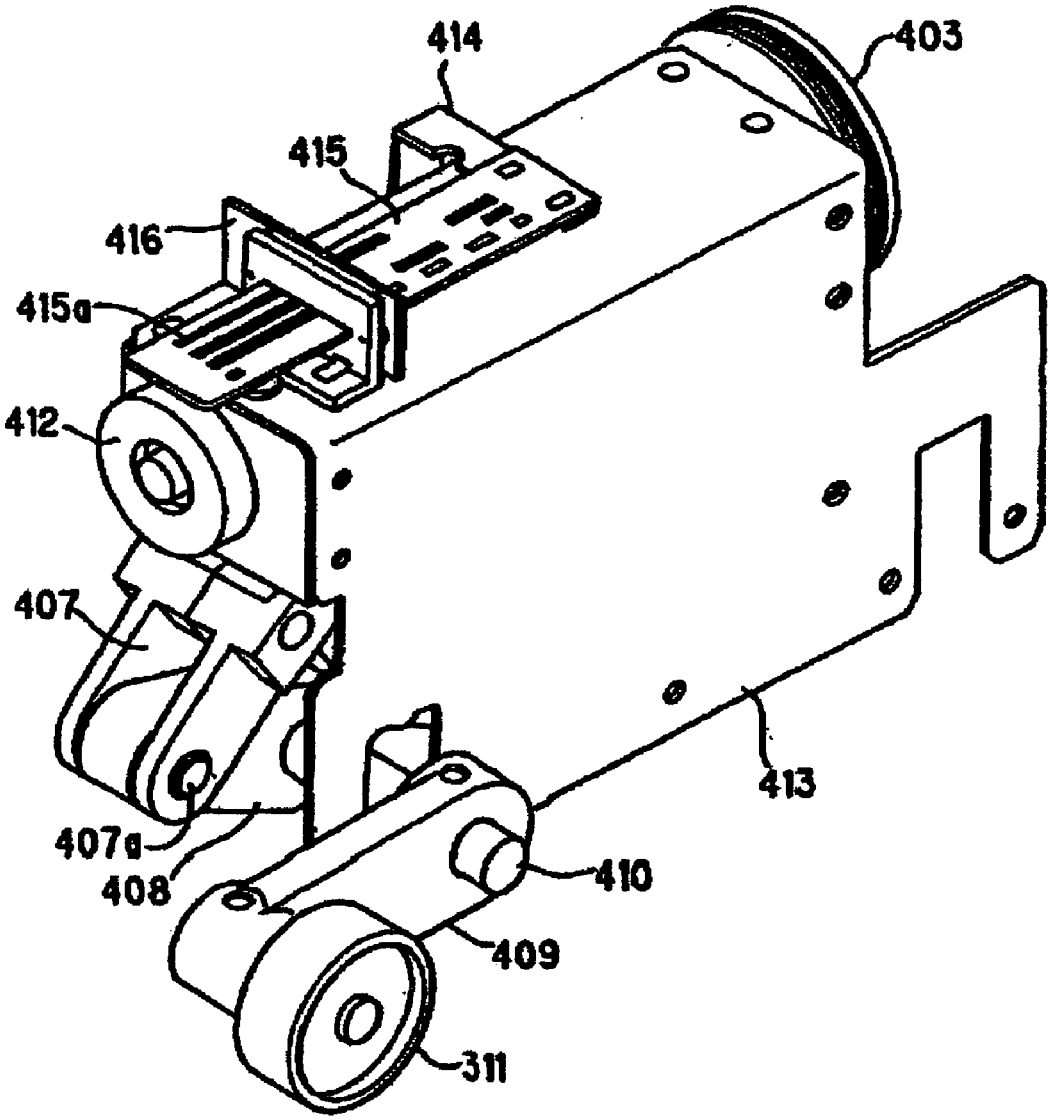
FIG. 21 is a perspective view that shows the front-rear position altering unit.

FIG. 20 is a drawing that shows a structure of the front-rear position altering unit 400, and FIG. 21 shows a perspective view thereof.

The front-rear position altering unit 400 is attached to a side plate 413 secured on the rear face side of both of the side end portions of the base member 111. The lifting roller supporting link 409 supports a lifting roller 311 on its one axis end so as to freely rotate thereon, with the other end being secured to the front-rear position altering shaft 410. One end of a link A408 is secured to the front-rear position altering shaft 410. The other end of the link A408 is connected to one end of a link B407 through a pin 407*a*, and these are mutually rotatably supported, centered on the pin 407*a*. The other end of the link B407 is rotatably supported on a pin 406*a* placed on a transferring nut holder 406. In the above, the lifting roller 311 corresponds to an engaging portion and the lifting roller supporting link 409 corresponds to an arm, and these constitute a supporting means together with the front-rear position altering shaft 410 forming the swingable center.

The transferring nut holder 406 integrally houses a transferring nut that is threaded and engages the outer circumference of the transferring screw 405. The transferring screw 405 is rotatably held by a transferring screw holding member A411 and a transferring screw holding member B412 on both sides of the transferring nut. Both of the transferring screws holding member A411 and the transferring screw holding member B412 are secured to the side plate 413.

A front-rear position altering large pulley 403 is secured to the outer circumference of the end of the transferring thread 405 in a concentric manner. An endless front-rear position altering belt 404 is wound around the outer circumferences of the front-rear-position altering small pulley 402 and the front-rear-position altering large pulley 403 that are attached to the driving shaft of the front-rear position altering motor 401. The front-rear position altering motor 401 is attached to the side plate 413 so that the driving shaft is set in parallel with the transferring screw 405.

The front-rear position altering motor 401, the front-rear position altering small pulley 402, the front-rear position altering large pulley 403, the front-rear position altering belt 404, the transferring screw 405, the transferring nut holder 406, the pin 406*a*, the link B407, the pin 407*a*, the link A408 and the front-rear position altering shaft 410 constitute a position altering means and an orientation altering means.

A plate-shaped front-rear position indicating plate holding member 414, which has a bent U-shape, is secured to the transferring nut holder 406. The front-rear position indicating plate holding member 414 with one end secured to the transferring nut holder 406 is bent so as to sandwich the side plate 413. The other end is wound to reach the outside of the side plate 413. A plate-shaped front-rear position indicating plate 415, which extends in the axial direction of the transferring screw 405, is held on the other end of the front-rear position indicating plate holding member 414 parallel to the side plate 413. The front-rear position indicating plate 415 is inserted into a detection unit of a front-rear position detection PCB 416 attached to the side plate 413. Slits 415*a* are formed in the front-rear position indicating plate holding member 414 in the axial direction of the transferring screw 405. Four rows of the slits 415*a* are formed in a direction orthogonal to the axial direction of the transferring screw 405, and the positions of the slits in the axial direction of the transferring screw 405 are different for each row. A front-rear position detection sensor, which detects the presence or absence of the slit, is installed in the detection unit of the front-rear position detection substrate 416. Four front-rear position detection sensors are placed at positions corresponding to the respective slits in a direction orthogonal to the axial direction of the transferring screw 405. Thus, the four front-rear position detection sensors 417*a* to 417*d* detect combinations of the presence or absence of the slits that changes, depending on the relative position of the front-rear position indicating plate 415 that is shifted together with the transferring nut so that the position of the transferring screw 405 in the axial direction can be detected.

FIGS. 20 and 21 show a front-rear position altering unit 400A which alters the front-rear position of the upper portion of the treating unit 110 by causing the lifting roller supporting links 409*c*, 409*d* placed on the upper side of the treating unit 110 to swing (see FIG. 5). A front-rear position altering unit 400B, which is placed on the rear face on the left-hand side (viewed from the front) of the base member 111, and alters the front-rear position of the lower portion of the treating unit 110 by causing the lifting roller supporting links 409*a*, 409*b* placed on the lower side of the treating unit 110 to swing, is also arranged substantially in the same manner as the front-rear position altering unit 400A. The front-rear position altering unit 400B is different from the front-rear position altering unit 400A in that a lifting shaft 308 to which a lifting pinion 310 is attached together with the lifting roller 311 is inserted into the ends of the lifting roller supporting links 409*a*, 409*b*.

The operation of the front-rear position altering unit is described next.

Figure 22:
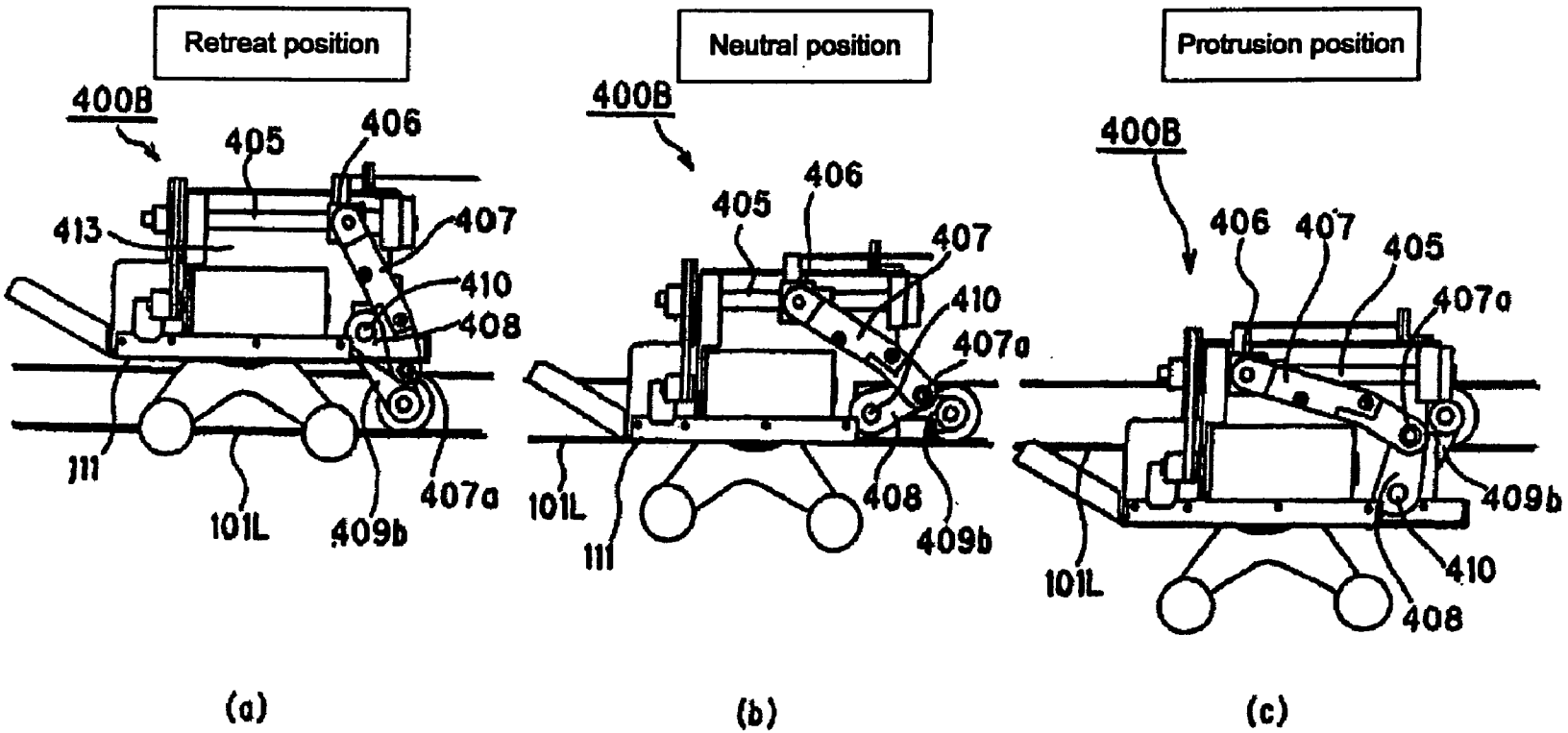
FIGS. 22(*a*), 22(*b*) and 22(*c*) are drawings that show states in which the front-rear position altering unit changes the position in the front-rear direction with respect to a guide rail.

FIG. 22 shows a state in which the front-rear position altering unit 400B has changed the position in the front to rear direction with respect to the guide rail 101L. FIG. 22(*a*) shows a state in which the front-rear position altering unit 400B is located at a retreated position, FIG. 22(*b*) shows a state in which it is located at a neutral position, and FIG. 22(*c*) shows a state in which it is located at an advanced position. FIG. 22 shows only the front-rear position altering unit 400B; however, the entire treating unit 110 has its front-rear position changed with respect to the guide rail 101L in the same manner as the front-rear position altering unit 400B. Moreover, in the respective cases shown in FIGS. 22(*a*), 22(*b*), 22(*c*), the front-rear position altering unit 400A is also operated in the same manner.

First, as shown in FIG. 22(*a*), let us assume that the transferring nut holder 406 is located at the lower end portion of the transferring screw 405 (in the drawing, the right-hand side corresponds to the lower position of the back portion, and the left-hand side corresponds to the upper position of the back portion). In this case, since the front-rear position altering shaft 410 is rotatably attached to the base member 111, the relative positional relationship between it and the transferring screw 405 also secured to the base member 111 through the side plate 413 is not changed during the front-rear position altering operation. Both the lifting roller supporting links 409*b* and link B408 are secured to the front-rear position altering shaft 410, and the angle therebetween is not changed. As shown in FIG. 22(*a*), therefore, the link A407 pushes the pin 407*a* forward so that the link B408 coupled thereto is rotated forward. Thus, the lifting roller supporting link 409*b*, integrally connected thereto through the front-rear position altering shaft 410, is also rotated forward. Since the front-rear position altering shaft 410 is attached to the base member 111, the entire treating unit 110 is caused to retreat backward with respect to the guide rail 101L, that is, in a departing direction from the treatment subject portion.

Next, as shown in FIG. 22(*b*), in the case where the transferring nut holder 406 is located approximately in the middle position of the transferring screw 405, the link A407 pulls the pin 407*a* toward the rear face side so that the link B408 coupled thereto is rotated toward the rear face side. Thus, the lifting roller supporting link 409*b*, integrally connected thereto through the front-rear position altering shaft 410, is caused to rotate backward, unlike in the state shown in FIG. 22(*a*). In this case, since the lifting roller supporting link 409*b* is placed approximately parallel to the base member 111 so that the base member 111 is located approximately on the same plane as the guide rail 101L.

Next, as shown in FIG. 22(*c*), let us assume that the transferring nut holder 406 is located at the upper end portion of the transferring screw 405. In this case, the link A407 further pulls the pin 407*a* toward the rear-face side, with the result that since the link B408 coupled thereto is further rotated toward the rear face side, the lifting roller supporting link 409*b*, integrally coupled thereto through the front-rear position altering shaft 410, is rotated toward the rear face side farther in comparison with the case shown in FIG. 22(*b*). Since the lifting roller supporting link 409*b* is located on the rear face side from the front-rear position altering shaft 410, the entire treating unit 110 is caused to stick out toward the front side from the guide rail 101L, that is, in an approaching direction to the treatment subject portion.

Figure 23:
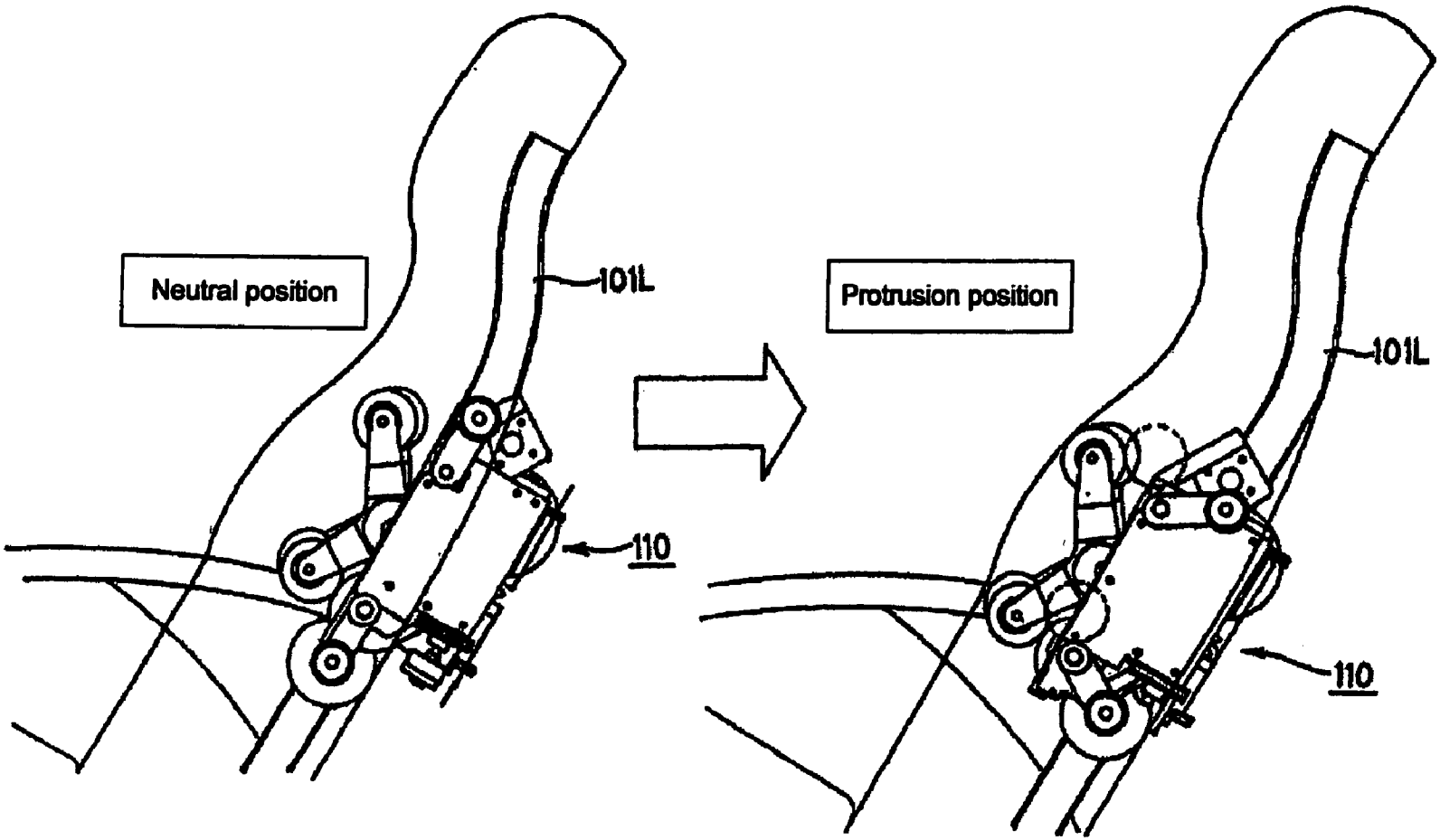
FIG. 23 is a drawing that shows a change in the positional relationship between the treating unit and a back portion.
Figure 24:
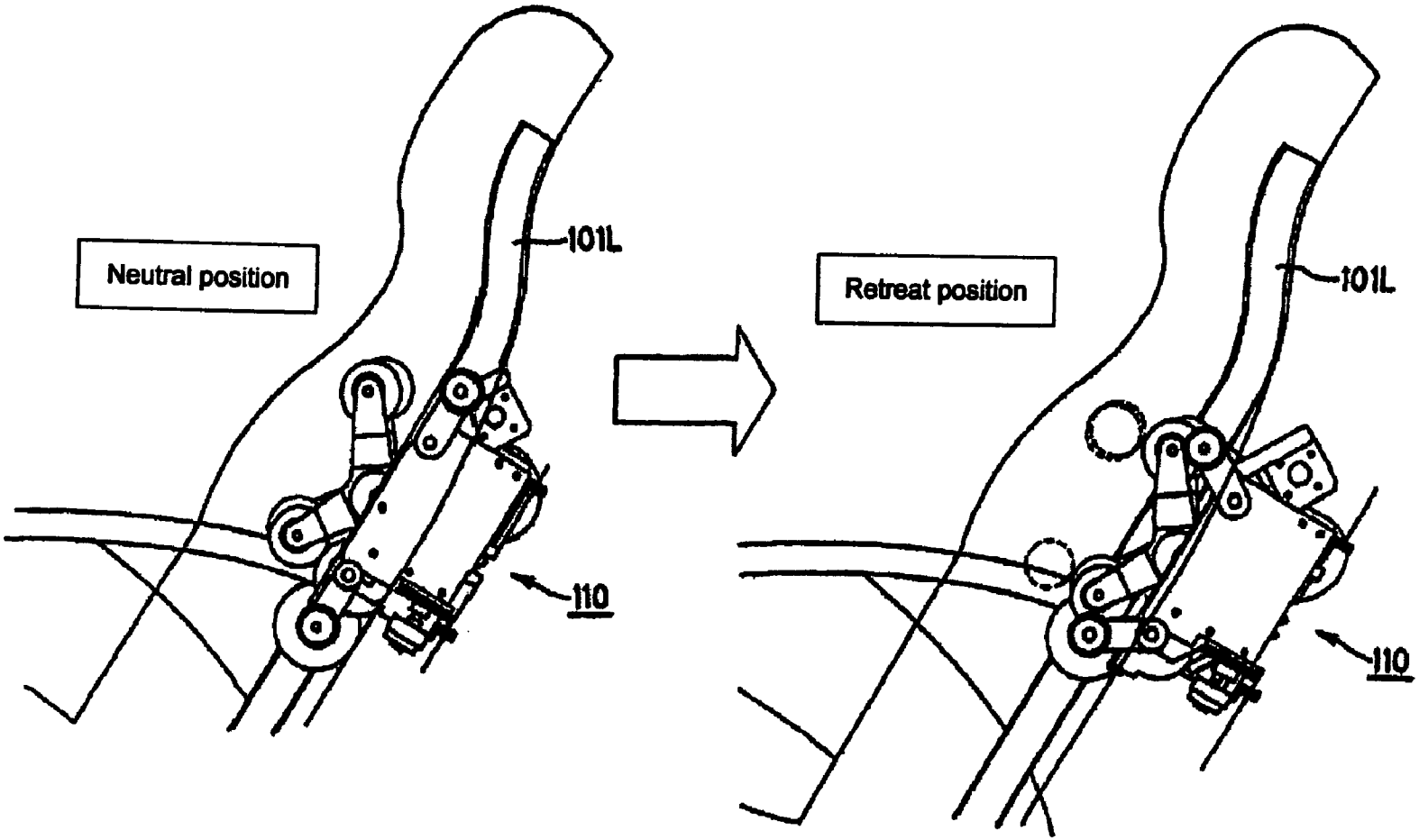
FIG. 24 is a drawing that shows a change in the positional relationship between the treating unit and the back portion.

FIG. 23 shows a positional relationship between massaging balls 201*a* to 201*d* and the back portion 100*a* in the case where the front-rear position of the treating unit 110 from the neutral position shown in FIG. 22(*b*) to an advanced position shown in FIG. 22(*c*). FIG. 24 shows a positional relationship between the massaging balls 201*a* to 201*d* and the back portion 100*a* in the case where the front-rear position of the treating unit 110 is altered from the neutral position shown in FIG. 22(*b*) to a retreated position shown in FIG. 22(*a*). In this arrangement, it is possible to adjust the amount of protrusion of the massaging balls 201*a* to 201*d* toward the treatment subject portion, and consequently to achieve finger-pressure operations and strength adjustments of the treatment, which will be described below.

FIGS. 23 and 24 have shown the case in which the two front-rear position altering units 400A, 400B carry out the same operations. The front-rear position altering units 400A, 400B, however, may be provided with respective front-rear position altering motors 401A, 401B, and controlled individually. Thus, the positional relationship of the treating unit 110 with respect to the lifting roller 311 placed above the treating unit 110 and the positional relationship of the treating unit 110 with respect to the lifting roller 311 placed below the treating unit 110 may be different from each other. In other words, the entire treating unit 110 is not only caused to advance and retreat approximately in parallel with the guide rails 101R, 101L, but also controlled in its positional relationships with respect to the upper portion of the treating unit 110 and the lower portion of the guide rails 101R, 101L respectively in an individual manner.

Figure 25:
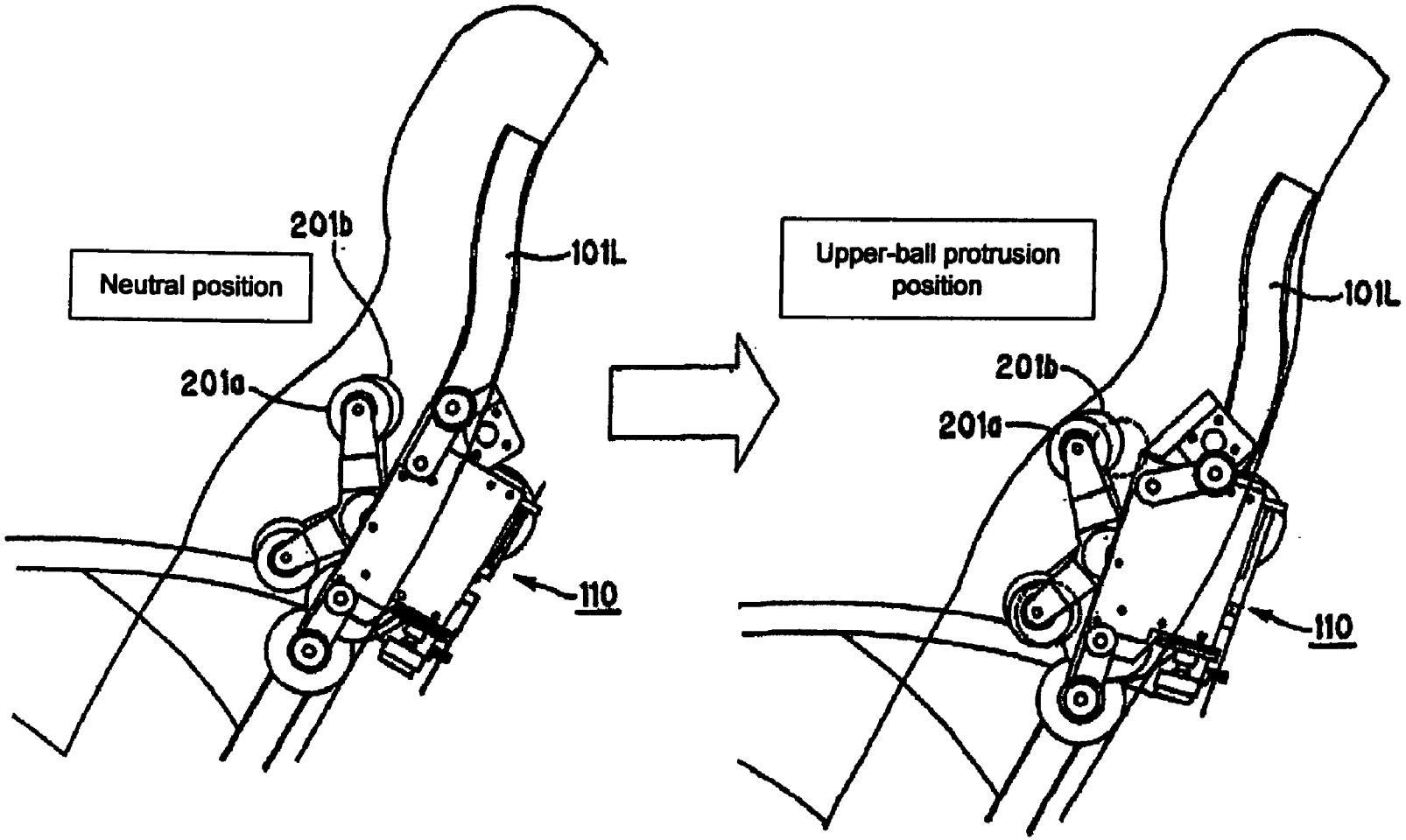
FIG. 25 is a drawing that shows a change in the positional relationship between the treating unit and the back portion.
Figure 26:
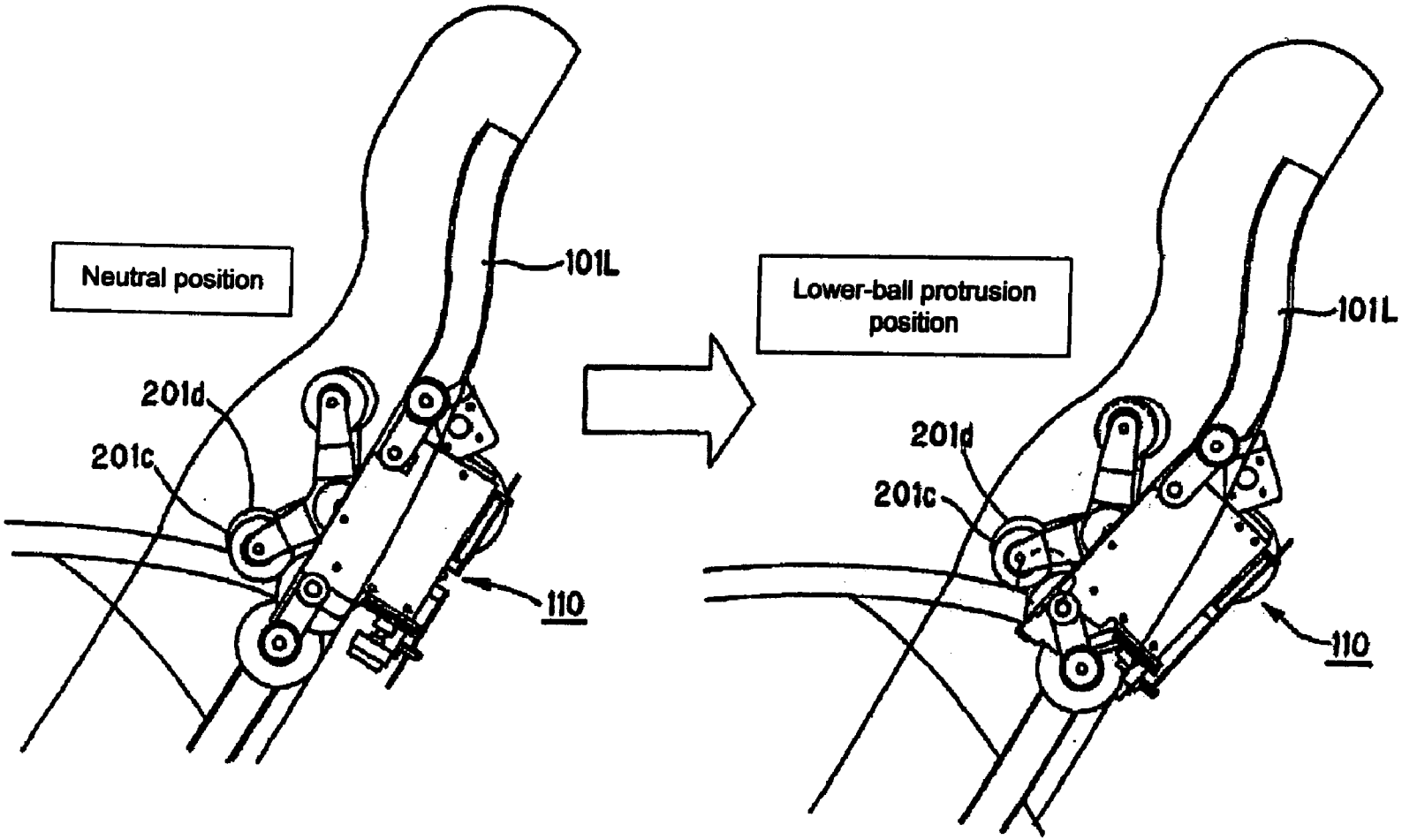
FIG. 26 is a drawing that shows a change in the positional relationship between the treating unit and the back portion.

FIG. 25 shows a positional relationship between the treating unit 110 and the back portion 100*a* in the case where, from the state where both of the front-rear position altering units 400A, 400B are at the neutral position, only the front-rear position altering unit 400A is shifted to the advanced position. In this case, only the upper portion of the treating unit 110 protrudes forward so that only the two massaging balls 201*a*, 201*b* on the upper side are caused to protrude (upper-ball protruding position). In contrast, FIG. 26 shows a positional relationship between the treating unit 110 and the back portion 100*a* in the case where, from the state where both of the front-rear position altering units 400A, 400B are placed at the neutral position, only the front-rear position altering unit 400B is shifted to the advanced position. In this case, only the lower portion of the treating unit 110 protrudes forward so that only the two massaging balls 201*c*, 201*d* on the lower side are caused to protrude (lower-ball protruding position).

In this manner, the front-rear position altering motors 401 of the front-rear position altering units 400A, 400B are controlled independently so as to change the amount of protrusion of the upper portion and lower portion of the treating unit 110 with respect to the guide rails 101R, 101L or the orientation of the treating unit 110 with respect to the guide rails 101R, 101L. Thus, the kinds, number and pressing force of the massaging balls (upper or lower balls) to be made in contact with the treatment subject portion of the body are switched.

In the following, therefore, the front-rear position altering motors 401A, 401B are respectively referred to as a massaging ball adjusting upper motor 401A and a massaging ball adjusting lower motor 401B, and four front-rear position detection sensors 417*a* to 417*d*, etc., respectively installed in the front-rear position altering units 400A, 400B, are referred to as massaging ball adjusting upper position sensors (1) to (4) 417A and massaging ball adjusting lower position sensors (1) to (4) 417B. The operation for driving the treating element unit 110 in an approaching (protruding) direction to the treatment subject portion with respect to the guide rails 101R, 101L is referred to as forward rotation, and a driving operation which drives the treating element unit 110 in a departing (retreating) direction from the treatment subject portion with respect to the guide rails 101R, 101L is referred to as backward rotation.

As described above, the lower lifting roller supporting links 409*a*, 409*b* are caused to swing along the guide rails 101R, 101L and the upper lifting roller supporting links 409*c* and 409*d* are swung along the guide rails 101R, 101L, so that the position in the front to rear direction of the treating unit 110 is altered but they may be so arranged that either of the upper and lower lifting rollers are kept at the same position, only the other being caused to swing. In this manner, even when the lifting supporting link constituting the position altering means is installed on only one of the upper and lower pairs, it is possible to adjust the position of the massaging balls in the front to rear direction, that is, the amount of protrusion toward the treatment subject portion, and consequently to adjust the finger-pressing operations and the strength of treatments. The swinging link also constitutes an orientation altering means.

The operations of the treating unit front-rear altering unit described above can be achieved independently of the lifting operations of the treating unit along the guide rails 110R, 1110L. Therefore, a member corresponding to each of the guide rails 110R, 110L may be arranged so as to have an extension including a movable range of the lifting roller 311 at the time of the front-to-rear direction shift and the orientation change of the treating unit 100 as a rail member, and by attaching this to the associated member that is selected on demand, it becomes possible to achieve massaging operations including "massaging", "pounding" and "finger-pressing" operations, the adjustments of the treatment strength through adjustments in the amount of protrusion of the massaging balls and the switching operations of the massaging balls to be used.

(Basic Operations of the Vibrator)

Figure 27:
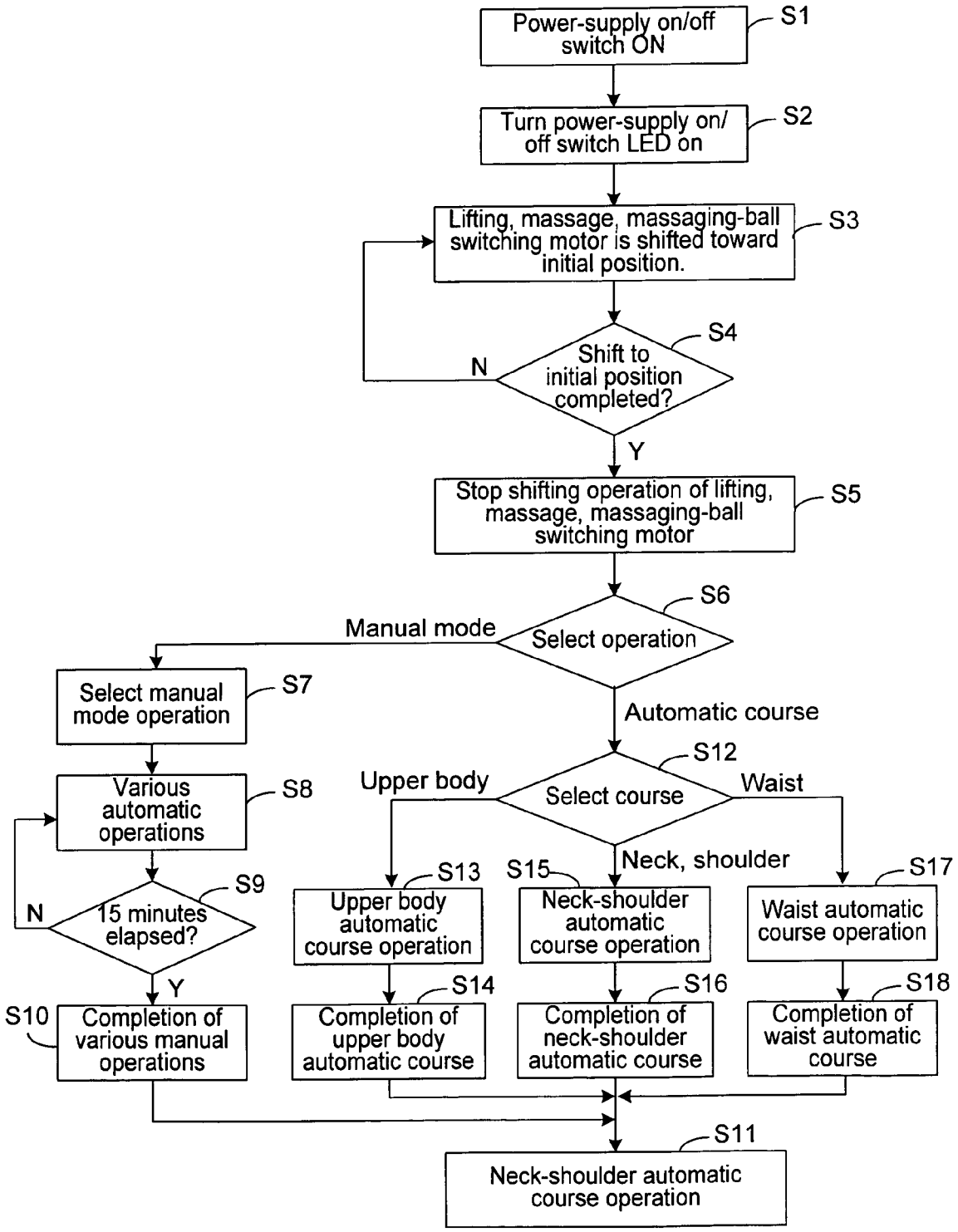
FIG. 27 is a flowchart that explains the basic operation of a vibrator.
Figure 28:
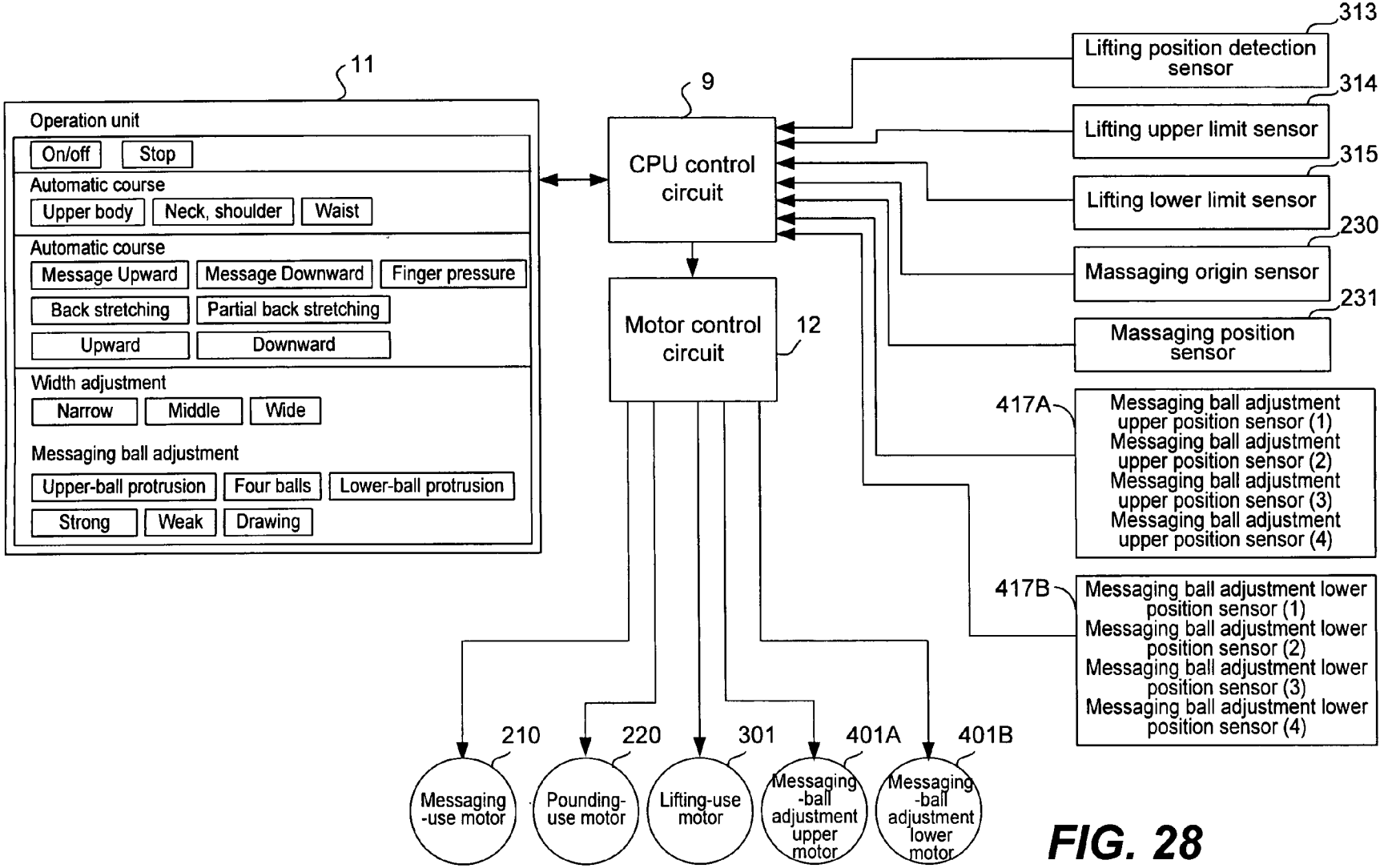
FIG. 28 is a block diagram that shows the entire structure of a vibrator.

The operations of the vibrator are described for carrying out massaging processes. FIG. 27 is a flowchart that explains the basic operations of the vibrator 10. FIG. 28 is a block diagram that shows a schematic structure of the vibrator 10. In the vibrator 10, based upon a command from the operation unit 11 and information from respective sensors, a CPU control circuit 9 outputs a command to a motor control circuit 12 so that the respective motors are driven or information is displayed on the operation unit.

First, a power-supply on/off switch is turned on at the operation unit 11 shown in FIG. 28 (step 1). Thus, an LED of the power-supply on/off switch is turned on, indicating that the power-supply switch is in the on-state (step 2).

Next, the lifting motor 301, the massaging motor 210, the massaging ball adjusting upper motor 401A and the massaging ball adjusting lower motor 401B (in FIG. 28, the massaging ball adjusting upper motor 401A and the massaging ball adjusting lower motor 401B are indicated as "massaging ball switching motor" in a combined manner) are operated to shift to the respective initial positions (step 3). It is determined whether or not the respective motors have been shifted to the initial positions (step 4), and if the shifting operations have not been completed, the sequence returns to step 3, and if completed, the operations of the lifting motor 301, the massaging motor 210, the massaging ball adjusting upper motor 401A and the massaging ball adjusting lower motor 401B are stopped (step 5).

Next, it is determined which of the manual mode and the automatic mode has been selected (step 6).

If the manual mode has been selected, it is determined which operation in the manual mode has been selected (step 7), and in accordance with the selection, various manual operations are carried out (step 8). With respect to the manual mode, selection can be made from items such as "upward massaging", "downward massaging", "pounding", "finger-pressing", "back-stretching", "partial back-stretching", "upward" and "downward". After having carried out the corresponding manual operation for 15 minutes (step 9), the corresponding manual operation is completed after a lapse of 15 minutes (step 10), and the power-supply on/off switch is turned off so that the LED is switched off (step 11).

If the automatic mode has been selected, it is determined which of the automatic courses has been selected (step 12).

If the upper body automatic course has been selected, the operation is carried out in accordance with a menu of the upper body automatic course (step 13). Upon completion of the menu (step 14), the sequence proceeds to step 11. Here, the upper body automatic course refers to a course in which, for example, the spine-stretching, pressing, pounding and finger-pressing operations are carried out over the entire upper body from the neck, shoulder, back to the waist in an appropriately combined manner. When a neck-shoulder automatic course has been selected, the operation is carried out in accordance with a menu of the neck-shoulder automatic course (step 15). Upon completion of the menu (step 16), the sequence proceeds to step 11. Here, the neck-shoulder automatic course refers to a course in which, for example, the back-stretching, pressing, pounding and finger-pressing operations are carried out on portions from the neck to the shoulder in an appropriately combined manner. When a waist automatic course has been selected, the operation is carried out in accordance with a menu of the waist automatic course (step 17). Upon completion of the menu (step 18), the sequence proceeds to step. 11. Here, the waist automatic course refers to a course in which, for example, the back-stretching, pressing, pounding and finger-pressing operations are carried out on the periphery of the waist in an appropriately combined manner.

(Massaging Ball Adjusting Operation)

Figure 29:
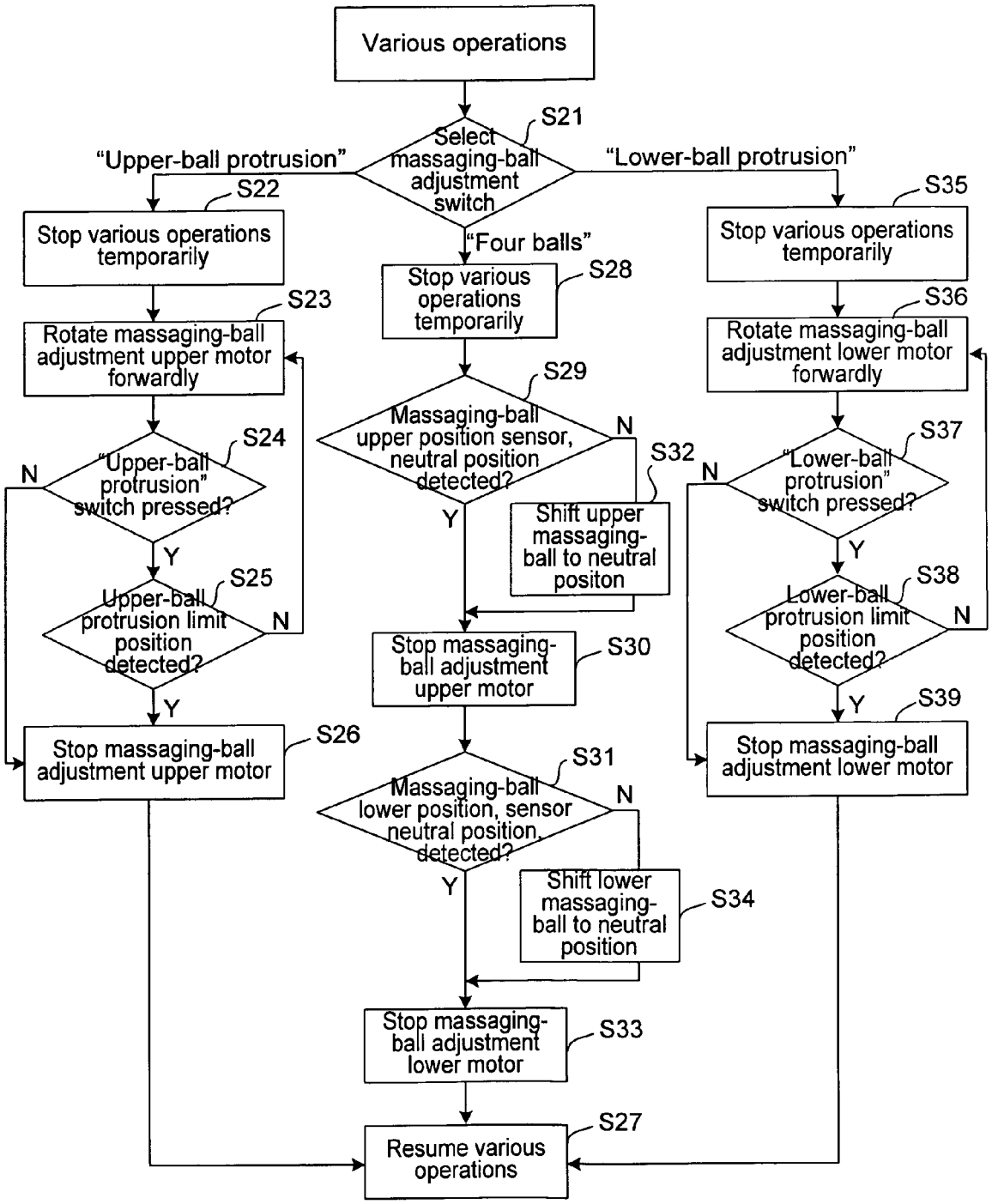
FIG. 29 is a flowchart that explains a sequence of massaging balls adjusting operations.

FIG. 29 is a flowchart that explains the sequence of massaging ball adjusting operations.

With the above-mentioned vibrator 10, it is possible to carry out massaging ball adjustments on demand even in the middle of the above-mentioned basic operations by operating switches on the operation unit 11.

If the massaging ball adjusting switch is pressed in the middle of each operation, the kind of the selected switch is first determined (step 21).

When an "upper-ball protrusion" switch has been pressed, the various operations are stopped temporarily (step 22). Next, the massaging ball adjusting upper motor 401A is forwardly rotated (step 23). It is determined whether or not the "upper-ball protrusion" switch has still been pressed (step 24). If the "upper-ball protrusion" switch has still been pressed, the steps 23 and 24 are repeated until the massaging ball adjusting upper position sensors (1) to (4) 417A have detected the upper ball protrusion limit position (step 25), and upon detection of the upper ball protrusion limit position, the massaging ball adjusting upper motor 401A is stopped (step 26), and the various operations are resumed (step 27). When the "upper-ball protrusion" switch is not pressed in step 24, the sequence proceeds to step 26.

If a "four-balls" switch has been pressed, operations are stopped temporarily (step 28). Next, it is determined whether the massaging ball adjusting upper position sensors (1) to (4) 417(A) (which are briefly indicated as "massaging ball upper position sensors" in FIG. 29) have detected the neutral position (step 29). If the massaging ball adjusting upper position sensors (1) to (4) 417(A) have detected the neutral position, the massaging ball adjusting upper motor 401A is stopped (step 30), and it is determined whether or not the massaging ball adjusting lower position sensors (1) to (4) 417(B) have detected the neutral position (step 31). If the massaging ball adjusting upper position sensors (1) to (4) 417(A) have not detected the neutral position, the massaging ball adjusting upper motor 401A is forwardly or backwardly rotated, and when the massaging ball adjusting upper position sensors (1) to (4) 417(A) have detected the neutral position (step 32), the sequence proceeds to step 30, thereby stopping the massaging ball adjusting upper motor 401A. In this case, the positions of the upper two massaging balls 201*a*, 201*b* in the front and rear directions can be detected by the massaging ball adjusting upper position sensors (1) to (4) 417(A). Thus, the upper two massaging balls can be returned to the neutral position by forwardly or backwardly rotating the massaging ball adjusting upper motor 401A in accordance with the detection positions (the same is true for the positions of the lower two massaging balls in the front and rear directions). In step 31, if the massaging ball adjusting lower position sensors (1) to (4) 417B (which are briefly indicated as "massaging ball lower position sensors" in FIG. 29) have detected the neutral position, the massaging ball adjusting lower motor 401B is stopped (step 33), and the sequence proceeds to step 27. If the massaging ball adjusting lower position sensors (1) to (4) 417B have not detected the neutral position, the massaging ball adjusting lower motor 401B is forwardly or backwardly rotated, and when the massaging ball adjusting lower position sensors (1) to (4) 417B have detected the neutral position (step 34), the sequence proceeds to step 33, thereby stopping the massaging ball adjusting lower motor 401B.

When a "lower-ball protrusion" switch has been pressed, operations are stopped temporarily (step 35). Next, the massaging ball adjusting lower motor 401B is forwardly rotated (step 36). It is determined whether or not the "lower-ball protrusion" switch has been pressed (step 37). If the "lower-ball protrusion" switch has been pressed, it is determined whether or not the massaging ball adjusting lower position sensors (1) to (4) 417B have detected the lower ball protrusion limit position (step 38). Here, if the massaging ball adjusting lower position sensors (1) to (4) 417B have detected the lower ball protrusion limit position, the massaging ball adjusting lower motor 401B is stopped (step 39), and the various operations are resumed (step 27). If the massaging ball adjusting lower position sensors (1) to (4) 417B have not detected the lower ball protrusion limit position, the sequence returns to step 36, thereby further rotating the massaging ball adjusting lower motor 401B. If the "lower-ball protrusion" switch is not pressed in step 37, the sequence proceeds to step 39.

Various massaging operations to be carried out by the massaging mechanism (Massaging process) are described next.

Figure 30:
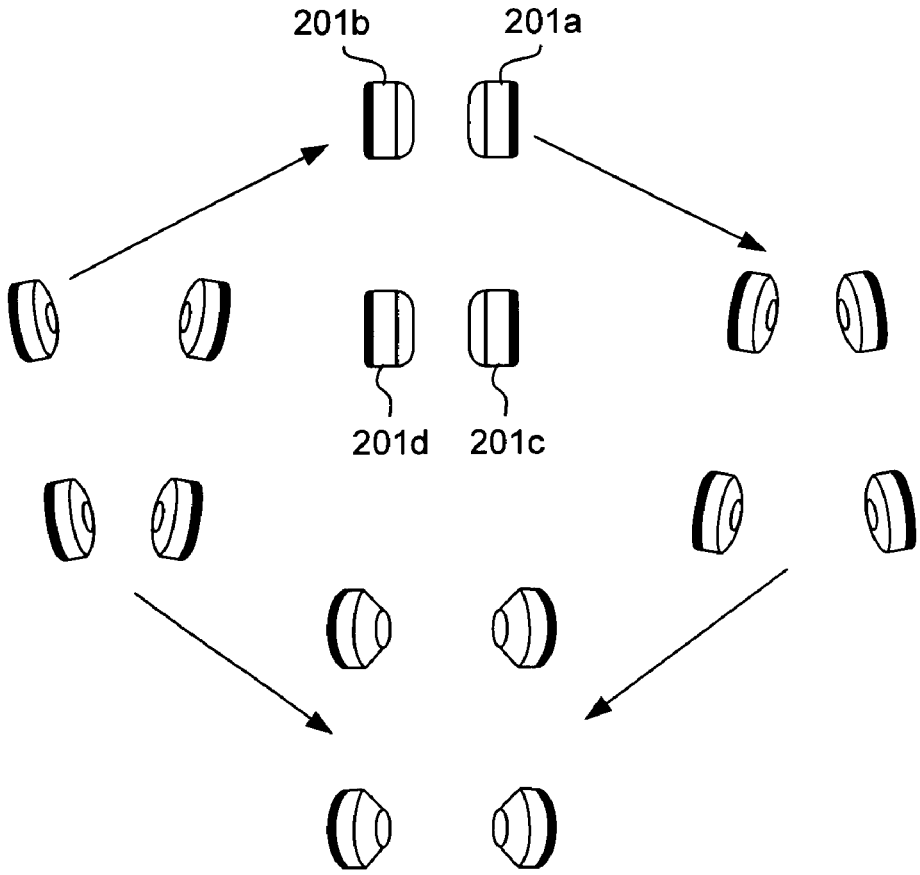
FIG. 30 is a drawing that explains movements of massaging balls at the time of the massaging operation.

During a massaging process, the rotation of the pounding shaft 206 is stopped, and only the massaging shaft 205 is rotated. The massaging ball arms 202R, 202L are supported on the periphery of a tilted sleeve 207 so as to freely rotate thereon. The tilted sleeve 207 is attached to the massaging shaft 205 in a tilted manner with respect to the massaging shaft 205. The massaging ball arms 202R, 202L are also limited in their rotation around the massaging shaft 205 by a link. The treating element 201 is thus caused to swing in the axial direction of the massaging shaft 205 while changing the distance from the center of the axis of the massaging shaft 205. FIG. 30 is a drawing that shows the movements of such massaging balls viewed from the front. In this case, since the distance between the right and left massaging balls is changed so that such operations make it possible to achieve "massaging operations" for massaging the body. When the above-mentioned massaging operations are carried out, the moving direction of the massaging balls can be reversed by switching the rotation direction of the massaging motor 210; thus, two types of operations, that is, "massaging-up" and "massaging-down" operations, are achieved.

(Pounding Process)

During a pounding process, the rotation of the massaging shaft 205 is stopped, and the pounding shaft 206 is rotated. At this time, the position in the rotation direction of the tilted sleeve 207 is controlled so that the massaging ball arms 202R, 202L are made approximately orthogonal to the massaging shaft 205 with the massaging balls being held in a state so as to be made approximately orthogonal to the back (massaging origin position). A massaging origin detection plate 216 and a massaging position indicating plate 217 are secured to the end of the massaging shaft 205 in a concentric manner (see FIG. 14). The massaging origin detection plate 216 is a disc shaped member with a slit being formed on one portion of the circumferential edge, and massaging origin photosensors, placed at positions facing the back face of the base member 111 in a manner so as to sandwich the massaging origin detection plate 216, are caused to detect the massaging origin position. The link 49 is supported so as to freely rotate through an eccentric sleeve 208 that rotates eccentrically in accordance with the rotation of the pounding shaft 206. By rotating the pounding shaft 206, therefore, the distance between the center of the axis of the pounding shaft 206 and each of link receiving units 20312R, 20312L to which the end portion of the link is fitted is varied. Since the massaging ball arms 202R, 202L are rotatably supported around the massaging shaft 205, the massaging ball arms 202R, 202L are caused to swing around the massaging shaft 205 by rotating the pounding shaft 206 at an appropriate speed by driving the pounding motor so as to achieve the pounding operation.

(Finger-pressing Process)

Figure 31:
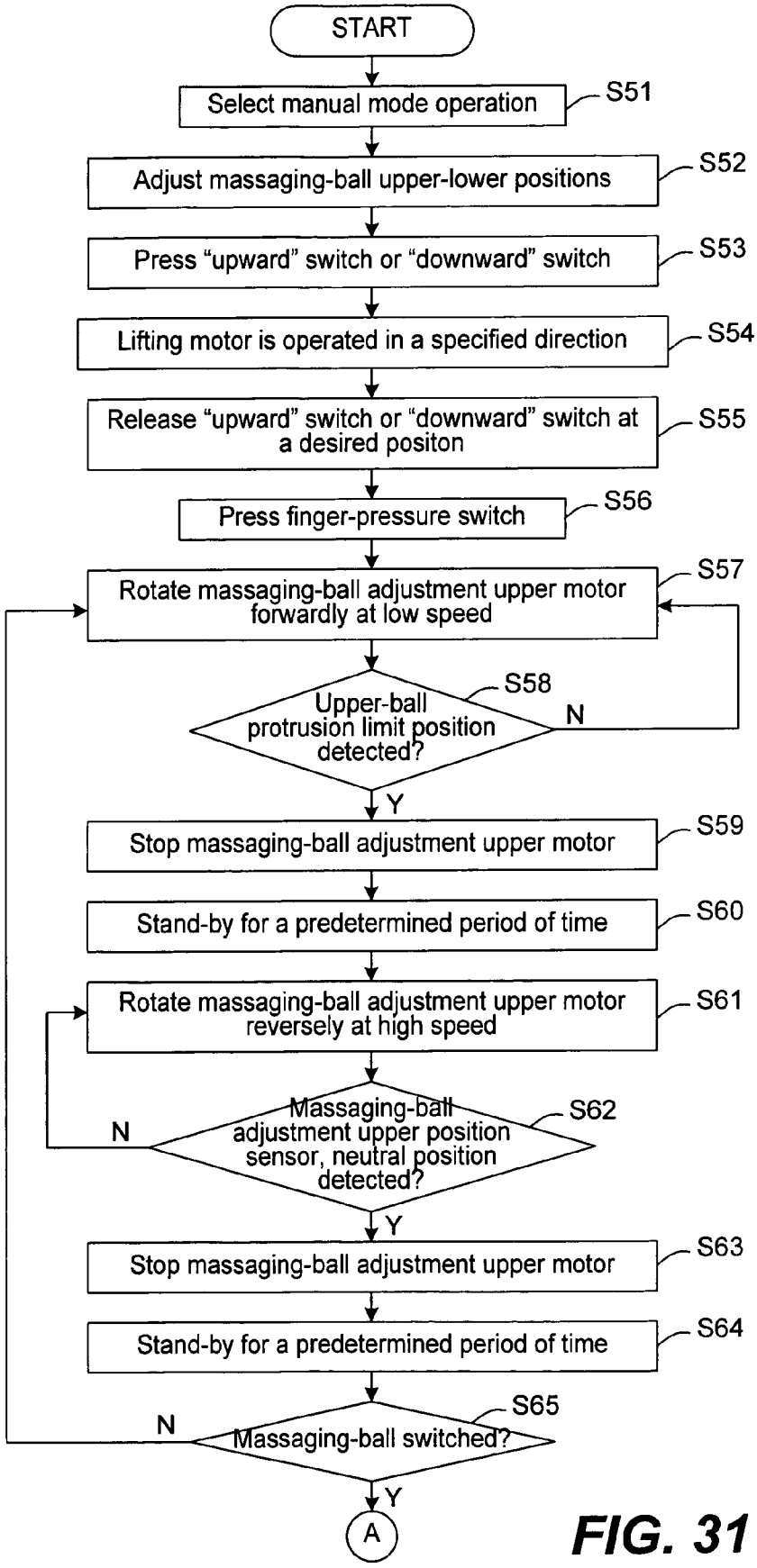
FIG. 31 is a flowchart that explains a sequence of finger-pressure operations of the vibrator.
Figure 32:
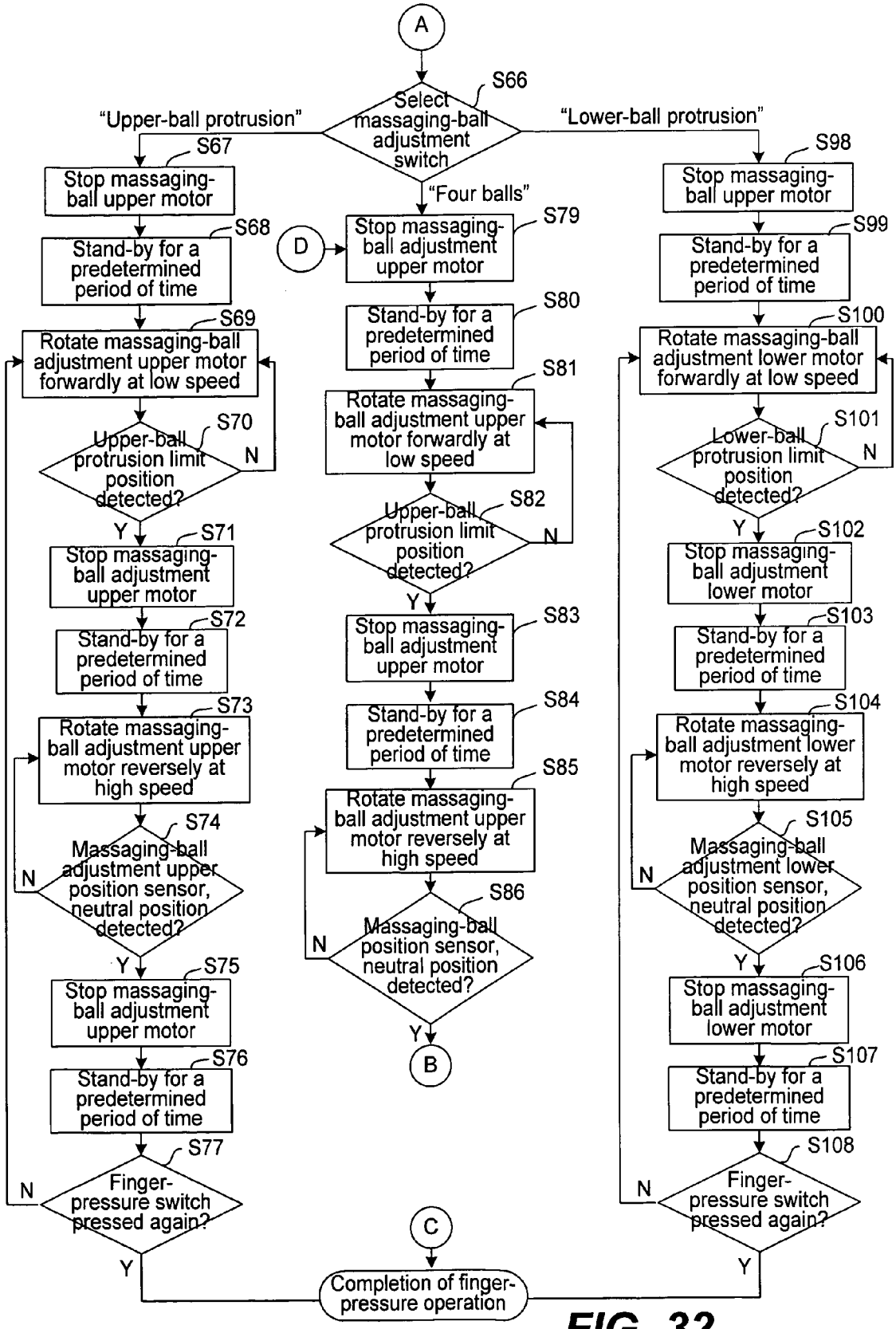
FIG. 32 is a flowchart that explains the sequence of finger-pressure operations of the vibrator.
Figure 33:
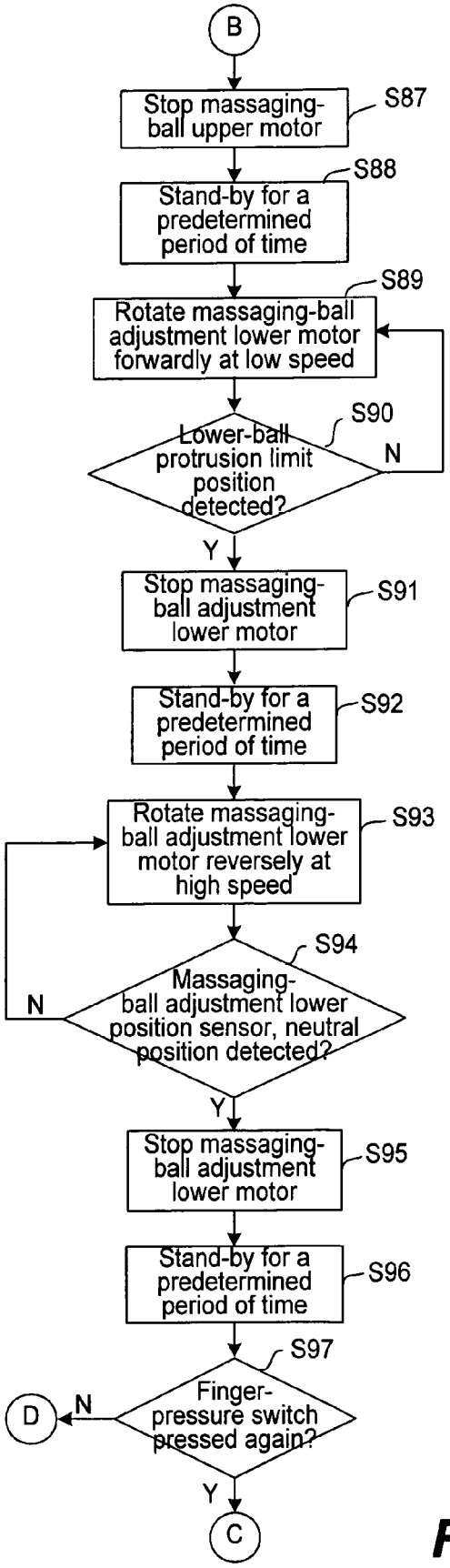
FIG. 33 is a flowchart that explains the sequence of finger-pressure operations of the vibrator.

A sequence of finger-pressing operations is described next. FIGS. 31, 32 and 33 are flowcharts that explain a sequence of finger-pressing operations of the vibrator 10.

First, the operation of a manual mode is selected (step 51) so that the upper and lower positions of the massaging balls are adjusted (step 52). At this time, the user pushes "upward" or "downward" switch on the operation unit 11 (step 53). In response, the lifting motor 301 is operated in the specified direction (step 54). When the massaging balls 201 have been shifted to a desired position, the user releases "upward" switch or "downward" switch on the lifting roller (step 55). Next, the user pushes the finger-pressing switch (step 56). In response, the massaging ball adjusting upper motor 401A is rotated forwardly at a low speed (step 57), and it is determined whether or not the massaging ball adjusting upper position sensors (1) to (4) 417A have detected the upper-ball protrusion limit position (step 58). If the massaging ball adjusting upper position sensors (1) to (4) 417A have not detected the upper-ball protrusion limit position, the sequence returns to step 57 so that the massaging ball adjusting upper motor 401A is further rotated forwardly at a low speed. If the massaging ball adjusting upper position sensors (1) to (4) 417A have detected the upper-ball protrusion limit position, the massaging ball adjusting upper motor 401A is stopped (step 59), and the sequence enters a stand-by state for a predetermined time (step 60), and the massaging ball adjusting upper motor 401A is then rotated backward at a high speed (step 61). Next, it is determined whether or not the massaging ball adjusting upper position sensors (1) to (4) 417A have detected the neutral position (step 62), and when the massaging ball adjusting upper position sensors (1) to (4) 417A have not detected the neutral position, the sequence returns to step 61 so that the massaging ball adjusting upper motor 401A is further rotated backward at a high speed. In case when the massaging ball adjusting upper position sensors (1) to (4) 417A have detected the neutral position, the massaging ball adjusting upper motor 401A is stopped (step 63), and the sequence enters a stand-by state for a predetermined time (step 64), and it is determined whether or not a massaging ball switching process is carried out (that is, whether or not a massaging ball adjusting switch has been pressed) (step 65). When the massaging ball switching process is not carried out, the sequence returns to step 57, and the massaging ball adjusting upper motor 401A is rotated forwardly at a low speed. When the massaging ball switching process is carried out, it is determined which massaging ball adjusting switch has been selected (step 66).

If an "upper ball protrusion" switch is selected in step 66, the massaging ball adjusting upper motor 401A is stopped (step 67), and the sequence enters a stand-by state for a predetermined time (step 68), and the massaging ball adjusting upper motor 401A is rotated forwardly at a low speed (step 69). Next, it is determined whether or not the massaging ball adjusting upper position sensors (1) to (4) 417A have detected the upper-ball protrusion limit position (step 70), and when the massaging ball adjusting upper position sensors (1) to (4) 417A have not detected the upper-ball protrusion limit position, the sequence returns to step 69 so that the massaging ball adjusting upper motor 401A is further rotated forwardly. If the massaging ball adjusting upper position sensors (1) to (4) 417A have detected the upper-ball protrusion limit position, the massaging ball adjusting upper motor 401A is stopped (step 71), and the sequence enters a stand-by state for a predetermined time (step 72), and the massaging ball adjusting upper motor 401A is rotated backward at a high speed (step 73). Next, it is determined whether or not the massaging ball adjusting upper position sensors (1) to (4) 417A have detected the neutral position (step 74), and when the massaging ball adjusting upper position sensors (1) to (4) 417A have not detected the neutral position, the sequence returns to step 73 so that the massaging ball adjusting upper motor 401A is further rotated forwardly at a high speed. If the massaging ball adjusting upper position sensors (1) to (4) 417A have detected the neutral position, the massaging ball adjusting upper motor 401A is stopped (step 75), and the sequence enters a stand-by state for a predetermined time (step 76). It is then determined whether or not the finger-pressing switch has been again pressed (step 77). If the finger-pressing switch has been again pressed, the finger-pressing operation is completed (step 78). When the finger-pressing switch has not been again pressed, the sequence returns to step 69 so that the massaging ball adjusting upper motor 401A is further rotated forwardly at a low speed.

If a "four-ball" switch is selected in step 66, the massaging ball adjusting upper motor 401A is stopped (step 79), and a sequence enters a stand-by state for a predetermined time (step 80), and the massaging ball adjusting upper motor 401A is then rotated forwardly at a low speed (step 81). Next, it is determined whether or not the massaging ball adjusting upper position sensors (1) to (4) 417A have detected the upper-ball protrusion limit position (step 82). If the massaging ball adjusting upper position sensors (1) to (4) 417A have not detected the upper-ball protrusion limit position, the sequence returns to step 81 so that the massaging ball adjusting upper motor 401A is further rotated forwardly at a low speed. If the massaging ball adjusting upper position sensors (1) to (4) 417A have detected the upper-ball protrusion limit position, the massaging ball adjusting upper motor 401A is stopped (step 83), and the sequence enters a stand-by state for a predetermined time (step 84), and the massaging ball adjusting upper motor 401A is rotated backward at a high speed (step 85). Next, it is determined whether or not the massaging ball adjusting upper position sensors (1) to (4) 417A have detected the neutral position (step 86), and when the massaging ball adjusting upper position sensors (1) to (4) 417A have not detected the neutral position, the sequence returns to step 85 so that the massaging ball adjusting upper motor 401A is further rotated forwardly at a high speed. If the massaging ball adjusting upper position sensors (1) to (4) 417A have detected the neutral position, the massaging ball adjusting upper motor 401A is stopped (step 87), and the sequence enters a stand-by state for a predetermined time (step 88). The massaging ball adjusting lower motor 401B is then rotated forwardly at a low speed (step 89). Next, it is determined whether or not the massaging ball adjusting lower position sensors (1) to (4) 417B have detected the lower-ball protrusion limit position (step 90). If the massaging ball adjusting lower position sensors (1) to (4) 417B have not detected the lower-ball protrusion limit position, the sequence returns to step 89 so that the massaging ball adjusting lower motor 401B is further rotated forwardly at a low speed. If the massaging ball adjusting lower position sensors (1) to (4) 417B have detected the lower-ball protrusion limit position, the massaging ball adjusting lower motor 401B is stopped (step 91), and the sequence enters a stand-by state for a predetermined time (step 92), and the massaging ball adjusting lower motor 401B is then rotated backward at a high speed (step 93). Next, it is determined whether or not the massaging ball adjusting lower position sensors (1) to (4) 417B have detected the neutral position (step 94), and if the massaging ball adjusting lower position sensors (1) to (4) 417B have not detected the neutral position, the sequence returns to step 93 so that the massaging ball adjusting lower motor 4011B is further rotated forwardly at a high speed. If the massaging ball adjusting lower position sensors (1) to (4) 417B have detected the neutral position, the massaging ball adjusting lower motor 401B is stopped (step 95), and the sequence enters a stand-by state for a predetermined time (step 96). It is then determined whether or not the finger-pressing switch has been again pressed (step 97). If the finger-pressing switch has been again pressed, the finger-pressing operation is completed (step 78). If the finger-pressing switch has not been again pressed, the sequence returns to step 79 so that the massaging ball adjusting upper motor 401A is stopped.

When a "lower-ball protrusion" switch is selected in step 66, the massaging ball adjusting upper motor 401A is stopped (step 98), and the sequence enters a stand-by state for a predetermined time (step 99), and the massaging ball adjusting lower motor 401B is then rotated forwardly at a low speed (step 100). Next, it is determined whether or not the massaging ball adjusting lower position sensors (1) to (4) 417B have detected the lower-ball protrusion limit position (step 101). If the massaging ball adjusting lower position sensors (1) to (4) 417B have not detected the lower-ball protrusion limit position, the sequence returns to step 100 so that the massaging ball adjusting lower motor 401B is further rotated forwardly at a low speed. If the massaging ball adjusting lower position sensors (1) to (4) 417B have detected the lower-ball protrusion limit position, the massaging ball adjusting lower motor 401B is stopped (step 102), and the sequence enters a stand-by state for a predetermined time (step 103), and the massaging ball adjusting lower motor 401B is rotated backward at a high speed (step 104). Next, it is determined whether or not the massaging ball adjusting lower position sensors (1) to (4) 417B have detected the neutral position (step 105), and if the massaging ball adjusting lower position sensors (1) to (4) 417B have not detected the neutral position, the sequence returns to step 104 so that the massaging ball adjusting lower motor 401B is further rotated forwardly at a high speed. If the massaging ball adjusting lower position sensors (1) to (4) 417B have detected the neutral position, the massaging ball adjusting lower motor 401B is stopped (step 106), and the sequence enters a stand-by state for a predetermined time (step 107) It is then determined whether or not the finger-pressing switch has been again pressed (step 108). If the finger-pressing switch has been pressed again, the finger-pressing operation is completed (step 78). If the finger-pressing switch has not been pressed again, the sequence returns to step 100 so that the massaging ball adjusting lower motor 401B is further rotated forwardly at a low speed.

(Back Stretching Process)

During a back stretching process, both of the massaging shaft 205 and the pounding shaft 206 are stopped, the lifting motor 301 is driven with the massaging ball arms 202R, 202L being held at the massaging origin position so that the entire massaging mechanism 1 is moved upward and downward along a rail. In this case, the kind (upper or lower massaging balls), number and amount of protrusion of the massaging balls to be used are switched by massaging ball adjusting switches on demand.

If a "drawing" mode is selected in the massaging ball adjustments in the operation unit 11, both the massaging ball adjusting upper motor 401A and the massaging ball adjusting lower motor 401B are backwardly rotated so that the treating unit 110 is caused to retreat toward the back face side as shown in FIG. 24.

(Massaging Ball Switching Process)

If a back stretching treatment is carried out upward and downward along the portion from the shoulder to waist, or when a composite treatment of this treatment and a pounding or massaging operation is carried out, the treatment unit 110 is raised and lowered between the upper end and the lower end in a shifting range along the guide rails 110R, 110L. If the aforementioned treatment is carried out by using only either of the pairs of massage balls 201*a*, 201*b* on the upper side and massage balls 201*c*, 201*d* on the lower side, the shifting range of the treating unit 110 is set in the same manner. However, there is a slight gap between the installation positions of the massage balls 201*a*, 201*b* on the upper side and massage balls 201*c*, 201*d* on the lower side in a longitudinal direction. For this reason, when a treatment such as the back stretching process is carried out by using only the massaging balls 201*a*, 201*b* on the upper side, a range to which no treatment is applied due to non-contact of the massaging balls to the treatment subject portion is generated at the lower end portion (that is, the waist portion), and when such a treatment is carried out by using only the massaging balls 201*c*, 201*d* on the lower side, such a range is generated at the upper end portion (that is, the shoulder portion). Even if a partial stretching treatment is carried out on one portion in a range from the shoulder to the waist while shifting upward and downward, the same problem occurs at the upper end and the lower end in the shifting range of the treating unit 110.

In order to solve this problem by switching the massaging balls to be used for the treatment at the upper end and lower end in the shifting range of the treating unit 110, a treatment may be carried out even in the range of the treatment subject portion which has not been covered with only the use of either one of the pairs of the upper and lower massaging balls, by using the other pair of the massaging balls. Three massaging ball switching operations will be described, but any of the two of them or all the three of them may be used to carry out the treatment in a combined manner. The process in which only the two massaging balls are used for the treatment may include a process using four massaging balls. Furthermore, although the following description does not refer to treatments such as pounding; however, the following switching operations may be carried out while executing these treatments, and a treatment, such as massaging or pounding, may be carried out between the back stretching treatments or the partial stretching treatments.

(First Massaging Ball Switching Operation)

Figure 34:
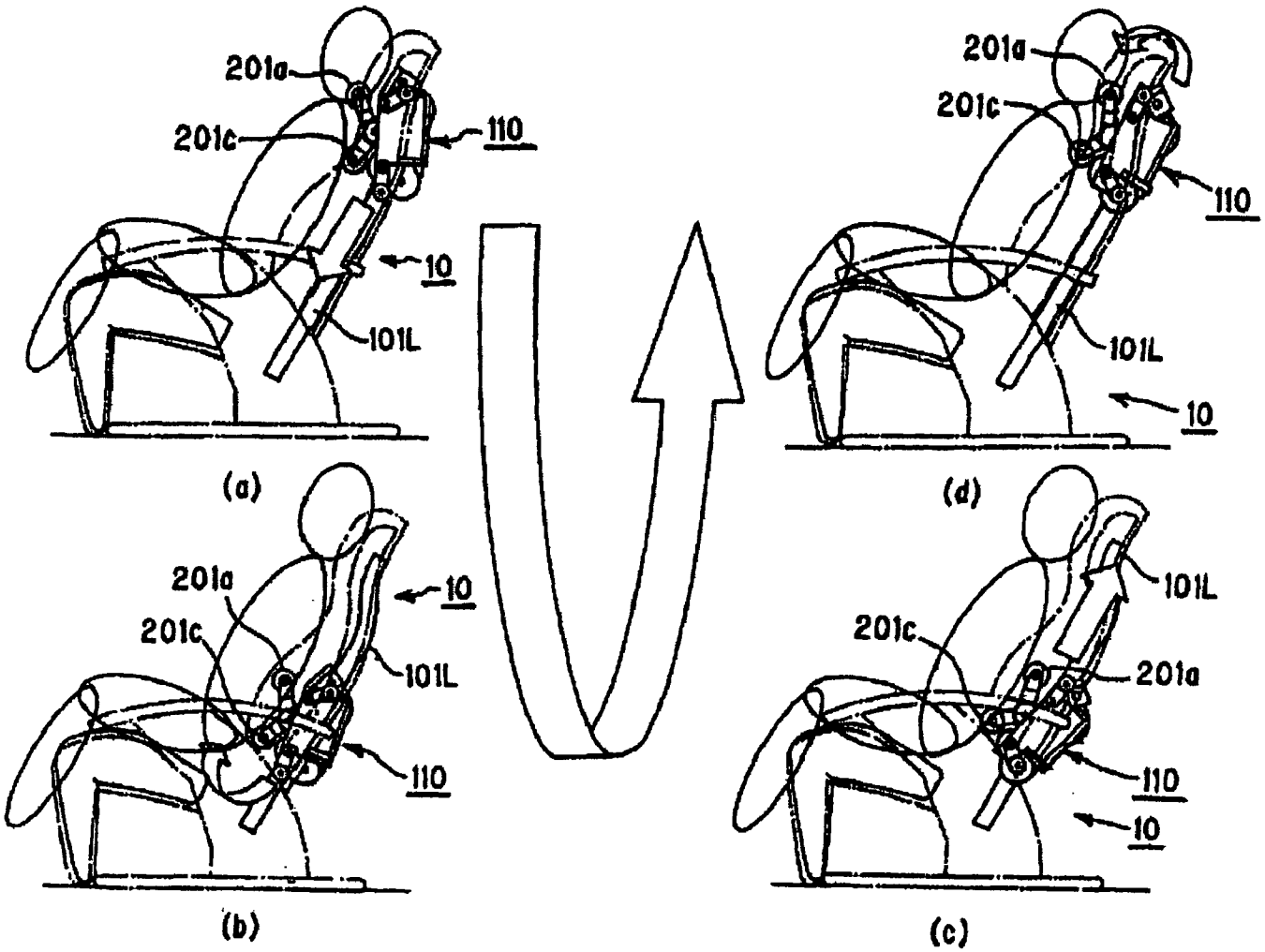
FIGS. 34(*a*), 34(*b*), 34(*c*) and 34(*d*) are drawings that show an operational transition of the treating unit at the time of a first massaging ball switching operation.
Figure 35:
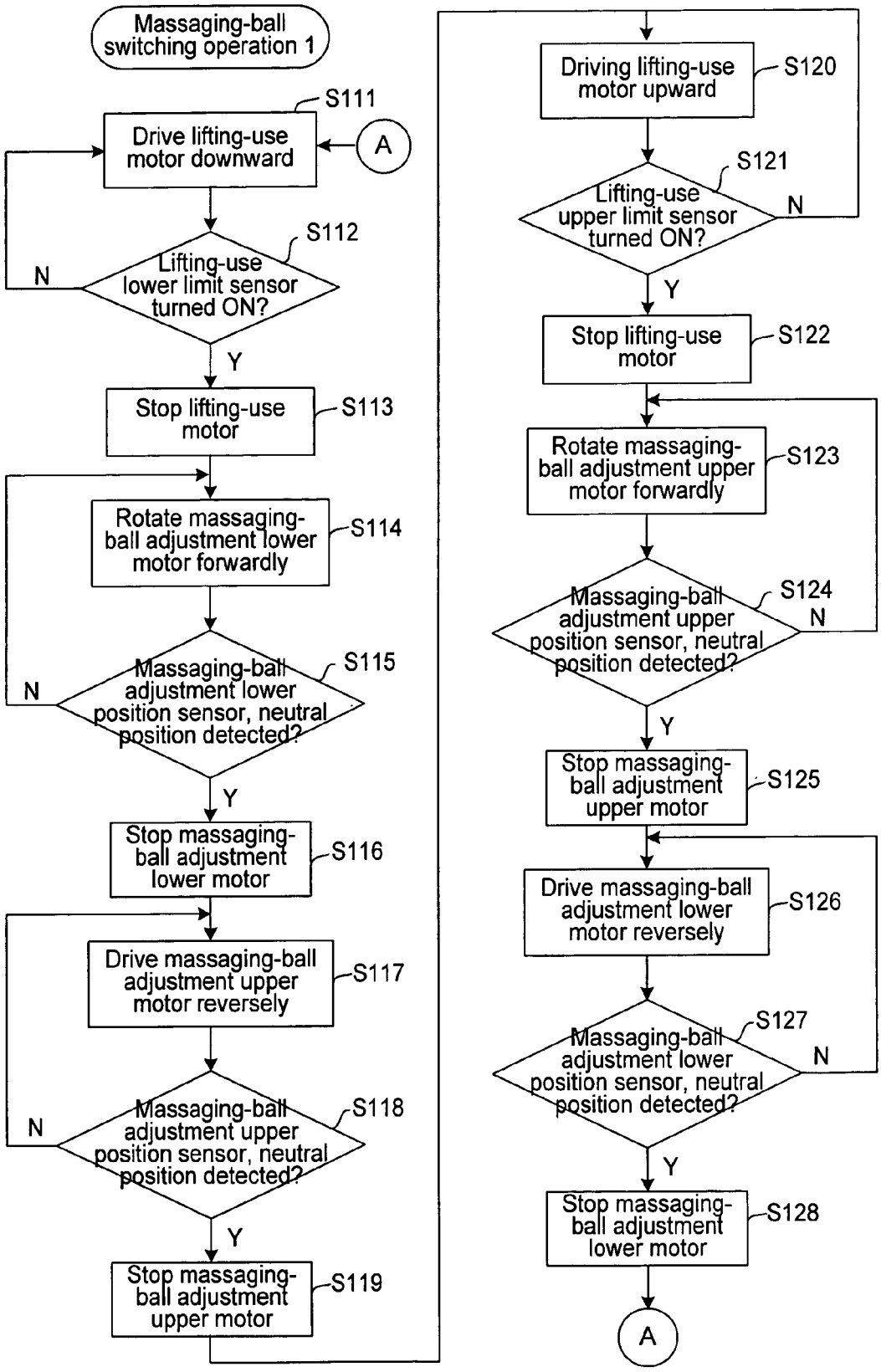
FIG. 35 is a flowchart that explains the sequence of the first massaging ball switching operation.

A sequence of first massaging ball switching operations during a back stretching treatment will be described next. FIG. 34 is a drawing that shows a transition of operations in the treating unit 110. FIG. 35 is a flowchart that explains a sequence of massaging ball switching operations.

First, as shown in FIG. 34(*a*), the treating unit 110 drives the lifting motor 301 downward from the upper end portion of the guide rails 101R, 101L, with the massaging balls 201*a*, 201*b* on the upper side protruding toward the treatment subject portion and the massaging balls 201*c*, 201*d* on the lower side retreating toward the side opposite to the treatment subject portion (step 111). The treating unit 110 is lowered along the treatment subject portion, while being supported in the same orientation with respect to the guide rails 101R, 101L. When the lifting lower-limit sensor 315 is turned on (step 112), the lifting motor 301 is stopped (step 113). Next, as shown in FIG. 35(*b*), the massaging ball adjusting lower motor 401B is rotated forwardly (step 114), and when the massaging ball adjusting lower position sensors have detected the state that the massaging balls 201*c*, 201*d* on the lower side stick out to a predetermined position (step 115), the massaging ball adjusting lower motor 401B is stopped (step 116). Next, the massaging ball adjusting upper motor 401A is backwardly rotated (step 117), and when the massaging ball adjusting upper position sensors have detected the state that the massaging balls 201*a*, 201*b* on the upper side have retreated to a predetermined position (step 118), the massaging ball adjusting upper motor 401A is stopped (step 119).

As shown in FIG. 34(*c*), the lifting motor 301 is successively driven upward (step 120). The treating unit 110 is raised along the treatment subject portion while being supported in the same orientation with respect to the guide rails 101R, 101L. When the lifting upper limit sensor 314 is turned on (step 121), the lifting motor 301 is stopped (step 122). Next, as shown in FIG. 34(*d*), the massaging ball adjusting upper motor 401A is rotated forwardly (step 123), and when the massaging ball adjusting upper position sensors have detected the state that the massaging balls 201*a*, 201*b* on the upper side stick out to a predetermined position (step 124), the massaging ball adjusting upper motor 401A is stopped (step 125). Next, the massaging ball adjusting lower motor 401B is backwardly rotated (step 126), and when the massaging ball adjusting lower position sensors have detected the state that the massaging balls 201*c*, 201*d* on the lower side has retreated to a predetermined position (step 127), the massaging ball adjusting lower motor 401B is stopped (step 128).

The sequence returns to step 111 thereafter so that the treating unit is again lowered and the above-mentioned operations are repeated.

In this manner, in the first massaging ball switching operation, the orientation of the treating unit 110 is switched at the upper end and the lower end of the guide rails 101R, 101L. While the treating unit 110 is lowered along the guide rails 101R, 101L, the massaging balls 201*a*, 201*b* on the upper side are caused to stick out toward the treatment subject portion, with the massaging balls 201*c*, 201*d* on the lower side being maintained in a retreated state to the side opposite to the treatment subject portion. While it is raised, by contrast, the massaging balls 201*c*, 201*d* on the lower side are caused to stick out toward the treatment subject portion, with the massaging balls 201*a*, 201*b* on the upper side being maintained in a retreated state to the side opposite to the treatment subject portion.

(Second Massaging Ball Switching Operation)

Figure 36:
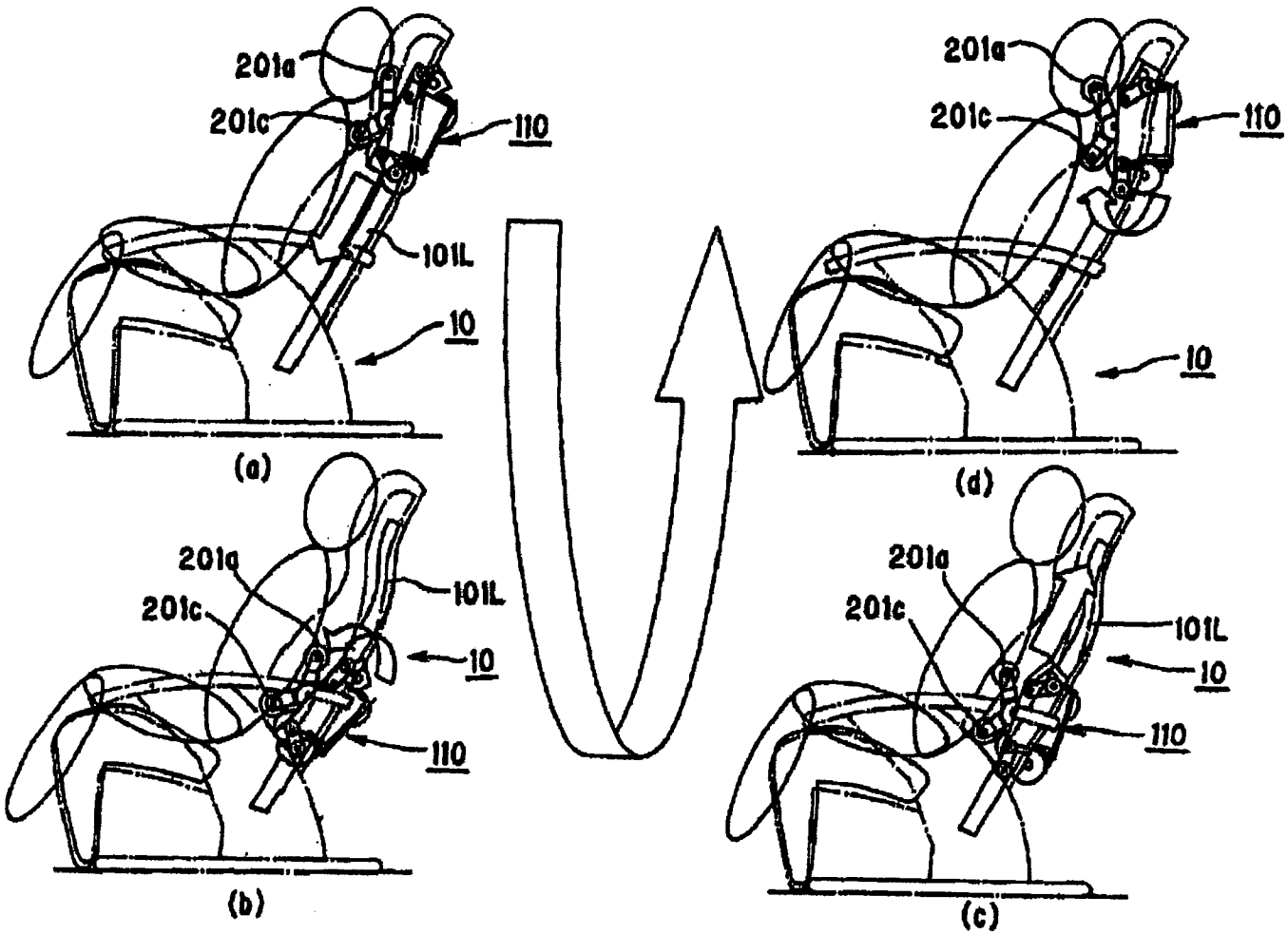
FIGS. 36(*a*), 36(*b*), 36(*c*) and 36(*d*) are drawings that show an operational transition of the treating unit at the time of a second massaging ball switching operation.
Figure 37:
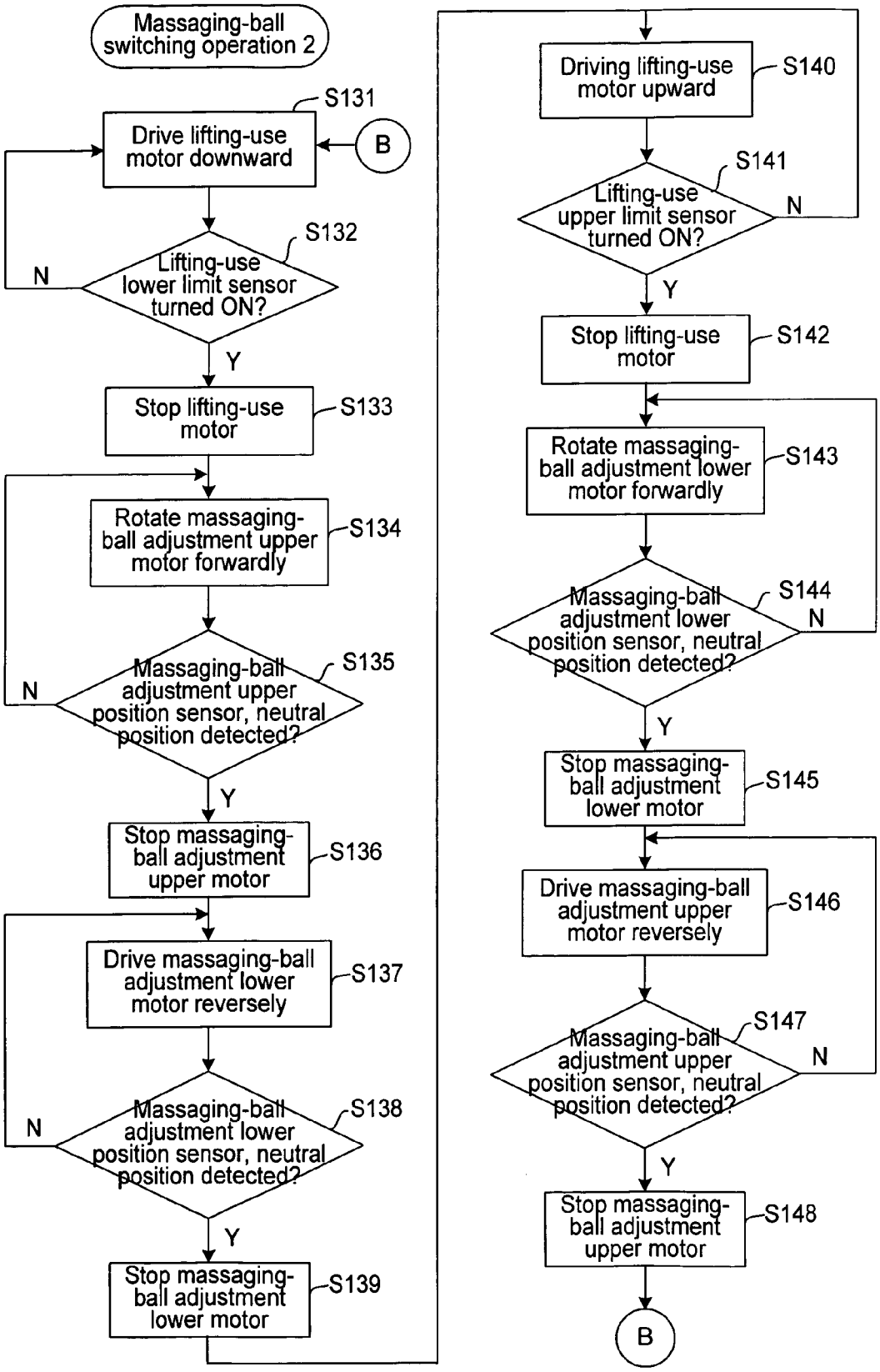
FIG. 37 is a flowchart that explains the sequence of the second massaging ball switching operation.

A sequence of second massaging ball switching operations during a back stretching treatment is described next. FIG. 36 is a drawing that shows a transition of operations in the treating unit 110. FIG. 37 is a flowchart that explains a sequence of massaging ball switching operations.

First, as shown in FIG. 36(*a*), the treating unit 110 drives the lifting motor 301 downward from the upper end portion of the guide rails 101R, 101L, with the massaging balls 201*a*, 201*b* on the upper side retreating toward the side opposite to the treatment subject portion and the massaging balls 201*c*, 201*d* on the lower side sticking out toward the treatment subject portion (step 131). The treating unit 110 is lowered along the treatment subject portion, while being supported in the same orientation with respect to the guide rails 101R, 101L. When the lifting lower-limit sensor 315 is turned on (step 132), the lifting motor 301 is stopped (step 133). Next, as shown in FIG. 36(*b*), the massaging ball adjusting upper motor 401A is rotated forwardly (step 134), and when the massaging ball adjusting upper position sensors have detected the state that the massaging balls 201*a*, 201*b* on the upper side stick out to a predetermined position (step 135), the massaging ball adjusting upper motor 401A is stopped (step 136). Next, the massaging ball adjusting lower motor 401B is backwardly rotated (step 137), and when the massaging ball adjusting lower position sensors have detected the state that the massaging balls 201*c*, 201*d* on the lower side has retreated to a predetermined position (step 138), the massaging ball adjusting lower motor 401B is stopped (step 139).

As shown in FIG. 36(*c*), the lifting motor 301 is successively driven upward (step 140). The treating unit 110 is raised along the treatment subject portion while being supported in the same orientation with respect to the guide rails 101R, 101L. When the lifting upper limit sensor 314 is turned on (step 141), the lifting motor 301 is stopped (step 142). Next, as shown in FIG. 36(*d*), the massaging ball adjusting lower motor 401B is rotated forwardly (step 143), and when the massaging ball adjusting lower position sensors have detected the state that the massaging balls 201*c*, 201*d* on the lower side stick out to a predetermined position (step 144), the massaging ball adjusting lower motor 401B is stopped (step 145). Next, the massaging ball adjusting upper motor 401A is backwardly rotated (step 146), and when the massaging ball adjusting upper position sensors have detected the state that the massaging balls 201*a*, 201*b* on the upper side have retreated to a predetermined position (step 147), the massaging ball adjusting upper motor 401A is stopped (step 148).

The sequence returns to step 131 thereafter so that the treating unit is again lowered and the above-mentioned operations are repeated.

The orientation of the treating unit 110 is thus altered in the second massaging ball switching operation at the upper end and the lower end of the guide rails 101R, 101L in the same manner as in the first massaging ball switching operation. In the second massaging ball operation, while the treating unit 110 is lowered along the guide rails 101R, 101L, the massaging balls 201*c*, 201*d* on the lower side are caused to stick out toward the treatment subject portion while the massaging balls 201*a*, 201*b* on the upper side are maintained in a retreated state away from the treatment subject portion. While it is raised, by contrast, the massaging balls 201*a*, 201*b* on the upper side are caused to stick out toward the treatment subject portion, with the massaging balls 201*c*, 201*d* on the lower side being maintained in a retreated state to the side opposite to the treatment subject portion.

(Third Massaging Ball Switching Operation)

Figure 38:
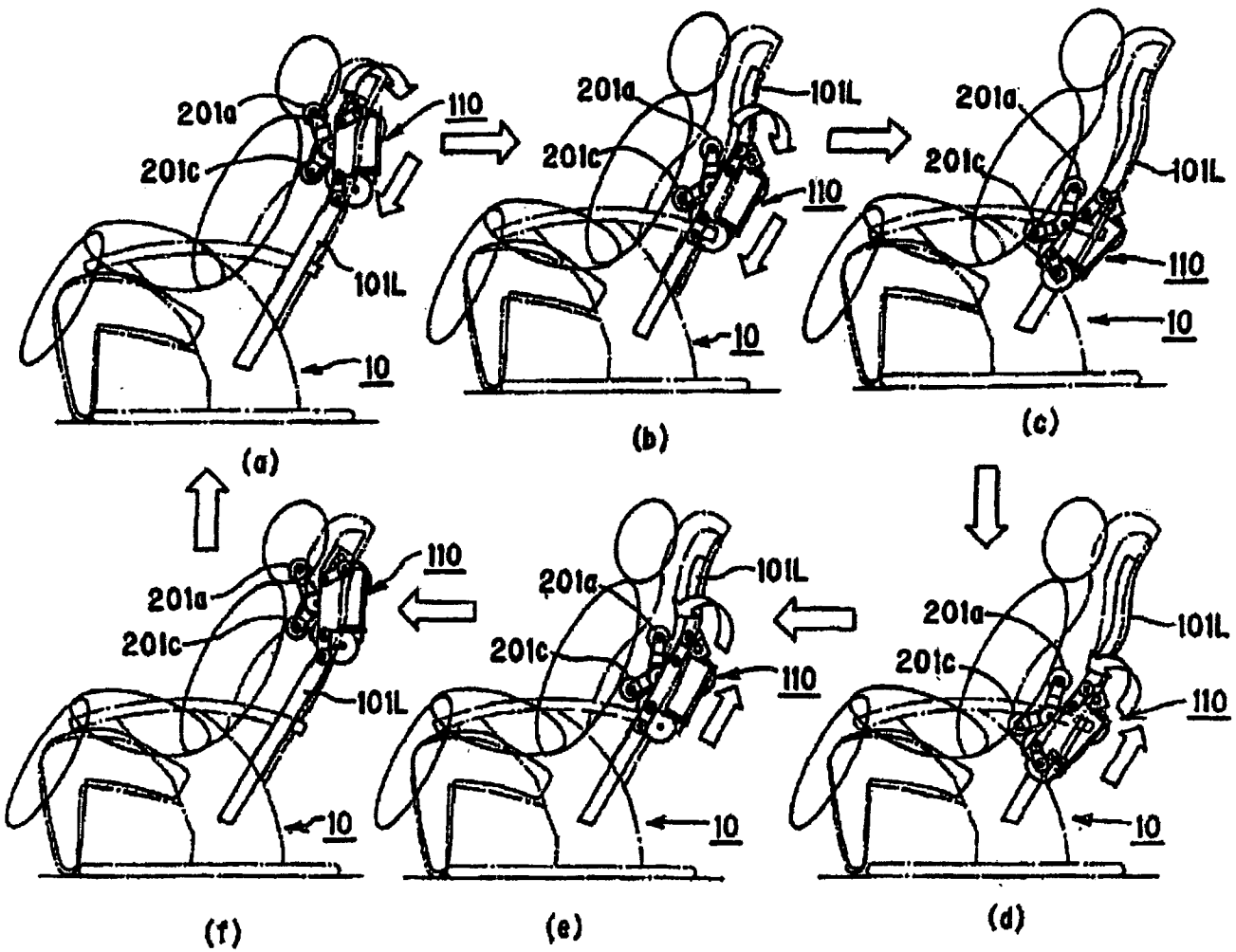
FIGS. 38(*a*), 38(*b*), 38(*c*), 38(*d*), 38(*e*) and 38(*f*) are drawings that show an operational transition of the treating unit at the time of a third massaging ball switching operation.
Figure 39:
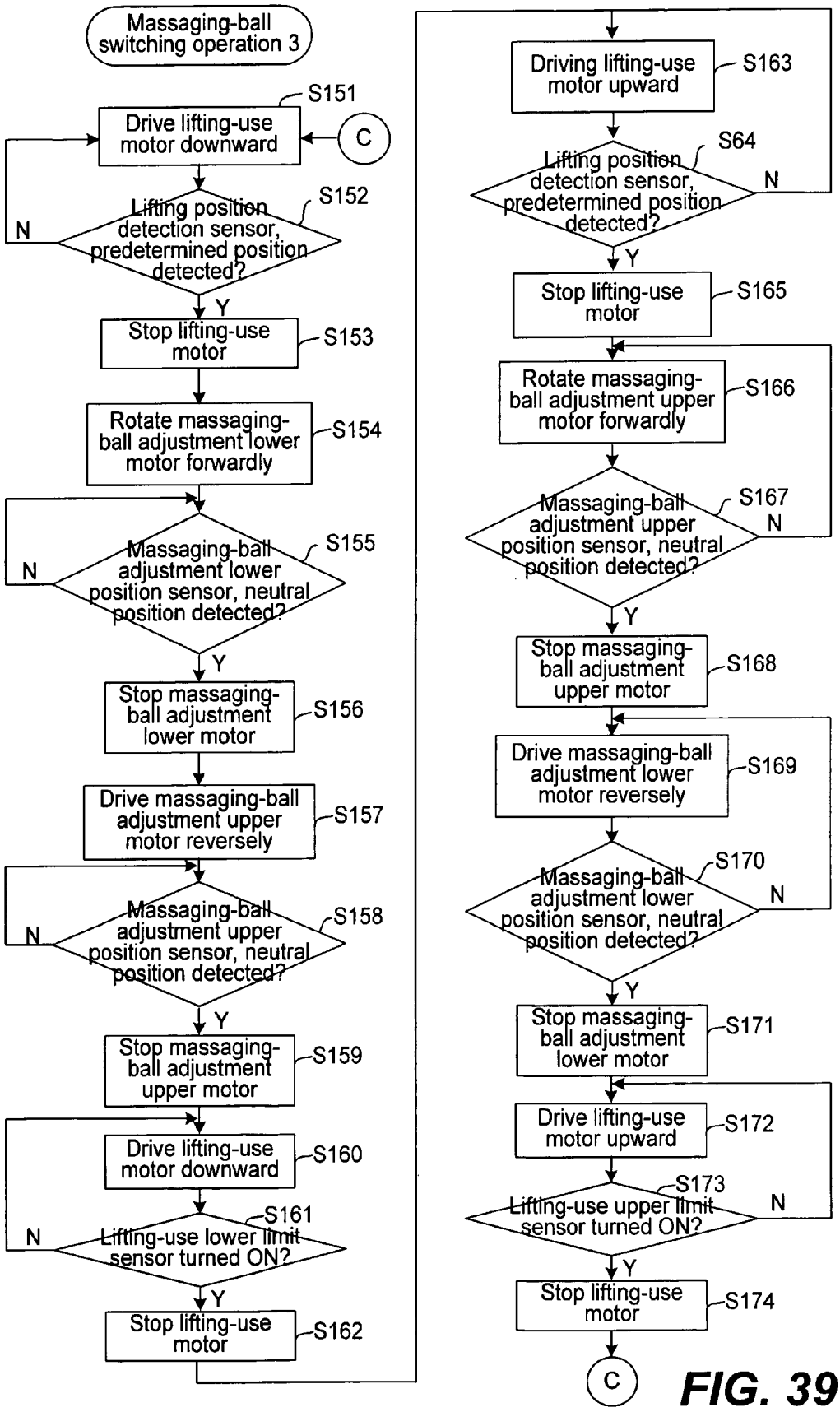
FIG. 39 is a flowchart that explains the sequence of the third massaging ball switching operation.

A sequence of third massaging ball switching operations during a back stretching treatment is described next. FIG. 38 is a drawing that shows a transition of operations in the treating unit 110. FIG. 39 is a flowchart that explains a sequence of massaging ball switching operations.

First, as shown in FIG. 38(*a*), the treating unit 110 drives the lifting motor 301 downward from the upper end portion of the guide rails 101R, 101L while the massaging balls 201*a*, 201*b* on the upper side stick out toward the treatment subject portion and the massaging balls 201*c*, 201*d* on the lower side retreat away from the treatment subject portion (step 151). The treating unit 110 is lowered along the treatment subject portion, while being supported in the same orientation with respect to the guide rails 101R, 101L. When the lifting position detection sensor 313 has detected a predetermined position (step 152), the lifting motor 301 is stopped (step 153). Next, as shown in FIG. 38(*b*), the massaging ball adjusting lower motor 401B is rotated forwardly (step 154), and when the massaging ball adjusting lower position sensors have detected the state that the massaging balls 201*c*, 201*d* on the lower side stick out to a predetermined position (step 155), the massaging ball adjusting lower motor 401B is stopped (step 156). Next, the massaging ball adjusting upper motor 401A is backwardly rotated (step 157), and when the massaging ball adjusting upper position sensors have detected the state that the massaging balls 201*a*, 201*b* on the upper side has retreated to a predetermined position (step 158), the massaging ball adjusting upper motor 401A is stopped (step 159). Next, the lifting motor 301 is driven downward (step 160). The treating unit 110 is lowered along the treatment subject portion, while being supported in the same orientation with respect to the guide rails 101R, 101L. As shown in FIG. 38(*c*), when the lifting lower-limit sensor 315 is turned on (step 161), the lifting motor 301 is stopped (step 162).

As shown in FIG. 38(*d*), the lifting motor 301 is successively driven upward (step 163). When the lifting position detection sensor 313 has detected a predetermined position (step 164), the lifting motor 301 is stopped (step 165). Next, as shown in FIG. 38(*e*), the massaging ball adjusting upper motor 401A is rotated forwardly (step 166), and when the massaging ball adjusting upper position sensors have detected the state that the massaging balls 201*a*, 201*b* on the upper side stick out to a predetermined position (step 167), the massaging ball adjusting upper motor 401A is stopped (step 168). Next, the massaging ball adjusting lower motor 401B is backwardly rotated (step 169), and when the massaging ball adjusting lower position sensors have detected the state that the massaging balls 201*c*, 201*d* on the lower side have retreated to a predetermined position (step 170), the massaging ball adjusting lower motor 401B is stopped (step 171). Next, the lifting motor 301 is driven downward (step 172). The treating unit 110 is raised along the treatment subject portion, while being supported in the same orientation with respect to the guide rails 101R, 101L. As shown in FIG. 38(*f*), when the lifting upper-limit sensor 314 is turned on (step 173), the lifting motor 301 is stopped (step 174).

The sequence returns to step 151 thereafter so that the treating unit is lowered again and the above-mentioned operations are repeated.

In the third massaging ball switching operation, the orientation of the treating unit is thus altered at a predetermined position in the middle of a range between the upper end and the lower end of the guide rails 101R, 101L. Therefore, on the upper end side of the guide rails 101R, 101L, the massaging balls 201*a*, 201*b* on the upper side are caused to stick out toward the treatment subject portion during both of the raising and lowering processes, with the massaging balls 201*c*, 201*d* on the lower side being supported in a retreated state to the side opposite to the treatment subject portion. On the lower end side of the guide rails 101R, 101L, by contrast, the massaging balls 201*c*, 201*d* on the lower side are caused to stick out toward the treatment subject portion during both of the raising and lowering processes, with the massaging balls 201*a*, 201*b* on the upper side being supported in a retreated state to the side opposite to the treatment subject portion.

In the operation described above, the lifting motor 301 is stopped in the middle of the shifting range of the treating unit 110 to alter the orientation of the treating unit 110; however, the orientation may be altered while being shifted. Moreover, the orientation altering positions of the treating unit 110 at the time of raising and lowering may be set at the same position or different positions.

With respect to the first to third massaging ball switching operations described above, it is preferable to determine which pair of massaging balls, the massaging balls 201*a*, 201*b* or the massaging balls 201*c*, 201*d*, is first subjected to the protruding process to the treatment subject portion and the retreating process to the side opposite to the treatment subject portion, and the invention is not intended to be limited by the order. These operations may be carried out simultaneously or with a predetermined time in between.

(Modified Example of the Structure of Massaging Balls)

Figure 40:
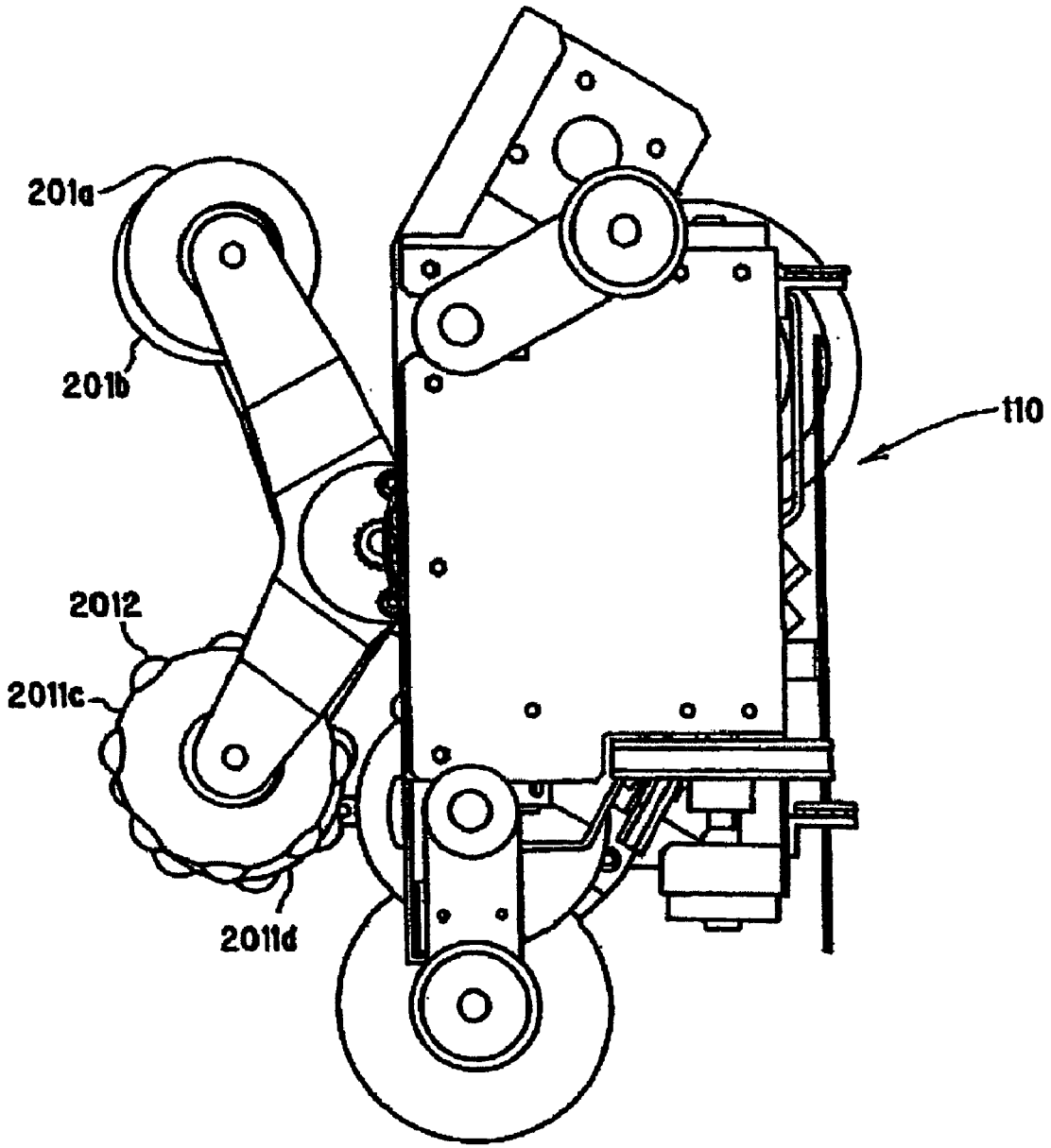
FIG. 40 is a drawing that shows another structural example of the massaging balls.

In the embodiment described above, each of the massaging balls 201*a*, 201*b* on the upper side and each of the massaging balls 201*c*, 201*d* on the lower side has the same shape. Therefore, whether the massaging balls 201*a*, 201*b* on the upper side or the massaging balls 201*c*, 201*d* may be used, the touch to the user or the treatment effects to the user is kept unchanged. However, as shown in FIG. 40, the circumferential surface of each of the massaging balls 201*a*, 201*b* on the upper side may be formed to have a smooth curved face, with the circumferential face of each of the massaging balls 2011*c*, 2011*d* on the lower side being formed to have a plurality of small protrusions 2012. By causing the massaging balls 201*a*, 201*b* on the upper side and the massaging balls 2011*c*, 2011*d* on the lower side to have mutually different shapes, it is possible to achieve different touches to the user and different treatment effects to the user depending on the cases in which only the massaging balls 201*a*, 201*b* on the upper side are used and in which only the massaging balls 2011*c*, 2011*d* on the lower side are used.

In a vibrator with a structure of massaging balls as described above, it becomes possible by carrying out the switching operations of the massaging balls as described above to achieve massaging operations with various functions.

(Modified Example of Guide Rails)

Figure 41:
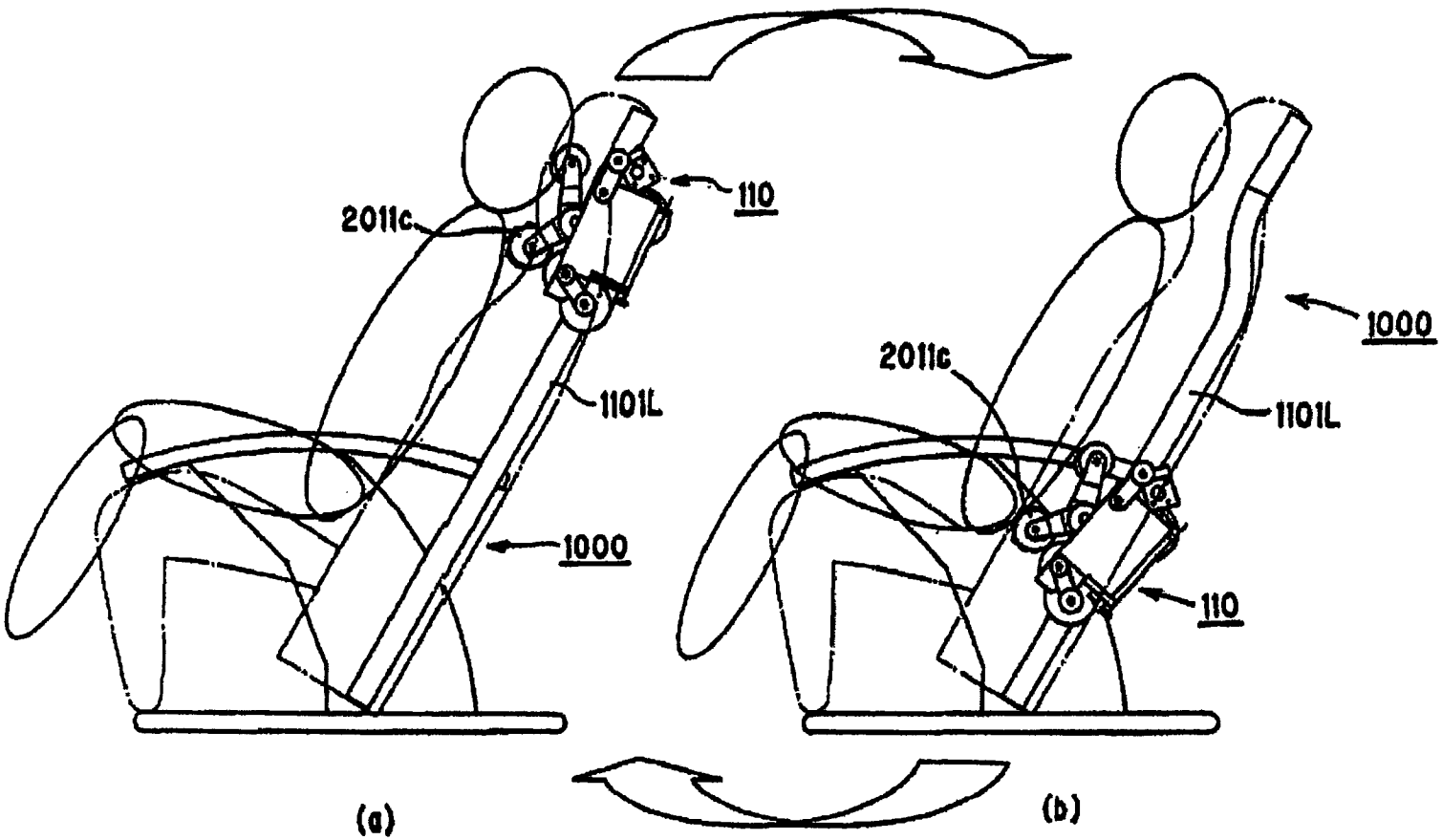
FIGS. 41(*a*) and 41(*b*) are drawings that explain another structural example of a guide rail.
Figure 42:
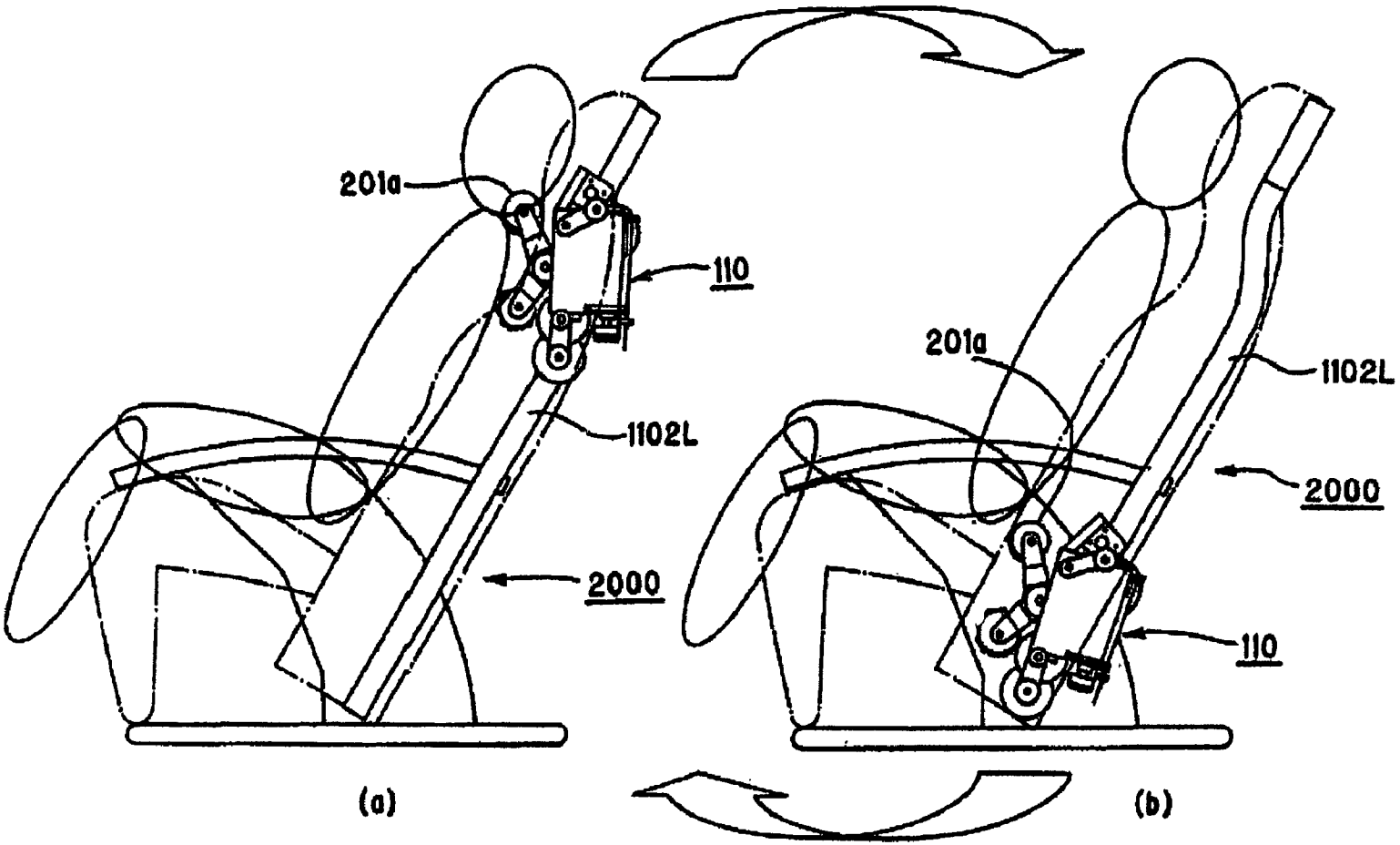
FIGS. 42(*a*) and 42(*b*) are drawings that explain still another structural example of the guide rail.

FIGS. 41 and 42 each show a schematic construction of a vibrator with guide rails having a different structure. They are the same as those described above except for the guide rails. Thus, like or equivalent parts are indicated by the same reference numerals and are not repetitiously described. Only featured structures will be explained.

FIG. 41 shows a vibrator 1000 having guide rails 110R, 110L that are extended upward. FIGS. 41(*a*) and 41(*b*) respectively show cases in which the treating unit 110 is positioned at the upper end and the lower end in the shifting range of the guide rails 110R, 110L. In FIG. 41(*a*), the massaging balls 201*c*, 201*d* on the lower side are positioned on the shoulder of the user with the massaging balls 201*a*, 201*b* on the upper side being positioned approximately in the center portion of the head. In FIG. 41(*b*), the massaging balls 201*c*, 201*d* on the lower side are positioned on the waist of the user in the same manner as the above-mentioned embodiment. In other words, it becomes possible to carry out a treatment in which only the massaging balls 201*c*, 201*d* on the lower side are used over the entire range from the shoulder to the waist, and this arrangement is effectively applied to the case in which the massaging balls 201*a*, 201*b* on the upper side and the massaging balls 201*c*, 201*d* on the lower side have mutually different shapes.

FIG. 42 shows a vibrator 2000 having guide rails 1102R, 1102L that are extended downward. FIGS. 42(*a*) and 42(*b*) respectively show an example in which the treating unit 110 is positioned at the upper end and the lower end in the shifting range of the guide rails 1102R, 1102L. FIG. 42(*a*) shows an example in which the treating unit 110 is positioned at the upper end in the shifting range of the guide rails 1102R, 1102L with the massaging balls 201*a*, 201*b* being positioned on the shoulder of the user in the same manner as the above-mentioned embodiment. In FIG. 42(*b*), the massaging balls 201*a*, 201*b* on the upper side are positioned on the waist of the user with the massaging balls 201*c*, 201*d* on the lower side being positioned on portions further below the waist of the user. In other words, it becomes possible to carry out a treatment in which only the massaging balls 201*a*, 201*b* on the upper side are used over the entire range from the shoulder to the waist, and this arrangement is effectively applied to an example in which the massaging balls 201*a*, 201*b* on the upper side and the massaging balls 201*c*, 201*d* on the lower side have mutually different shapes.

INDUSTRUSTRIAL APPLICABILITY

As described above, it is possible within the scope of the invention to alter the position of the treating unit supporting the treating elements in a direction approximately orthogonal to the shifting direction with respect to the guiding means. It is therefore possible to increase the maximum adjustable distance between the treating elements and the human body to appropriately control the force that is exerted on the treatment subject portion, to provide treatments with strength suitable for the condition and the corresponding portion and also to achieve treatments with various functions. It also becomes possible to prevent the treating elements from becoming cumbersome when not being used.

What is claimed is:

1. A vibrator comprising:

a pair of right and left treating elements adapted to undergo treatment motions including patting and kneading on a treatment subject portion of a user;

a treating unit that supports said treating elements and is shiftable in a shifting direction along said treatment subject portion;

guide rails that guide said treating unit to shift along the treatment subject portion;

supporting means which supports said treating unit with respect to said guide rails; and position altering means which alters the position of said treating unit in a substantially orthogonal direction to said shifting direction with respect to said guide rails;

wherein said supporting means comprises rollers that engage said guide rails and an arm that supports said rollers and is swingably supported by said treating unit, said position altering means serving to cause said arm to undergo a swinging motion and to alter the swinging angle of said arm; and wherein said position altering means serves to alter a swing angle of said arm between a protrusion position in which a swinging center of the arm is positioned closer toward the treatment subject portion away from the rollers such that the treating unit is caused to protrude outward with respect to the guide rails in an approaching direction to the treatment subject portion and a retreat position in which said rollers are positioned closer toward the treatment subject portion away from the swinging center of the arm such that the treating unit is caused to retreat backward with respect to the guide rails in a departing direction from the treatment subject portion.

* * * * *